US007583241B2

(12) United States Patent
Jung

(10) Patent No.: US 7,583,241 B2
(45) Date of Patent: Sep. 1, 2009

(54) PLASMA DISPLAY APPARATUS AND DRIVING METHOD OF THE SAME

(75) Inventor: Yunkwon Jung, Gumi-si (KR)

(73) Assignee: LG Electronics Inc., Seoul (KR)

( * ) Notice: Subject to any disclaimer, the term of this patent is extended or adjusted under 35 U.S.C. 154(b) by 805 days.

(21) Appl. No.: 11/280,449

(22) Filed: Nov. 17, 2005

(65) Prior Publication Data

US 2006/0109211 A1 May 25, 2006

(30) Foreign Application Priority Data

Nov. 19, 2004 (KR) ..... 10-2004-0095455
Jul. 27, 2005 (KR) ..... 10-2005-0068666

(51) Int. Cl.
*G09G 3/28* (2006.01)

(52) U.S. Cl. ..... 345/60; 345/63; 345/66; 345/67

(58) Field of Classification Search ..... 345/60–69; 315/169.1–169.4
See application file for complete search history.

(56) References Cited

U.S. PATENT DOCUMENTS

| | | | | |
|---|---|---|---|---|
| 5,317,334 | A * | 5/1994 | Sano | 345/63 |
| 5,446,344 | A * | 8/1995 | Kanazawa | 315/169.4 |
| 5,790,087 | A * | 8/1998 | Shigeta et al. | 345/67 |
| 6,262,699 | B1 | 7/2001 | Suzuki et al. | 345/68 |
| 6,677,714 | B2 | 1/2004 | Du et al. | 315/169.4 |
| 7,358,931 | B2 | 4/2008 | Mizobata et al. | 345/60 |
| 7,508,359 | B2 | 3/2009 | Han | 345/60 |
| 2002/0195963 | A1 | 12/2002 | Tokunaga et al. | 315/169.3 |
| 2004/0001036 | A1 | 1/2004 | Takayama et al. | 345/62 |

FOREIGN PATENT DOCUMENTS

| | | |
|---|---|---|
| EP | 1 359 563 A2 | 11/2003 |
| JP | 08-305319 | 11/1996 |
| JP | 2001-051649 | 2/2001 |
| JP | 2001-272948 | 10/2001 |

OTHER PUBLICATIONS

European Search Report dated Jan. 16, 2007.
Chinese Office Action dated Sep. 21, 2007.
European Search Report dated Jul. 12, 2006.
European Office Action dated Apr. 22, 2009.
U.S. Office Action dated May 26, 2009.

* cited by examiner

*Primary Examiner*—Vijay Shankar
(74) *Attorney, Agent, or Firm*—Ked & Associates LLP

(57) ABSTRACT

A plasma display apparatus and a driving method of the same are provided. The plasma display apparatus comprises a plasma display panel comprising a scan electrode, a sustain electrode and an address electrode; a first controller for controlling an application time point of the data pulse for the address electrode during address period to be different from an application time point of a scan pulse for the scan electrode; and a second controller for controlling a last sustain pulse applied to at least one of the scan electrode and the sustain electrode, wherein the second controller controls, when the temperature in the plasma display panel or the temperature around the plasma display panel is substantially a high temperature, an interval between the application time point of the last sustain pulse and an initialization signal of a next subfield to be longer than the interval in room temperature.

34 Claims, 36 Drawing Sheets

PLASMA DISPLAY APPARATUS AND DRIVING METHOD OF THE SAME

This Nonprovisional application claims priority under 35 U.S.C. § 119(a) on Patent Application No. 10-2004-0095455 filed in Republic of Korea on Nov. 19, 2004, Patent Application No. 10-2005-0068666 filed in Republic of Korea on Jul. 27, 2005, the entire contents of which are hereby incorporated by reference.

BACKGROUND OF THE INVENTION

1. Field of the Invention

The present invention relates to a plasma display apparatus, and more particularly, to a plasma display apparatus and a driving method of the same, for preventing an erroneous discharge, a mistaken discharge, and an abnormal discharge, increasing a dark room contrast, for increasing an operation margin, and for differently embodying application time points of pulses applied in an address period and a sustain period.

2. Description of the Background Art

In a conventioal plasma display panel, one unit cell is provided at a space between barrier ribs formed between a front panel and a rear panel. A main discharge gas such as neon (Ne), helium (He) or a mixture (He+Ne) of neon and helium and an inert gas containing a small amount of xenon (Xe) fill each cell. When a discharge occurs using a high frequency voltage, the inert gas generates vacuum ultraviolet rays and phosphors provided between the barrier ribs are emitted, thereby realizing an image. The plasma display panel is considered as one of the next generation display devices due to its thin profile and light weigh construction.

FIG. 1 illustrates a structure of a conventional plasma display panel.

As shown in FIG. 1, a plasma display panel includes a front panel 100 and a rear panel 110. The front panel 100 has a plurality of sustain electrode pairs arranged with a scan electrode 102 and a sustain electrode 103 each paired and formed on a front glass 101, which is a display surface for displaying the image thereon. The rear panel 110 has a plurality of address electrodes 113 arranged to intersect with the plurality of sustain electrode pairs on a rear glass 111, which is spaced apart in parallel with and sealed to the front panel 100.

The front panel 100 includes the paired scan electrode 102 and the paired sustain electrode 103 for performing a mutual discharge in one pixel and sustaining an emission of light, that is, the paired scan electrode 102 and the paired sustain electrode 103 each having a transparent electrode (a) formed of indium-tin-oxide (ITO) and a bus electrode (b) formed of metal. The scan electrode 102 and the sustain electrode 103 are covered with at least one dielectric layer 104, which controls a discharge current and insulates the paired electrodes. A protective layer 105 is formed of oxide magnesium (MgO) on the dielectric layer 104 to facilitate a discharge.

The rear panel 110 includes stripe-type (or well-type) barrier ribs 112 for forming a plurality of discharge spaces (that is, discharge cells) that are arranged in parallel. The rear panel 110 includes a plurality of address electrodes 113 arranged in parallel with the barrier ribs 112 and performing an address discharge and generating the vacuum ultraviolet rays. Red (R), green (G) and blue (B) phosphors 114 emit visible rays for displaying the image in the address discharge and are coated over an upper surface of the rear panel 110. Lower dielectric layer 115 for protecting the address electrode 113 is formed between the address electrode 113 and the phosphor 114.

In the above constructed plasma display panel, electrodes are arranged in a matrix form, and this will be described with reference to FIG. 2 below.

FIG. 2 illustrates an arrangement structure of the electrodes formed on the conventional plasma display panel.

Referring to FIG. 2, the scan electrodes (Y1 to Yn) are formed to be in parallel with the sustain electrodes (Z1 to Zn) on the plasma display panel 200, and the address electrodes (X1 to Xm) are formed to intersect with the scan electrodes (Y1 to Yn) and the sustain electrodes (Z1 to Zn).

The discharge cells are formed at intersections of the scan electrodes (Y1 to Yn), the sustain electrodes (Z1 to Zn), and the address electrodes (X1 to Xm). Accordingly, the discharge cell is formed in a matrix form on the plasma display panel.

Driving circuits for supplying a predetermined pulse are attached to the plasma display panel having the above arranged electrodes, thereby constructing the plasma display apparatus.

The method for embodying the image gray level in the plasma display apparatus is illustrated in FIG. 3 below.

FIG. 3 illustrates the method for expressing the gray level of the image in the conventional plasma display apparatus.

As shown in FIG. 3, in the conventional method for expressing the image gray level in the plasma display apparatus, one frame is divided into several subfields, each subfield having a different number of emissions. Each subfield is divided into a reset period (RPD) for initializing all cells, an address period (APD) for selecting the discharge cell, and a sustain period (SPD) for expressing the gray level depending on the number of discharges. For example, when the image is displayed in 256 gray levels, as shown in FIG. 2, a frame period (16.67 ms) corresponding to a 1/60 second is divided into eight subfields (SF1 to SF8), and each of the eight subfields (SF1 to SF8) is divided into the reset period, the address period, and the sustain period.

Each subfield has the same period of reset period and the address period. The address discharge for selecting the cell to be discharged is generated by a voltage difference between the address electrode and the scan electrode being the transparent electrode. The sustain period is increased in a ratio of $2^n$ (n=0, 1, 2, 3, 4, 5, 6, 7) for each subfield. Since the sustain period is different for each subfield as described above, the sustain period of each subfield (that is, the number of sustain discharges) is controlled, thereby expressing the image gray level.

FIG. 4 is a waveform diagram illustrating an example of the driving waveform of the conventional plasma display panel. FIGS. 5A to 5E are stepwise diagrams illustrating a distribution of the wall charges within the discharge cell varied by the driving waveform of FIG. 4.

The driving waveform of FIG. 4 will be described with reference to the wall charge distributions of FIGS. 5A to 5E.

Referring to FIG. 4, each of the subfields (SFn−1and SFn) includes the reset period (RP) for initializing the discharge cells 1 of a whole screen, the address period (AP) for selecting the discharge cell, the sustain period (SP) for sustaining discharge of the selected discharge cell 1, and the erasure period (EP) for erasing the wall charges within the discharge cell 1.

In the erasure period (EP) of the (n−1)th subfield (SFn−1), an erasure ramp waveform (ERR) is applied to the sustain electrodes (Z). During the erasure period (EP), 0V is applied to the scan electrodes (Y) and the address electrodes (X). The erasure ramp waveform (ERR) is a positive ramp waveform having a voltage that gradually increases from 0V to a positive sustain voltage (Vs). During the erasure ramp waveform (ERR), an erasure discharge is generated between the scan electrode (Y) and the sustain electrode (Z) within on-cells. During the erasure discharge, the wall charges are erased within on-cells. As a result, each discharge cell 1 has the wall charge distribution soon after the erasure period (EP) as in FIG. 5A.

In a setup period (SU) of the reset period (RP) where the nth subfield (SFn) begins, the positive ramp waveform (PR) is applied to all scan electrodes (Y), and 0V is applied to the sustain electrodes (Z) and the address electrodes (X). During the positive ramp waveform (PR) of the setup period (SU), voltages of the scan electrodes (Y) gradually increase from the positive sustain voltage (Vs) to a reset voltage (Vr) more than the positive sustain voltage (Vs). During the positive ramp waveform (PR), a dark discharge is generated between the scan electrodes (Y) and the address electrodes (X) within the discharge cells of the entire screen and concurrently, the dark discharge is generated between the scan electrodes (Y) and the sustain electrodes (Z). As a result of the dark discharge, soon after the setup period (SU), as shown in FIG. 5B, positive wall charges remain on the address electrodes (X) and the sustain electrodes (Z), and negative wall charges remain on the scan electrode (Y). In the setup period (SU), while the dark discharge is generated, gap voltages (Vg) between the scan electrodes (Y) and the sustain electrodes (Z) and gap voltages between the scan electrodes (Y) and the address electrodes (X) are initialized to a voltage close to a discharge firing voltage (Vf) that is capable of generating a discharge.

Subsequent to the setup period (SU), in a setdown period (SD) of the reset period (RP), a negative ramp waveform (NR) is applied to the scan electrodes (Y). At the same time, the positive sustain voltages (Vs) are applied to the sustain electrodes (Z) and 0V is applied to the address electrodes (X). During the negative ramp waveform (NR), voltages of the scan electrodes (Y) gradually decrease from the positive sustain voltage (Vs) to the negative erasure voltage (Ve). During the negative ramp waveform (NR), the dark discharge is generated between the scan electrodes (Y) and the address electrodes (X) within the discharge cell of the whole screen and concurrently, the dark discharge is generated even between the scan electrodes (Y) and the sustain electrodes (Z). As a result of the dark discharge of the setdown period (SD), the wall charge distribution within each discharge cell 1 is changed to have an optimal condition for address dischrgae as in FIG. 5C. At this time, excessive wall charges unnecessary for the address discharge are erased and a predetermined amount of wall charges remain on the scan electrodes (Y) and the address electrodes (X) within each discharge cell 1. The wall charges on the sustain electrodes (Z) are converted from a positive polarity to a negative polarity while the negative wall charges are moved from the scan electrodes (Y) and accumulated. In the setdown period (SD) of the reset period (RP), while the dark discharge is generated, the gap voltages between the scan electrodes (Y) and the sustain electrodes (Z), and the gap voltages between the scan electrodes (Y) and the address electrodes (X) are close to the discharge firing voltage (Vf).

In the address period (AP), negative scan pulses (−SCNP) are sequentially applied to the scan electrodes (Y) and at the same time, the scan electrodes (Y) are synchronized with the negative scan pulses (−SCNP), so that the positive data pulses (DP) are applied to the address electrodes (X). A scan pulse (−SCNP) voltage is a scan voltage that decreases from 0V or a negative scan bias voltage (Vyb) close to 0V to a negative scan voltage (−Vy). A data pulse voltage (DP) is the positive data voltage (Va). During the address period (AP), a positive Z bias voltage (Vzb) that is less than the positive sustain voltage (Vs) is supplied to the sustain electrodes (Z). Where the gap voltage is maintained at a level close to the discharge firing voltage (Vf) soon after the reset period (RP), the gap voltage between the scan electrodes (Y) and the address electrodes (X) exceeds the discharge firing voltage (Vf) while the address discharge is generated between the electrodes (X and Y) within the on-cells to which the scan voltage (Vsc) and the data voltage (Va) are applied. A primary address discharge between the scan electrodes (Y) and the address electrodes (X) generates priming charged particles within the discharge cell and, as in FIG. 5D, induces a secondary discharge between the scan electrodes (Y) and the sustain electrodes (Z). The wall charge distribution within the on-cells generating the address discharge is as shown in FIG. 5E.

The wall charge distribution within off-cells not generating the address discharge substantially maintains a state shown in FIG. 5C.

In the sustain period (SP), the sustain pulses (SUSP) of the positive sustain voltage (Vs) are alternately applied to the scan electrodes (Y) and the sustain electrodes (Z). In the on-cells selected by the address discharge, the sustain discharge is generated between the scan electrodes (Y) and the sustain electrodes (Z) for each sustain pulse (SUSP) with the assistance of the wall charge distribution of FIG. 5E. In the off-cells, the discharge is not generated during the sustain period. This is because the wall charge distribution of the off-cells is maintained in a state as shown in FIG. 5C so that, when an initial sustain voltage (Vs) is applied to the scan electrodes (Y), the gap voltage between the scan electrodes (Y) and the sustain electrodes (Z) cannot exceed the discharge firing voltage (Vf).

However, in the conventional plasma display apparatus, there is a drawback in that, during the erasure period (EP) of the (n−1)th subfield (SFn−1) and the reset period (RP) of the nth subfield (SFn), the discharge is generated several times to initialize the discharge cells 1 and to control the wall charges, thereby reducing the darkroom contrast and reducing a contrast ratio. Table 1 below is an arrangement of a discharge type and the number of discharges generated in the erasure period (EP) and the reset period (RP) of the previous subfield (SFn−1) in the conventional plasma display apparatus.

TABLE 1

| | period | Operation | | |
|---|---|---|---|---|
| | | | RP of SFn | |
| | Cell state | EP of SFn-1 | SU | SD |
| On-cell turned on in SFn-1 | Opposite discharge (Y-X) | X | ○ | ○ |
| | Surface discharge (Y-Z) | ○ | ○ | ○ |
| Off-cell turned off in SFn-1 | Opposite discharge (Y-X) | X | ○ | ○ |
| | Surface discharge (Y-Z) | X | ○ | ○ |

As shown in Table 1, in the on-cells turned on in the (n−1)th subfield (SFn−1), during the erasure period (EP) and the reset period (RP), a surface discharge between the scan electrodes (Y) and the sustain electrodes (Z) is generated three times, and an opposite discharge between the scan electrodes and the address electrodes is generated two times. In the off-cells turned off in the previous subfield (SFn), during the erasure period (EP) and the reset period (RP), the surface discharge between the scan electrodes (Y) and the sustain electrodes (Z) is generated two times, and an opposite discharge between the scan electrodes (Y) and the address electrodes (X) is generated two times.

The discharges generated several times during the erasure period and the reset period increase the emissions in the erasure period and the reset period when the amount of emissions should be minimized if possible in consideration of a contrast characteristic, thereby causing a reduction of the darkroom contrast value. In particular, the surface discharge between the scan electrodes (Y) and the sustain electrodes (Z) provides a significant light emission in comparison to the opposite discharge between the scan electrodes (Y) and the address electrodes (X) and therefore, has a negative influence on the darkroom contrast in comparison with the opposite discharge.

In the conventional plasma display apparatus, in the erasure period (EP) of the (n−1)th subfield (SFn−1), the wall charges are not completely erased and therefore, where the negative wall charges are excessively accumulated on the scan electrodes (Y), the dark discharge is not generated in the setup period (SU) of the nth subfield (SFn). If the dark discharge is not normally generated in the setup period (SU), the discharge cells are not initialized. To generate the discharge in the setup period, the reset voltage (Vr) must be increased. If the dark discharge is not generated in the setup period (SU), the discharge cell is not in the optimal address condition soon after the reset period, thereby causing an abnormal discharge or an erroneous discharge. Where the positive wall charges are excessively accumulated on the scan electrodes (Y) soon after the erasure period (EP) of the (n−1)th subfield (SFn−1), in the setup period (SU) of the nth subfield (SFn), when the positive sustain voltage (Vs) being an initiation voltage of the positive ramp waveform (PR) is applied to the scan electrodes (Y), an excessive discharge is generated, thereby not uniformly initializing all of the cells.

FIG. 6 illustrates variations of an external voltage applied between the scan electrode and the sustain electrode and the gap voltage within the discharge cell in the setup period when the plasma display panel is driven by the driving waveform of FIG. 4.

FIG. 6 illustrates the external application voltage (Vyz) between the scan electrodes (Y) and the sustain electrodes (Z) and the gap voltage (Vg) within the discharge cell in the setup period (SU). In FIG. 6, the external application voltage indicated by a solid line is an external voltage applied to each of the scan electrodes (Y) and the sustain electrodes (Z) and is about equal to the voltage of the positive ramp waveform (PR) since 0V is applied to the sustain electrodes (Z). In FIG. 6, dotted lines ①, ② and ③ denote the gap voltages (Vg) provided for a discharge gas by the wall charges within the discharge cell. The gap voltage (Vg) varies as shown by the dotted lines ①, ② and ③ since the number of wall charges within the discharge cell varies by an amount depending on whether or not the discharge is generated in the previous subfield. The relationship between the external application voltage (Vyz) between the scan electrodes (Y) and the sustain electrodes (Z) and the gap voltage (Vg) provided for the discharge gas within the discharge cell is expressed in Equation 1 below.

$$Vyz=Vg+Vw \quad \text{[Equation 1]}$$

In FIG. 6, the gap voltage (Vg) of the dotted line ① represents the wall charges that are sufficiently erased within the discharge cell, thereby the wall charges are sufficiently reduced. The gap voltage (Vg) increases in proportion to the external application voltage (Vyz). When the gap voltage (Vg) equals the discharge firing voltage (Vf), the dark discharge is generated. Due to this dark discharge, the gap voltage within the discharge cells is initialized to the discharge firing voltage (Vf).

In FIG. 6, the gap voltage (Vg) of the dotted line ② represents a strong discharge generated during the erasure period of the (n−1)th subfield (SFn−1). The gap voltage (Vg) inverts the polarities of the wall charges in the wall charge distribution within the discharge cells. Soon after the erasure period (EP), the polarities of the wall charges accumulated on the scan electrodes (Y) are converted into the positive polarities due to the strong discharge. This occurs because there is low uniformity among the discharge cells or there is a variation of a slope of the erasure ramp waveform (ERR) depending on temperature variation where there is a large sized PDP. The initial gap voltage (Vg) increases too much as shown in the dotted line ② of FIG. 6 and therefore, in the setup period (SU), the positive sustain voltage (Vs) is applied to the scan electrodes (Y) and at the same time, the gap voltage (Vg) exceeds the discharge firing voltage (Vf), thereby generating the strong discharge. Due to this strong discharge, in the setup period (SU) and the setdown period (SD), the discharge cells are not initialized in the wall charge distribution of the optimal address condition, that is, in the wall charge distribution of FIG. 4C. Therefore, the address discharge can be generated in the off-cells that need to be turned off. In other words, when the erasure discharge is strongly generated in the erasure period prior to the reset period, an erroneous discharge can occur.

In FIG. 6, during the erasure period (EP) of the (n−1)th subfield (SFn−1), the gap voltage (Vg) of the dotted line ③ represents the erasure discharge that is very weak or not generated, which maintains the wall charge distribution that is formed as a result of the sustain discharge generated just before the erasure discharge within the discharge cells. In a detailed description, as shown in FIG. 3, the last sustain discharge is generated when the sustain pulse (SUSP) is applied to the scan electrodes (Y). As a result of the last sustain discharge, the negative wall charges remain on the scan electrodes (Y) and the positive wall charges remain on the sustain electrodes (Z). However, such wall charges need to be erased to perform a normal initialization in a next subfield but when the erasure discharge is very weak or is not generated, the polarity does not change. A reason why the erasure discharge is very weak or is not generated is that in the PDP, the discharge cells are non-uniform in uniformity or the erasure ramp waveform (ERR) is varied in slope depending on the temperature variation. The initial gap voltage (Vg) is too low to have the negative polarity as shown in the dotted line ③ of FIG. 6 and therefore, even though the positive ramp waveform (PR) increases up to the reset voltage (Vr) in the setup period, the gap voltage (Vg) within the discharge cells does not equal the discharge firing voltage (Vf). Therefore, the dark discharge is not generated in the setup period (SU) and the setdown period (SD). As a result, where the erasure discharge is very weak or is not generated in the erasure period prior to the reset period, the initialization is not performed properly, thereby causing an erroneous discharge or an abnormal discharge.

In the dotted line ② of FIG. 6, the relationship between the gap voltage (Vg) and the discharge firing voltage (Vf) is expressed as shown in Equation 2, and shown in the dotted line ③ of FIG. 6, the relationship between the gap voltage (Vg) and the discharge firing voltage (Vf) is expressed as in Equation 3:

$$Vgini+Vs>Vf \quad \text{[Equation 2]}$$

$$Vgini+Vr<Vf \quad \text{[Equation 3]}$$

where, Vgini represents initial gap voltage just before the setup period (SU) is initiated as shown in FIG. 6.

A gap voltage condition (or wall charge condition) for performing the normal initialization in the erasure period (EP) and the reset period (RP) considering the above drawbacks is expressed in the following Equation 4 that satisfys Equations 2 and 3:

$$Vf-Vr<Vgini<Vf-Vs \quad \text{[Equation 4]}$$

If the initial gap voltage (Vgini) does not satisfy the condition of the Equation 4 before the setup period (SU), the conventional plasma display apparatus can cause an erroneous discharge, a mistaken discharge, or an abnormal discharge and a decrease in the operational margin. In other words, in the conventional plasma display apparatus, to secure the operational reliability and the operation margin, an erasure operation in the erasure period (EP) should be normally performed but, as aforementioned, can be abnormally performed depending on the uniformity of the discharge cell or the use temperature of the PDP.

In the conventional plasma display apparatus, there is a drawback in that, due to excessive space charges apprearing in a high temperature environment and the active motion of the space charges, the wall charge distribution becomes unstable, thereby causing the erroneous discharge, the misdischarge, or the abnormal discharge and therefore, the operational margin decreases. This will be described in detail with reference to FIGS. 7A to 7C.

FIGS. 7A to 7C illustrate the space charges and the motion of the space charges when the plasma display panel is driven in a high temperature environment by the driving waveform of FIG. 4.

In a high temperature environment, the quantity and the momentum of the space charges generated in a discharge are increased more than in a room temperature or in a low temperature. Accordingly, in the sustain discharge of the (n−1)th subfield (SFn−1), many space charges are generated, and soon after the setup period (SU) of the nth subfield (SFn), as shown in FIG. 7A, many space charges 300 that are in active motion remain within a discharge space.

As in FIG. 7A, where the space charges 300 in active motion exist within the discharge space, during the address period, the data voltage (Va) is applied to the address electrode (X), and the scan voltage (−Vy) is applied to the scan electrode (Y). As shown in FIG. 7B, as a result of the setup discharge of the setup period (SU), the positive space charges 300 are recombined with the negative wall charges accumulated on the scan electrode (Y), and the negative space charges 300 are recombined with the positive wall charges accumulated on the address electrode (Y) as a result of the setup discharge.

As shown in FIG. 7C, the negative wall charges on the scan electrode (Y) and the positive wall charges on the address electrode (X) formed by the setup discharge are erased so that, though the data voltage (Va) and the scan voltage (−Vy) are applied to the address electrode (X) and the scan electrode (Y), the gap voltage (Vg) does not equal the discharge firing voltage (Vf). Therefore, the address discharge is not generated. Accordingly, there is a drawback in that, when the driving waveform of FIG. 4 is applied to a PDP used in a high temperature environment, mistaken writing of the on-cells will occur frequently.

FIG. 8 illustrates another example of the driving waveform according to a conventional driving method of the plasma display apparatus.

As shown in FIG. 8, in the plasma display apparatus, all of the cells are driven with the subfield divided into the reset period for initializing all cells, the address period for selecting the discharge cell, the sustain period for sustaining the discharge of the selected cell, and the erasure period for erasing the wall charges within the discharged cell.

In the setup period of the reset period, the ramp-up waveform (ramp-up) is concurrently applied to all scan electrodes (Y). During this ramp-up waveform, a weak dark discharge is generated within the discharge cells of the whole screen. Due to this setup discharge, the positive wall charges are accumulated on the address electrode (X) and the sustain electrode (Z) and the negative wall charges are accumulated on the scan electrode (Y).

In the setdown period, the ramp-up waveform is applied and then, a ramp-down waveform which falls from a positive voltage less than a peak voltage of the ramp-up waveform to a specific voltage level less than a ground level(GND) generates a weak erasure discharge within the cells, thereby sufficiently erasing the wall charges excessively formed in the scan electrode (Y). Due to setdown discharge, there are enough wall charges to generate a stable address discharge, which will uniformly remain within the cells.

In the address period, the negative scan pulses are sequentially applied to the scan electrodes (Y) and at the same time, the scan electrodes (Y) are synchronized with the scan pulses, thereby applying the positive data pulse to the address electrode (X). As a voltage difference between the scan pulse and the data pulse is added to a wall voltage generated in the reset period, the address discharge is generated within the discharge cell to which the data pulse is applied. The wall charges are formed within the cells selected by the address discharges, so that the discharge is generated when the sustain voltage (Vs) is applied. The positive voltage (Vz) is supplied to the sustain electrode so that, during the setdown period and the address period, the voltage difference with the scan electrode decreases, thereby preventing an erroneous discharge with the scan electrode.

In the sustain period, the sustain pulse (Sus) is alternately applied to the scan electrode (Y) and the sustain electrode (Z). In the cell selected by the address discharge, while the wall voltage within the cell is added to the sustain pulse, the sustain discharge, that is, the display discharge is generated between the scan electrode (Y) and the sustain electrode (Z) whenever the sustain pulse is applied.

After the completion of the sustain discharge, the erasure period can also be included. In this erasure period, a voltage of an erasure ramp waveform (ramp-ers) having a narrow pulsewidth and a low voltage level is supplied to the sustain electrode (Z), thereby erasing the remaining wall charges within the cells of the whole screen.

In the plasma display apparatus driven using the driving waveform, in the address period, the application time point of the scan pulse applied to the scan electrode (Y) is the same as application time points of the data pulses applied to the address electrodes (X1 to Xn). In the conventional driving method, the application time points of the scan pulse and the data pulse in the address period will be described with reference to FIG. 9 below.

FIG. 9 illustrates the application time point of the pulse applied in the address period in the conventional driving method of the plasma display apparatus.

As shown in FIG. 9, in the driving method of the conventional plasma display apparatus, in the address period, all data pulses are applied to the address electrodes (X1 to Xn) at the same time (ts) as the scan pulses are applied to the scan electrode (Y). If the data pulse and the scan pulse are applied to the address electrodes (X1 to Xn) and the scan electrode (Y) at the same time point, respectively, noise is generated in a waveform applied to the scan electrode (Y) and a waveform applied to the sustain electrode (Z). An example of the noise generated when the data pulse and the scan pulse are applied to the address electrodes (X1 to Xn) and the scan electrode at the same time point, respectively will be described with reference to FIG. 10 below.

FIG. 10 illustrates the generation of noise resulting from the pulses applied in the address period in the conventional driving method of the plasma display apparatus.

As shown in FIG. 10, in the conventional driving method of the plasma display apparatus, if the data pulse and the scan pulse are applied to the address electrodes (X1 to Xn) and the scan electrode (Y) in the address period, respectively, noise is generated in the waveform applied to the scan electrode (Y) and the sustain electrode (Z). The noise is generated due to coupling through the capacitance of a PDP. At a time point when the data pulse rises abruptly, a rising noise is generated in the waveform applied to the scan electrode (Y) and the sustain electrode (Z), and at a time point when the data pulse falls abruptly, a falling noise is generated in the waveform applied to the scan electrode (Y) and the sustain electrode (Z).

As mentioned above, there is a drawback in that the scan pulse applied to the scan electrode (Y) and concurrently, the data pulse applied to the address electrode (X) result in noise being generated in the waveform applied to the scan electrode (Y) and the sustain electrode (Z) which then causes an unstable address discharge to be generated in the address period, thereby reducing the driving efficiency of the plasma display panel.

In the conventional plasma display apparatus driven using the driving waveform, the erroneous discharge is generally caused by a temperature around the panel that is high. The erroneous discharge caused by the temperature will be described with reference to FIG. 11 below.

FIG. 11 illustrates the erroneous discharge depending on the temperature in the plasma display apparatus operating by the driving waveform based on the conventional driving method.

Referring to FIG. 11, in the plasma display apparatus operating by the driving waveform according to the conventional driving method, when the temperature around the panel is relatively high, a recombination ratio of the space charges 401 to the wall charges 400 within the discharge cell is increased, and an absolute amount of the wall charges participating in the discharge decreases, thereby causing the erroneous discharge. The space charges 401 exist in the space within the discharge cell, and do not take part in the discharge unlike the wall charges 400.

For example, the recombination ratio of the space charges 401 to the wall charges 400 increases in the address period and the amount of the wall charges 400 taking part in the address discharge decreases, thereby destabilizing the address discharge. As addressing is performed later, a time for recombining the space charges 401 and the wall charges 400 is sufficiently secured. Therefore, the address discharge is more unstable. Accordingly, a high temperature erroneous discharge occurs, thereby turning-off the turned-on discharge cell of the address period, in the sustain period.

Where the temperature around the panel is relatively high, upon generation of the sustain discharge in the sustain period, the space charges 401 are speeded up in the discharge and accordingly, the recombination ratio of the space charges 401 to the wall charges 400 increases. Accordingly, there is a drawback in that after any one sustain discharge, the recombination of the space charges 401 and the wall charges 400 causes the wall charges 400 participating in the sustain discharge to decrease in amount, thereby causing the high temperature erroneous discharge that does not generate a next sustain discharge.

SUMMARY OF THE INVENTION

Accordingly, an object of the present invention is to solve at least the problems and disadvantages of the background art.

An object of the present invention is to provide a plasma display apparatus and a driving method of the same, for stabilizing a discharge in a high temperature environment.

Another object of the present invention is to provide a plasma display apparatus and a driving method of the same, for setting an application time point of a data pulse applied to an address electrode (X) to be different from the application time point of a scan pulse applied to a scan electrode (Y), and also improving a waveform applied in a sustain period, thereby reducing noise and preventing address margin decreases while reducing erroneous discharges.

To achieve these and other advantages and in accordance with the purpose of the present invention, as embodied and broadly described, there is provided a plasma display apparatus including: a plasma display panel including a scan electrode, a sustain electrode and an address electrode; a first controller for setting an application time point of the data pulse for the address electrode during address period to be different from an application time point of a scan pulse for the scan electrode; and a second controller for controlling a last sustain pulse applied to at least one of the scan electrode and the sustain electrode, wherein the second controller, when the temperature in the plasma display panel or the temperature around the plasma display panel is too high, sets an interval between the application time point of the last sustain pulse and an initialization signal of a next subfield to be more than the interval at room temperature.

The present invention can reduce noise, and stabilize discharges of a PDP in a high temperature environment, thereby suppressing generation of an erroneous discharge depending on temperature related.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
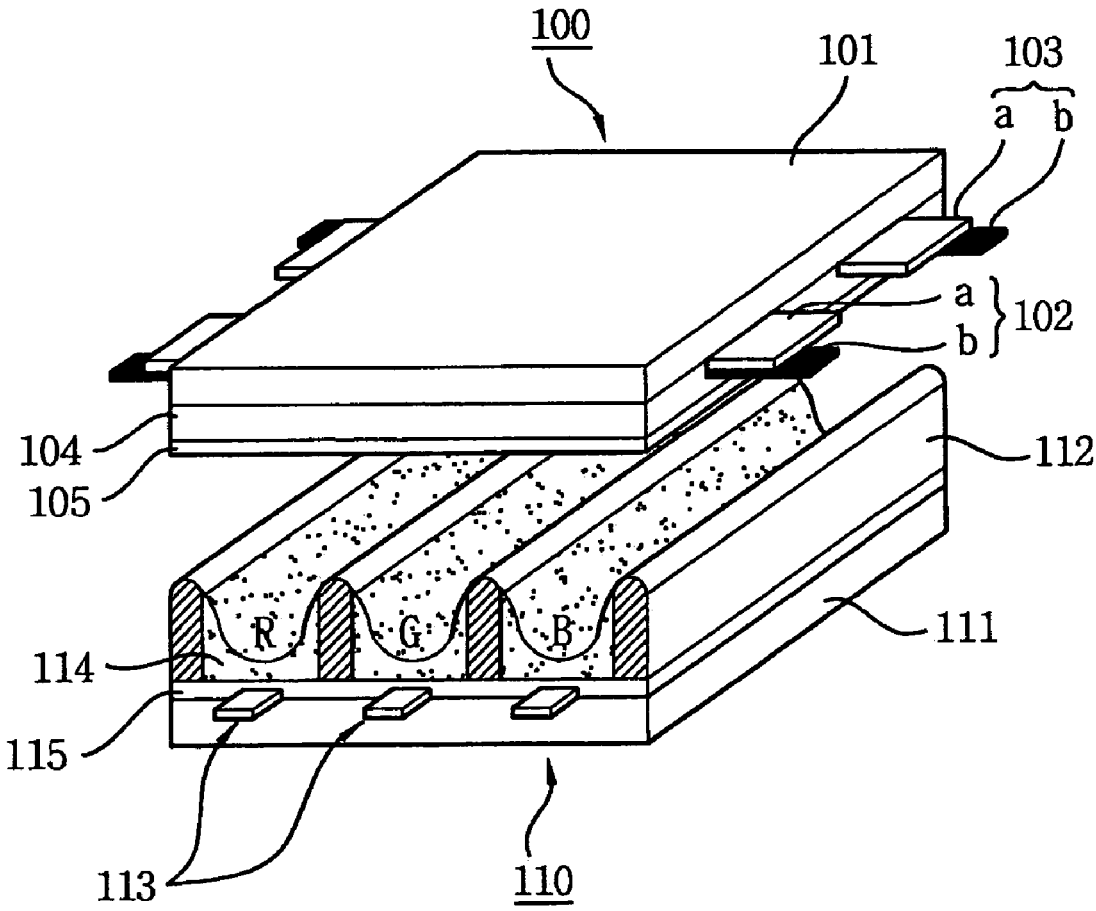
FIG. 1 illustrates a construction of a conventional plasma display panel.
Figure 2:
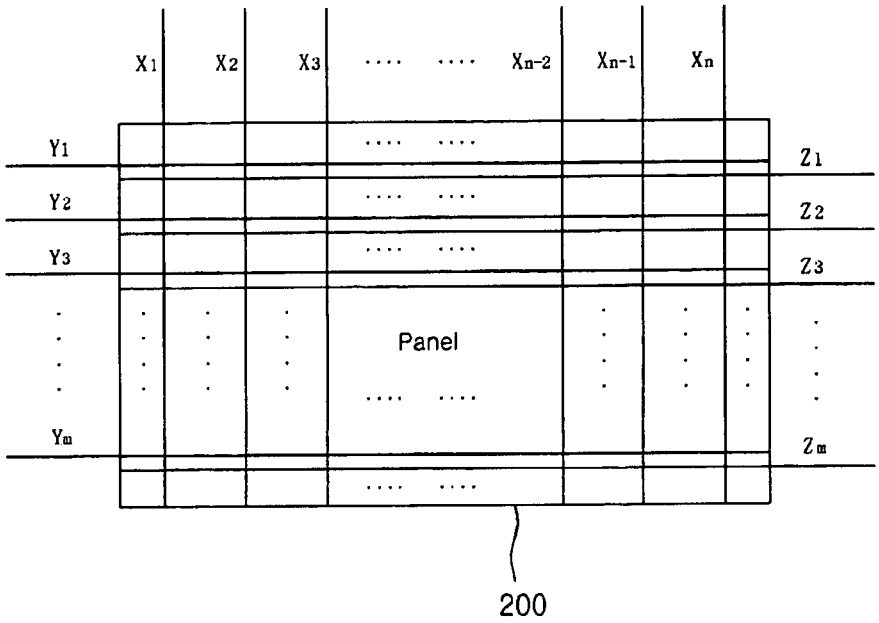
FIG. 2 illustrates an arrangement structure of electrodes formed on a conventional plasma display panel.
Figure 3:
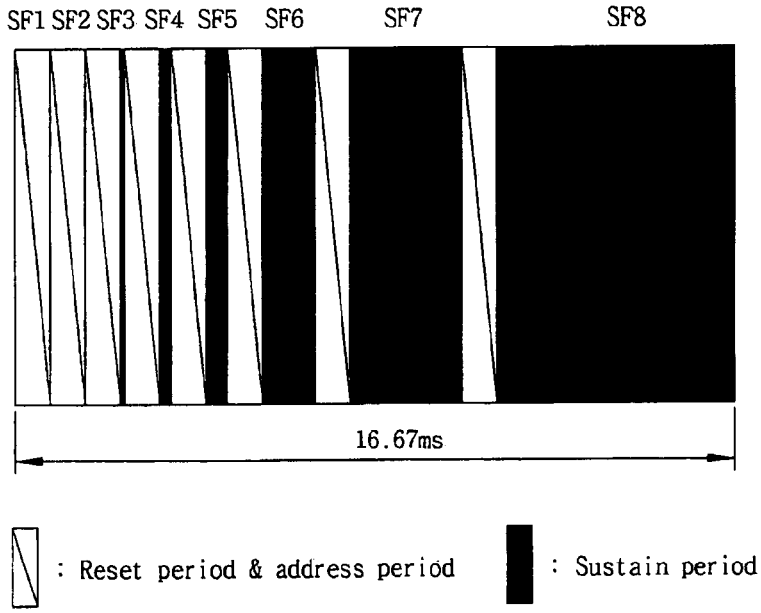
FIG. 3 illustrates a method for expressing a gray level of an image in a conventional plasma display apparatus.
Figure 12:
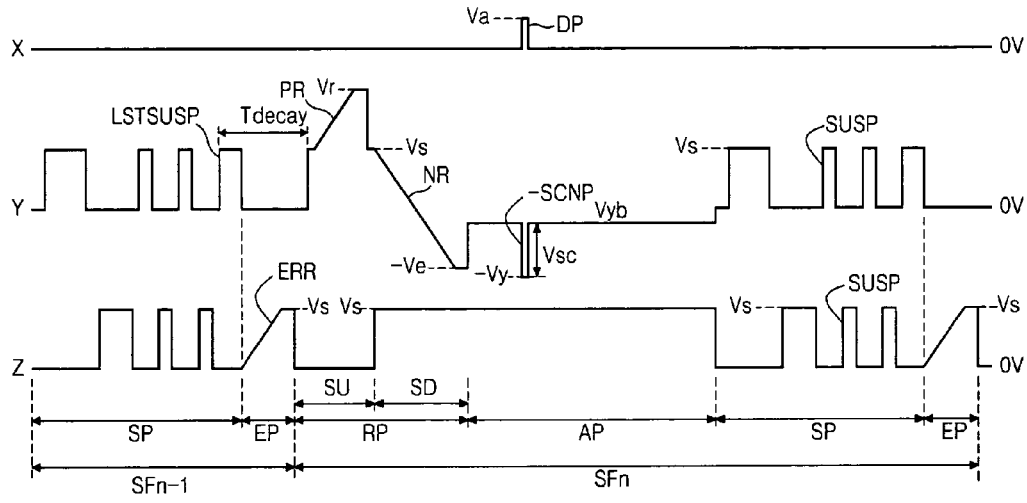
FIG. 12 is a waveform diagram illustrating a driving method of a plasma display apparatus according to the first embodiment of the present invention.

FIG. 12 is a waveform diagram illustrating a driving method of a plasma display apparatus according to the first embodiment of the present invention. A driving waveform of FIG. 12 is applied to a three-electrode alternating current surface discharge type plasma display panel (PDP) shown in FIG. 2.

Referring to FIG. 12, each subfield (SFn−1and SFn) includes a reset period (RP) for initializing discharge cells of a whole screen, an address period (AP) for selecting the discharge cell, a sustain period (SP) for sustaining discharge of the selected discharge cell and an erasure period (EP) for erasing the wall charges within the discharge cell.

Figure 4:
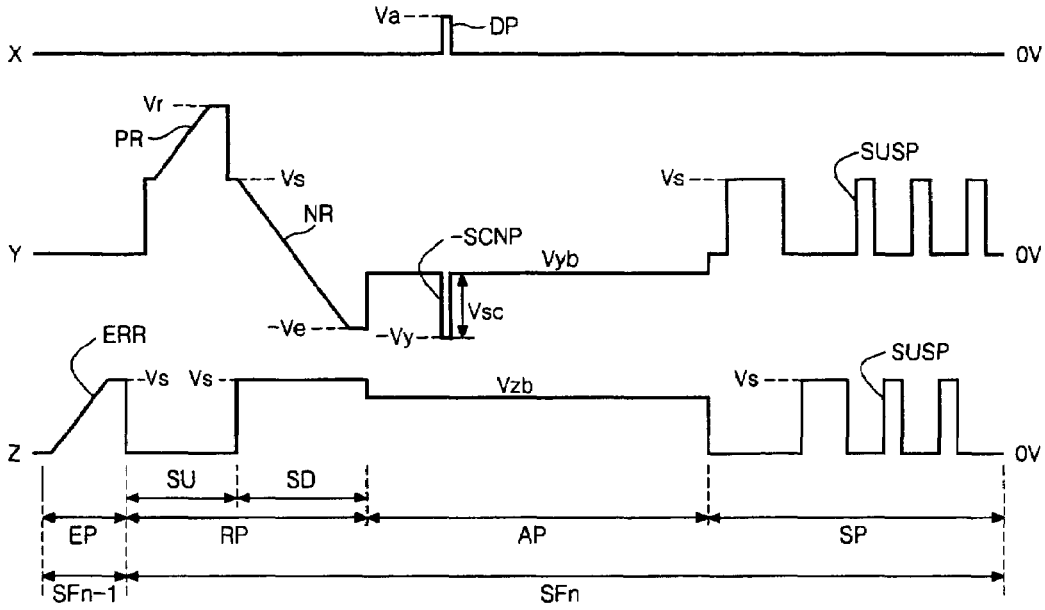
FIG. 4 is a waveform diagram illustrating an example of a driving waveform of a conventional plasma display panel.

The reset period (RP), the address period (AP), and the sustain period (SP) are the same as those of the driving waveform of FIG. 4 and therefore, a detailed description thereof will be omitted.

In the driving method of the plasma display apparatus according to the first embodiment of the present invention, in a high temperature environment of more than 40° C., a space charge decay time (Tdecay) for generating decay of space charges is set to be between a rising time point of a last sustain pulse (LSTSUSP) of the (n−1)th subfield (SFn−1) and a rising time point of a positive ramp waveform (PR) at which the reset period (RP) of the nth subfield (SFn) is initiated.

Figure 5A:
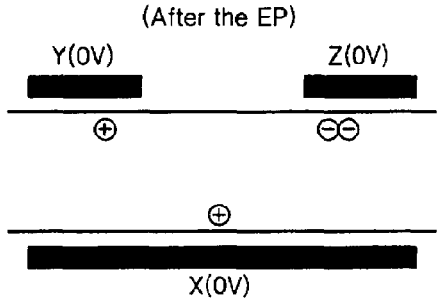
FIGS. 5A to 5E are stepwise diagrams illustrating a distribution of wall charges within a discharge cell varied by a driving waveform of FIG. 4.
Figure 5B:
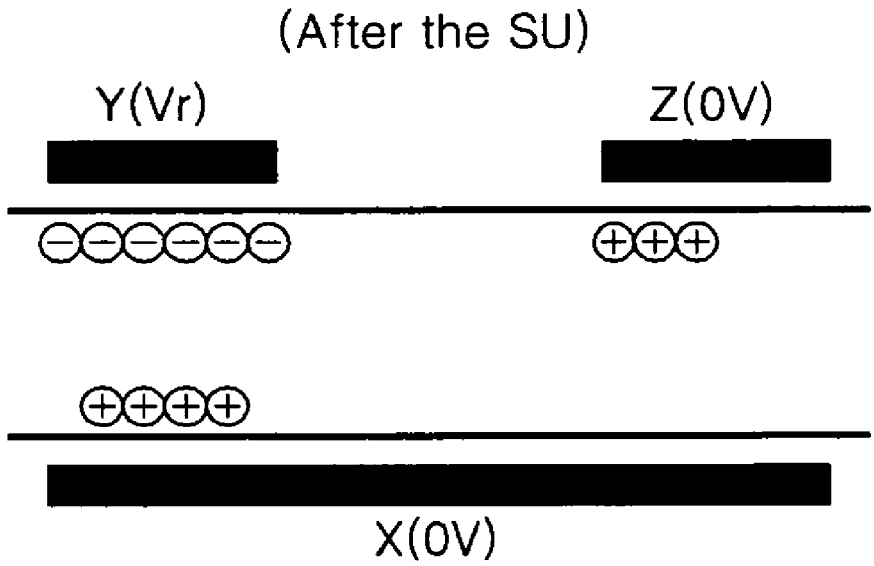
Figure 5C:
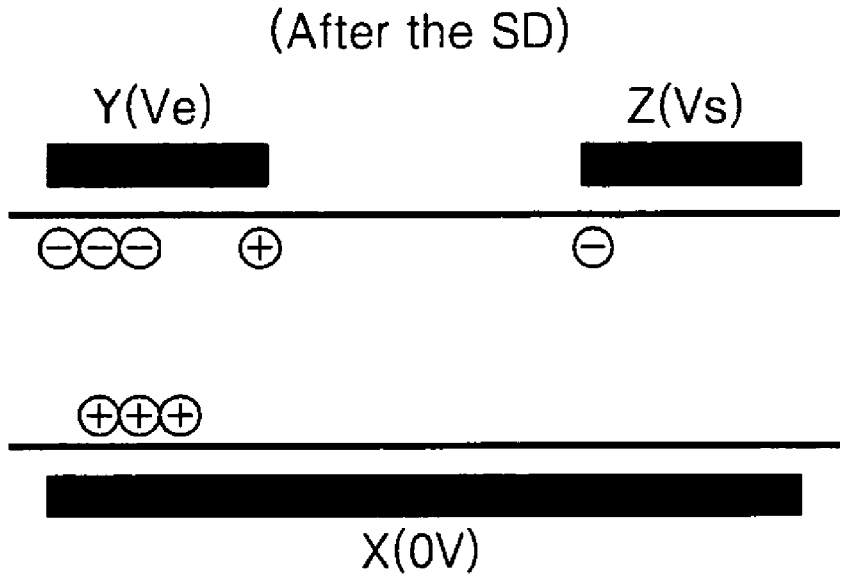
Figure 5D:
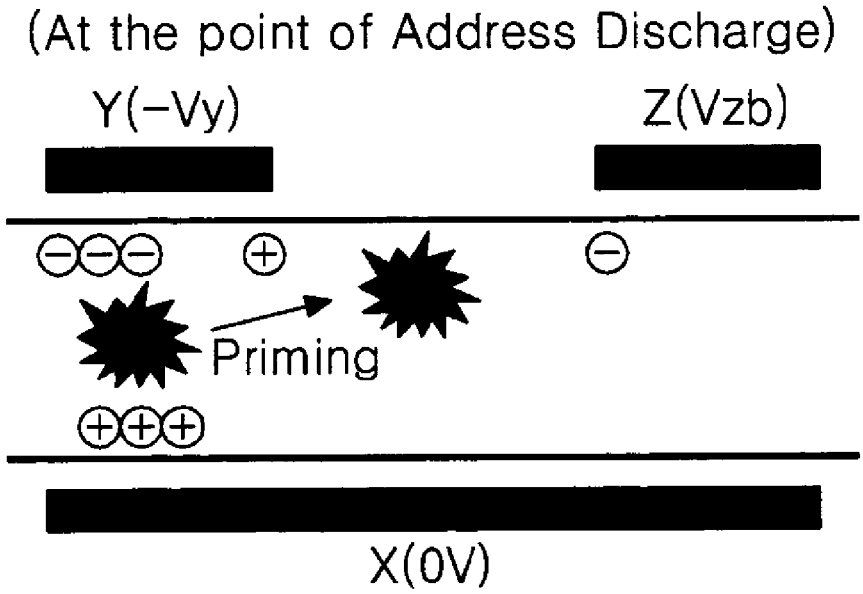
Figure 5E:
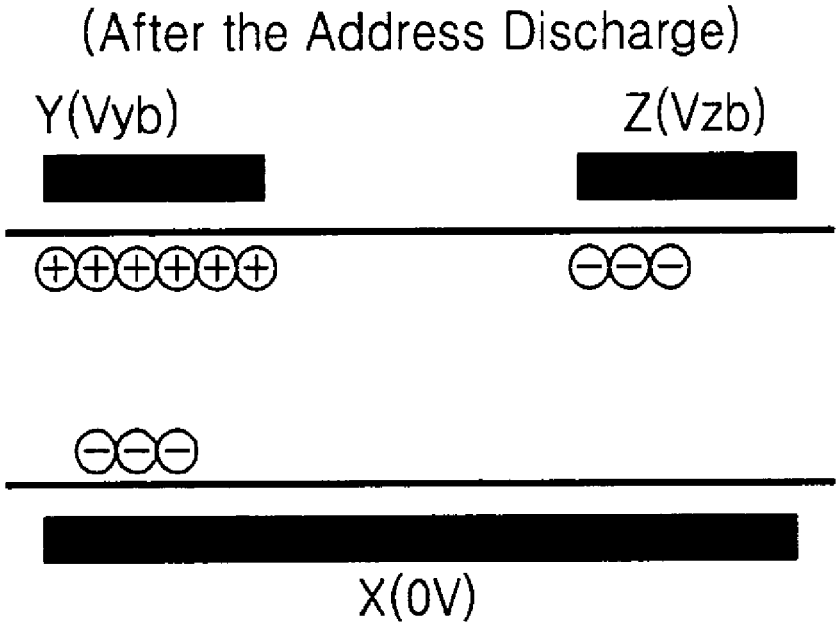
Figure 6:
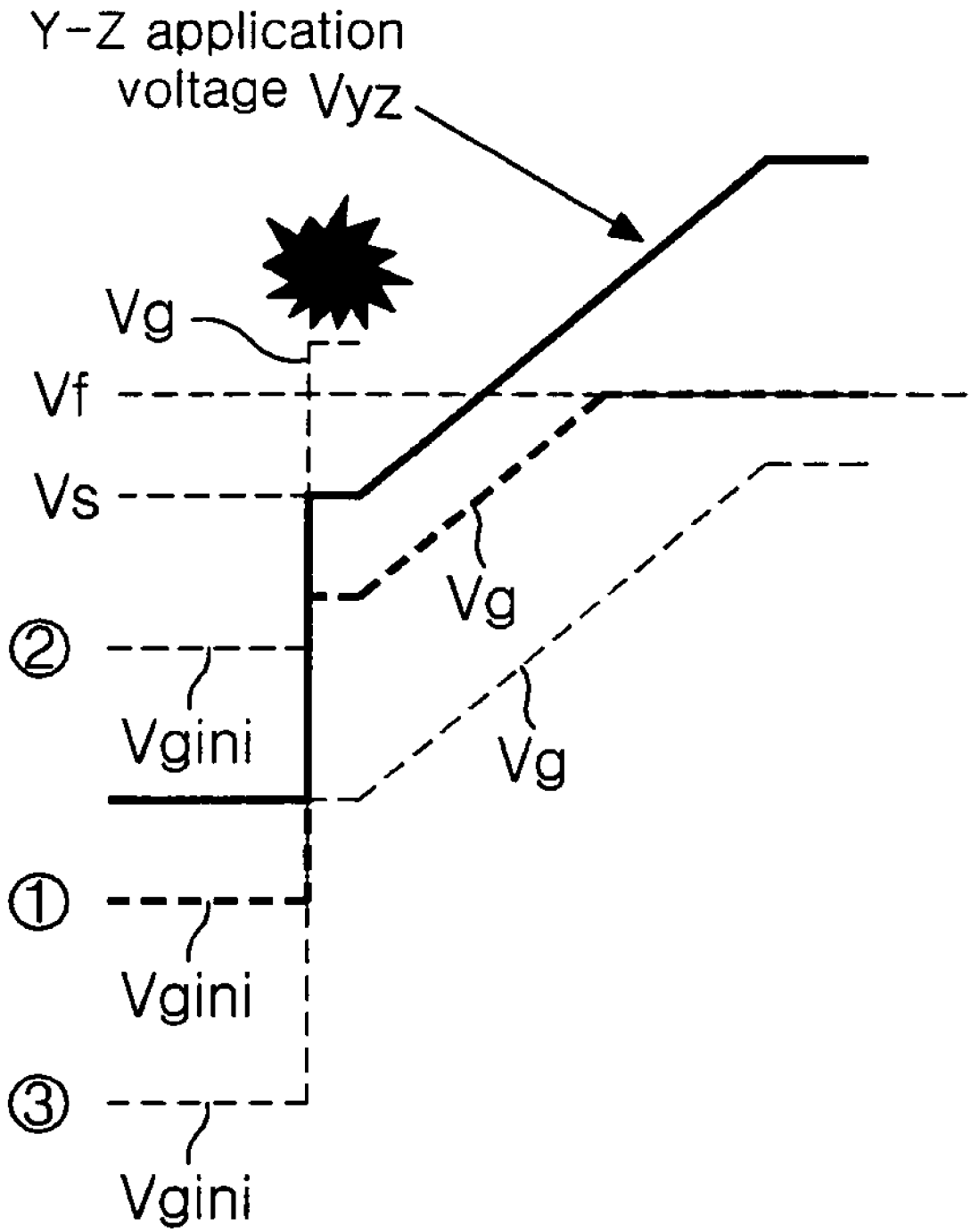
FIG. 6 illustrates variations of an external voltage applied between a scan electrode and sustain electrodes and a gap voltage within a discharge cell in a setup period when a plasma display panel is driven by a driving waveform of FIG. 4.

The space charge decay time (Tdecay) is set to be longer in the high temperature environment of more than 40° C. than in a room temperature environment, and is about 300 μs+50 μs. During the space charge decay time (Tdecay), space charges generated in a sustain discharge of the (n−1)th subfield (SFn−1) decay due to their mutual recombination and their recombination with wall charges. After the decaying of the space charges, during the reset period (RP) of the nth subfield (SFn), a setup discharge and a setdown discharge are consecutively generated and as a result, soon after the reset period (RP) of the nth subfield (SFn), each of the discharge cells is initialized to have an optimal wall charge distribution condition of an address discharge, with few space charges as shown in FIG. 5C.

During the erasure period (EP) of the space charge decay time (Tdecay), an erasure ramp waveform (ERR) for inducing an erasure discharge within the discharge cell is applied to sustain electrodes (Z). The erasure ramp waveform (ERR) is a positive ramp waveform having a voltage that gradually increases from 0V to a positive sustain voltage (Vs). The erasure ramp waveform (ERR) causes the erasure discharge to be generated between the scan electrode (Y) and the sustain electrode (Z) within on-cells generating the sustain discharge, thereby erasing the wall charges.

Figure 13:
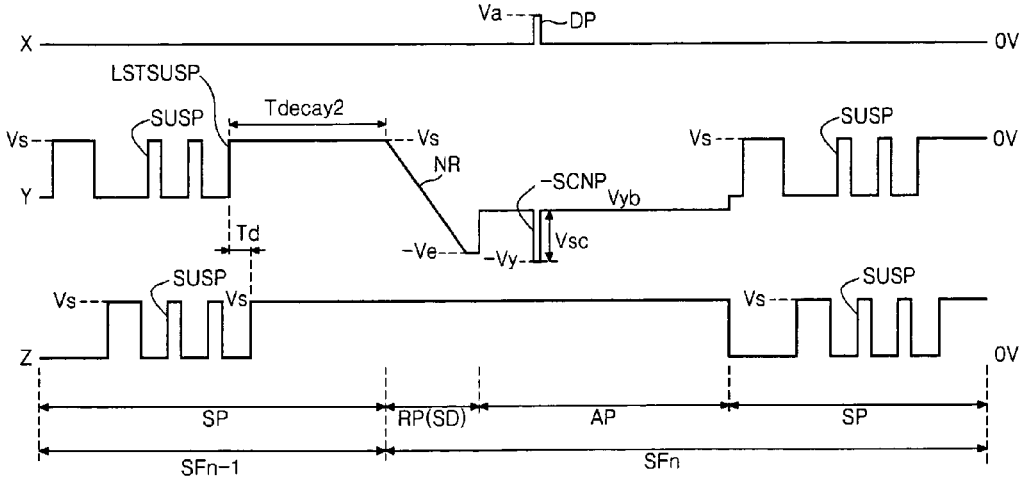
FIG. 13 is a waveform diagram illustrating a driving waveform of a first subfield period in a driving method of a plasma display apparatus according to the second embodiment of the present invention.

FIG. 13 is a waveform diagram illustrating a driving method of a plasma display apparatus according to the second embodiment of the present invention. A driving waveform of FIG. 13 is applicable to a PDP where the discharge cells can be initialized using only a last sustain discharge in a previous subfield and a setdown discharge in a next subfield subsequent to the previous subfield without the setup discharge, that is, to a PDP having the discharge cell with a high uniformity and a wide driving margin.

Referring to FIG. 13, an (n−1)th subfield (SFn−1) includes a reset period (RP), an address period (AP), and a sustain period (SP). An nth subfield (SFn) includes a reset period (RP) having only a setdown period without a setup period, an address period (AP), a sustain period (SP), and an erasure period (EP).

The address period (AP) and the sustain period (SP) are substantially the same as those of the driving waveform of FIG. 4 and the embodiment of FIG. 12 and therefore, detailed descriptions thereof will be omitted.

In the driving method of the plasma display apparatus according to the second embodiment of the present invention, in a high temperature environment, a space charge decay time (Tdecay2) for generating decay of space charges is set to be between a rising time point of a last sustain pulse (LSTSUSP) of the (n−1)th subfield (SFn−1) and a falling initiation time point of a negative ramp waveform (PR) at which the reset period (RP) of the nth subfield (SFn) is initiated.

The space charge decay time (Tdecay2) is the same as a time corresponding to a pulsewidth of the last sustain pulse, and is set to be longer in the high temperature environment of 40° C. than in a room temperature environment. The space charge decay time (Tdecay2) is about 300 μs+50 μs at a high temperature. During the space charge decay time (Tdecay2), the last sustain pulse (LSTSUSP) of a sustain voltage (Vs) is applied to scan electrodes (Y) and the sustain voltage (Vs) is sustained, and the sustain voltage (Vs) is applied to sustain electrodes (Z) after a predetermined time (Td) lapses from a time point that the last sustain pulse (LSTSUSP) is applied to the scan electrodes (Y). This voltage causes negative space charges to be accumulated on the scan electrodes (Y) and positive space charges to be accumulated on address electrodes (X) during the space charge decay time (Tdecay2). Accordingly, soon after the space charge decay time (Tdecay2), the space charges are extinguished at each discharge cell, thereby initializing each of the discharge cells by a wall charge distribution similar with a result of a conventional setup discharge, that is, by a wall charge distribution similar with that of FIG. 5B.

Subsequent to the space charge decay time (Tdecay2), in a reset period (RP(SD)) of the nth subfield (SFn), a negative ramp waveform (NR) is applied to the scan electrodes (Y). During the reset period (RP(SD)), the positive sustain voltage (Vs) is applied to the sustain electrodes (Z), and 0V is applied to the address electrodes (X). Due to the negative ramp waveform (NR), voltages of the scan electrodes (Y) decrease gradually from the positive sustain voltage (Vs) to the negative erasure voltage (Ve). Due to the negative ramp waveform (NR), a dark discharge is generated between the scan electrodes (Y) and the address electrodes (X) within the discharge cells of the entire screen and concurrently, is generated between the scan electrodes (Y) and the sustain electrodes (Z). As a result of the dark discharge of the setdown period (SD), the wall charge distribution within each discharge cell changes to have an optimal address condition as shown in FIG. 4C.

Figure 14:
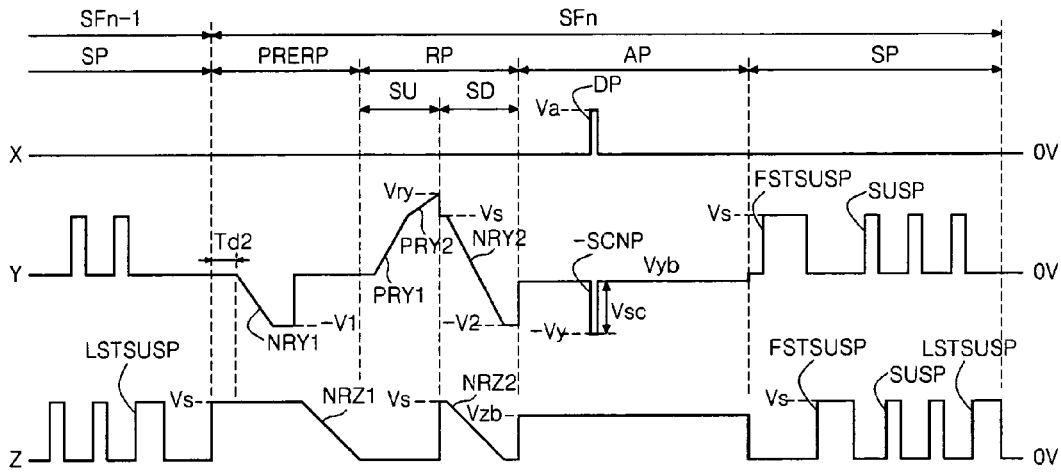
FIG. 14 is a waveform diagram illustrating a driving waveform of a first subfield period in a driving method of a plasma display apparatus according to the third embodiment of the present invention.
Figure 15A:
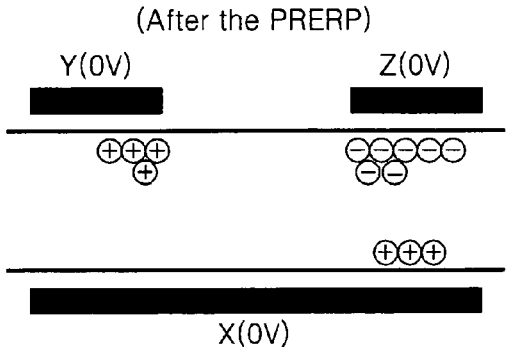
FIGS. 15A and 15E are stepwise diagrams illustrating a distribution of wall charges within a discharge cell varied by a driving waveform of FIG. 14.
Figure 15B:
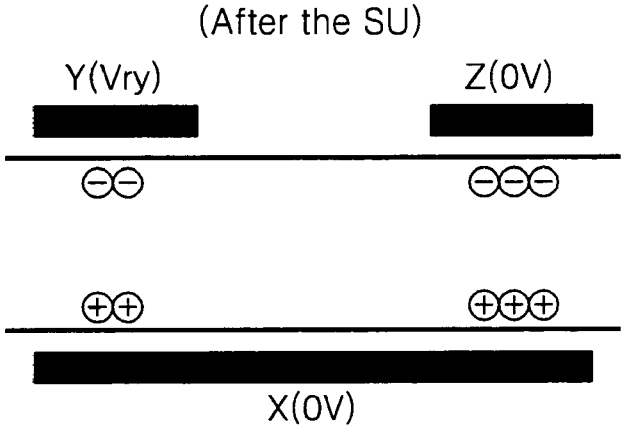
Figure 15C:
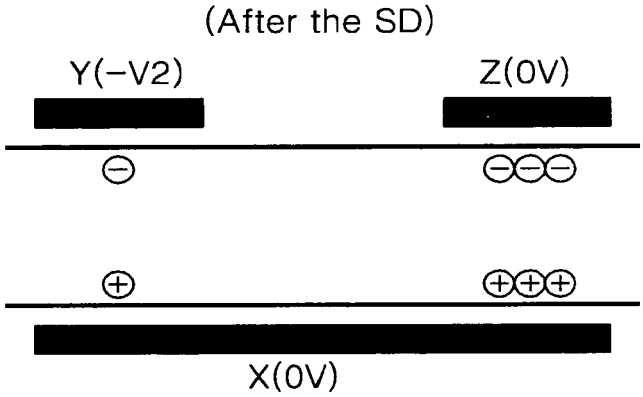
Figure 15D:
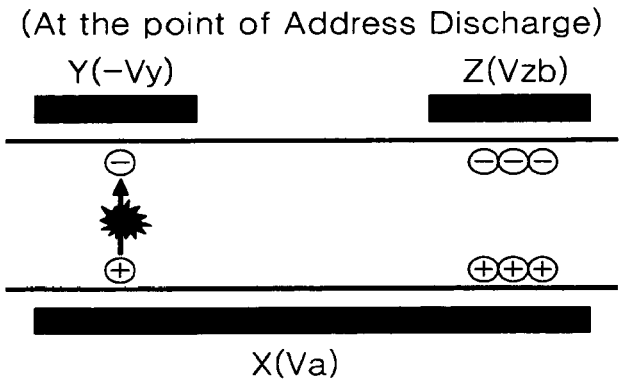
Figure 15E:
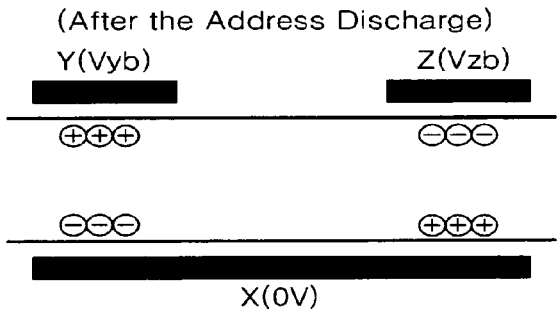

FIG. 14 is a waveform diagram illustrating a driving method of a plasma display apparatus according to the third embodiment of the present invention, and FIGS. 15A and 15E are stepwise diagrams illustrating a wall charge distribution within a discharge cell varied by a driving waveform of FIG. 14.

The driving waveform of FIG. 14 will be described on the basis of the wall charge distribution of FIGS. 15A to 15E.

Referring to FIG. 14, in the driving method of the plasma display apparatus according to the present invention, driving is performed in a high temperature environment by time-dividing at least any one subfield (for example, a first subfield) into a pre reset period (PRERP) for forming a positive wall charge on scan electrodes (Y) and forming a negative wall charge on sustain electrodes (Z), a reset period (RP) for initializing the discharge cells of a whole screen using the wall charge distribution formed by the pre reset period (PRERP), an address period (AP), and a sustain period (SP). An erasure period can be included between the sustain period (SP) and a reset period of a next subfield.

From a time point when a predetermined time (Td2) lapses after a positive sustain voltage (Vs) is applied to all of the sustain electrodes (Z) in the pre-reset period (PRERP), a first Y negative ramp waveform (NRY1) having a voltage decreasing from 0V or a ground level voltage (GND) to a negative voltage (−V1) is applied to all of the scan electrodes (Y). The predetermined time (Td2) is varied depending on the PDP characteristics. While voltages of the sustain electrodes (Z) are sustained, after voltages of the scan electrodes (Y) decrease, the voltage (−V1) is sustained for a predetermined time. During the pre reset period (PRERP), 0V is applied to the address electrodes (X).

During the predetermined initial time (Td2) of the pre reset period (PRERP), a difference between the sustain voltage (Vs) applied to the sustain electrodes (Z) and 0V applied to the scan electrodes (Y) causes negative space charges within the discharge cell to be accumulated on the scan electrodes (Y) and to be changed into wall charges, and causes positive space charges within the discharge cell to be accumulated on the sustain electrodes (Y) and to be changed into wall charges. After the erasing of the space charges, the sustain voltage (Vs) applied to the sustain electrodes (Z) and the first Y negative ramp waveform (NRY1) applied to the scan electrodes (Y) generate the dark discharge between the scan electrodes (Y) and the sustain electrodes and between the sustain electrodes (Z) and the address electrodes (X) in all of the discharge cells. As a result of the discharge, soon after the pre reset period (PRERP), as shown in FIG. 15A, the positive wall charges are accumulated on the scan electrodes (Y) and the negative wall charges are much accumulated on the sustain electrodes (Z) within all of the discharge cells. The positive wall charges accumulat on the address electrodes (X). Due to the wall charge distribution of FIG. 15A, a positive gap voltage is formed between the scan electrodes (Y) and the sustain electrodes (Z) within all of the discharge cells, and an electric field is formed from the scan electrodes (Y) to the sustain electrodes (Z) within each discharge cell.

In a setup period (SU) of the reset period (RP), a first Y positive ramp waveform (PRY1) and a second Y positive ramp waveform (PRY2) are consecutively applied to all of the scan electrodes (Y) and 0V is applied to the sustain electrodes (Z) and the address electrodes (X). A voltage of the first Y positive ramp waveform (PRY1) increases from 0V to the positive sustain voltage (Vs) and a voltage of the second Y positive ramp waveform (PRY2) increases from the positive sustain voltage (Vs) to a positive Y reset voltage (Vry). The second Y positive ramp waveform (PRY2) has a lower slope than the the slope of the first Y positive ramp waveform (PRY1). Depending on the PDP characteristics, the first Y positive ramp waveform (PRY1) and the second Y positive ramp waveform (PRY2) can also have the same slope. As the first Y positive ramp waveform (PRY1) is added to a voltage of the electric field formed between the scan electrodes (Y) and the sustain electrodes (Z) within the discharge cell, the dark discharge is generated between the scan electrodes (Y0 and the sustain electrodes (Z) and between the scan electrodes (Y) and the address electrodes (X) within all of the discharge cells. As a result of the discharge, as shown in FIG. 15B, soon after the setup period (SU), even within all of the discharge cells, the negative wall charges are accumulated on the scan electrodes (Y) while the scan electrodes are changed from a positive polarity to a negative polarity, and the positive wall charges are more accumulated on the address electrodes (X). The number of wall charges accumulated on the sustain electrodes (Z) decrease slightly but retain their negative polarity while the negative wall charges move toward the scan electrodes (Y).

By the wall charge distribution soon after the pre reset period (PRERP), before the dark discharge is generated in a setdown period (SD), a Y reset voltage (Vr) is lower than a conventional reset voltage (Vr) of FIG. 4 due to the sufficiently great positive gap voltage within all of the discharge cells. While the pre-reset period (PRERP) and the setup period (SU) lapse, the positive wall charges are sufficiently accumulated on the address electrodes (X) and therefore, an absolute value of an external applied voltage, that is, a data voltage (Va) and a scan voltage (−Vy) needing an address discharge is reduced.

Subsequent to the setup period (SU), in the setdown period (SD) of the reset period (RP), the second Y negative ramp waveform (NRY2) is applied to the scan electrodes (Y) and at the same time, a second Z negative ramp waveform (NRZ2) is applied to the sustain electrodes (Z). A voltage of the second Y negative ramp waveform (NRY2) decreases from the positive sustain voltage (Vs) to a negative voltage (−V2). A voltage of the second Z negative ramp waveform (NRZ2) decreases from the positive sustain voltage (Vs) to 0V or a ground level voltage. The voltage (−V2) can be identical with or different from the voltage (−V1) of the reset period (PRERP). During the setdown period (SD), the voltages of the scan electrodes (Y) and the sustain electrodes (Z) decrease concurrently and therefore, a discharge is not generated therebetween whereas the dark discharge is generated between the scan electrodes (Y) and the address electrodes (X). This dark discharge causes excessive wall charges to be erased from the negative wall charges accumulated on the scan electrodes (Y) and excessive wall charges to be erased from the positive wall charges accumulated on the address electrodes (X). As a result, all of the discharge cells have a uniform wall charge distribution as shown in FIG. 15C. In the wall charge distribution of FIG. 15C, the gap voltage between the scan electrodes (Y) and the address electrodes (X) increases and is about equal to a discharge firing voltage (Vf) since the negative wall charges are sufficiently accumulated on the scan electrodes (Y) and the positive wall charges are sufficiently accumulated on the address electrodes (X). Accordingly, the wall charge distribution of all of the discharge cells is controlled to have an optimal address condition soon after the setdown period (SD).

In the address period (AP), a negative scan pulse (−SCNP) is sequentially applied to the scan electrodes (Y) and at the same time, a positive data pulse (DP) is synchronized to the scan pulse (−SCNP) and is applied to the address electrodes (X). A voltage of the scan pulse (−SCNP) is a scan voltage (Vsc) that decreases from 0V or a negative scan bias voltage (Vyb) equaling about 0V, to the negative scan voltage (−Vy). During the address period (AP), a positive Z bias voltage (Vzb) lower than the positive sustain voltage (Vs) is supplied to the sustain electrodes (Z). Soon after the reset period (RP), all of the discharge cells are controlled in gap voltage to have the optimal address condition, the gap voltage between the scan electrodes (Y) and the address electrodes (X) exceeds the discharge firing voltage (Vf), thereby generating the address discharge only between the electrodes (X and Y) within the on-cells where the scan voltage (Vsc) and the data voltage (Va) are applied. The wall charge distribution within the on-cells where the address discharge is generated, is shown in FIG. 15D. Soon after the address discharge is generated, as shown in FIG. 15E, the wall charge distribution within the on-cells changes while the positive wall charges accumulate on the scan electrodes (Y) and the negative wall charges accumulate on the address electrodes (X) by the address discharge.

In the off-cells where 0V or the ground level voltage is applied to the address electrodes (X) or 0V or a scan bias voltage (Vyb) is applied to the scan electrodes (Y), the gap voltage is less than the discharge firing voltage. Accordingly, in the off-cells where the address discharge is not generated, the wall discharge distribution is substantially maintained in a state shown in FIG. 15C.

In the sustain period (SP), sustain pulses (FIRSTSUSP, SUSP, and LSTSUSP) of the positive sustain voltage (Vs) are alternately applied to the scan electrodes (Y) and the sustain electrodes (Z). During the sustain period (SP), 0V or the ground level voltage is supplied to the address electrodes (X). The sustain pulse (FSTSUSP) first applied to each of the scan electrodes (Y) and the sustain electrodes (Z) is set to have a wider pulsewidth than the normal sustain pulse (SUSP) so that initiation of the sustain discharge is stabilized. The last sustain pulse (LSTSUSP) is applied to the sustain electrodes (Z), and is set to have a wider pulse width than the normal sustain pulse (SUSP) in an initial state of the setup period (SU) to sufficiently accumulate the negative wall charges on the sustain electrodes (Z). The on-cells selected by the address discharge during the sustain period (SP) are assisted by the wall charge distribution of FIG. 15E, and generate the sustain discharges between the scan electrodes (Y) and the sustain electrodes (Z) at each sustain pulse (SUSP). The off-cells have an initial wall charge distribution of the sustain period (SP) as shown in FIG. 15C and accordingly, even though the sustain pulses (FIRSTSUSP, SUSP, LSTSUSP) are applied, the gap voltage is less than the discharge firing voltage (Vf), thereby not generating the discharge.

To reduce an amount of the space charges generated in the sustain discharge, rising periods and falling periods of the sustain pulses (FIRSTSUSP, SUSP, and LSTSUSP) are lengthened to be about 340 ns±20 ns.

The driving waveform of FIG. 14 is not limited only to a first subfield and is applicable to several initial subfields including the first subfield and also to all of the subfields included in one frame period.

Figure 16:
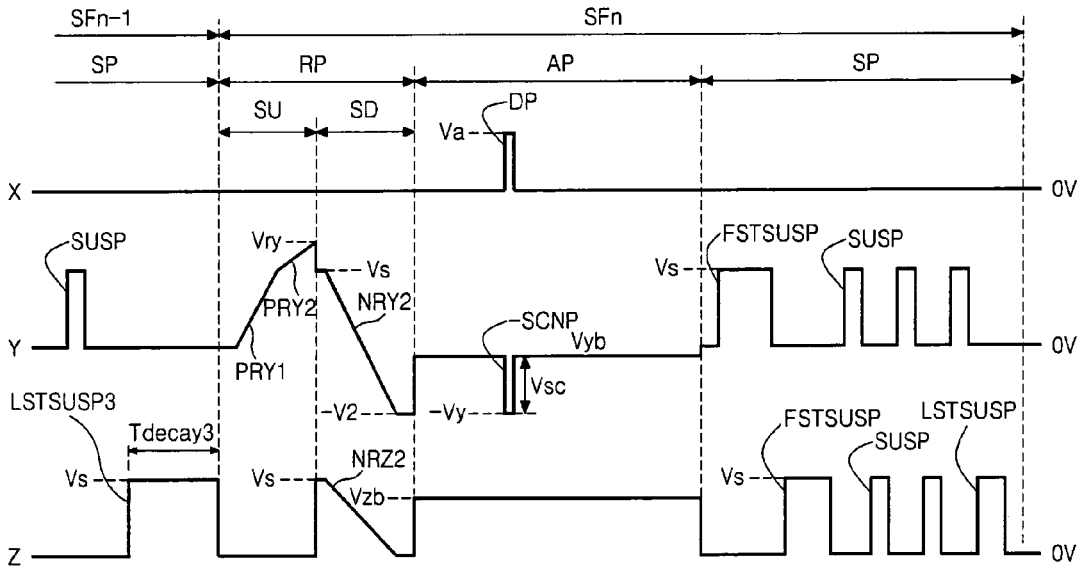
FIG. 16 is a waveform diagram illustrating a driving waveform of remnant subfield periods other than a first subfield period in a driving method of a plasma display apparatus according to the third embodiment of the present invention.
Figure 17:
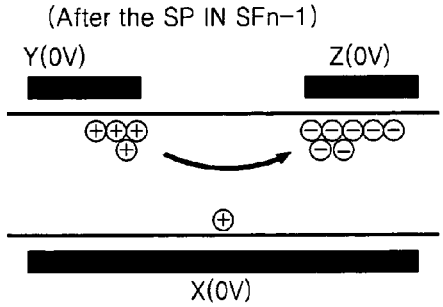
FIG. 17 illustrates a distribution of wall charges formed within a discharge cell soon after a sustain period by the driving waveform of FIG. 16.
Figure 18:
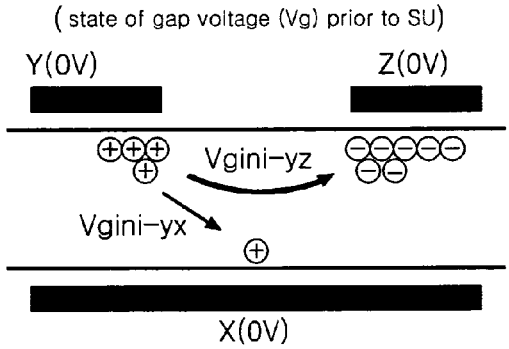
FIG. 18 illustrates a distribution of wall charges and a gap voltage within a discharge cell, formed before a setup period by the driving waveforms of FIGS. 14 and 16.

FIG. 16 illustrates a driving waveform during a sustain period (SP) of an (n−1)th subfield (SFn−1) ("n" is a positive integer more than 2) and an nth subfield (SFn) in a driving method of a plasma display apparatus according to the third embodiment of the present invention. FIG. 17 illustrates a distribution of wall charges formed within a discharge cell soon after the sustain period by the driving waveform of FIG. 16 and FIG. 18 illustrates the wall charge distribution and a gap voltage within the discharge cell formed prior to a setup period by the driving waveforms of FIGS. 14 and 16.

The driving waveform of FIG. 16 will be described on the basis of the wall charge distributions of FIGS. 17 and 18.

Referring to FIG. 16, at the nth subfield (SFn), all cells of the PDP are initialized using the wall charge distribution that is formed soon after the sustain period in the (n−1)th subfield (SFn−1), for example, in a first subfield.

Each of the (n−1)th subfield (SFn−1) and the nth subfield (SFn) includes the reset period (RP) for initializing all of the cells with the assistance of the wall charge distribution where negative wall charges are sufficiently accumulated on sustain electrodes (Z), the address period (AP) for selecting the cell and the sustain period (SP) for sustaining the discharge of the selected cell.

In the sustain period of the (n−1)th subfield (SFn−1), a last sustain pulse (LSTSUSP3) is applied to the sustain electrodes (Z). 0V or a ground level voltage is applied to the scan electrodes (Y) and the address electrodes (X). A space charge decay time (Tdecay3) corresponding to a pulsewidth of the last sustain pulse (LSTSUSP3) equals the time needed to change the space charges into wall charges to induce a sustain discharge within the on-cells and also to erase the space charges within the discharge cells before the reset period (RP) of the nth subfield (SFn). The space charge decay time (Tdecay3) when the last sustain pulse (LSTSUSP3) is sustained as the sustain voltage (Vs) is set to have about 300 μs±50 μs.

Due to the discharge between the scan electrodes (Y) and the sustain electrodes (Z) generated by the last sustain pulse (LSTSUSP3), positive wall charges are sufficiently accumulated on the scan electrodes (Y) and negative wall charges are accumulated on the sustain electrodes (Z) with few space charges as shown in FIG. 17.

In the setup period (SU) of the nth subfield (SFn), the dark discharge is generated in all of the cells using the wall charge distribution of FIG. 17 and all of the cells are initialized to have the wall charge distribution shown in FIG. 15B. The setup period (SU), and its subsequent setdown initialization, address and sustain operations are substantially the same as those of the driving waveform of FIG. 14.

In the plasma display apparatus and the driving method of the same according to the third embodiment of the present invention, in a high temperature environment, the space charges are changed into wall charges, thereby initializing a stable wall charge distribution in the high temperature environment, and a setup period of a next subfield directly follows a last sustain discharge of a previous subfield, without the erasure period for erasing the wall charges between the sustain period of the previous subfield and the reset period of the next subfield. The sustain discharge is a strong glow discharge and therefore, a sufficient number of wall charges accumulate on the scan electrodes (Y) and the sustain electrodes (Z) and sustain the polarities of the positive wall charges on the scan electrodes and the polarities of the negative wall charges on the sustain electrodes (Z).

FIG. 18 illustrates a gap voltage of the cell formed by the last sustain discharge or the discharge of the pre reset period (PRERP).

Referring to FIG. 18, due to the last sustain pulse (LSTSUSP) or waveforms (NRY1, PRZ, and NRZ1) of the pre reset period (PRERP), the discharge is generated between the scan electrode (Y) and the sustain electrode (Z), thereby forming an inter-Y-Z initial gap voltage (Vgini−yz) in an electric field from the scan electrode (Z) to the sustain electrode (Z) directly before the setup period (SU), and forming an inter-Y-X initial gap voltage (Vgini−yx) from the scan electrode (Y) to the address electrode (X) within the cell.

In the discharge cells, the inter-Y-Z initial gap voltage (Vgini−yz) is already formed by the wall charge distribution of FIG. 18 before the setup period (SU) and therefore, when an external voltage equal to the difference between the discharge firing voltage (Vf) and the inter-Y-Z initial gap voltage (Vgini−yz) is applied, the dark discharge is generated within the cell during the setup period (SU). This is expressed in Equation 5 below.

$$Vyz \geqq Vf-(Vgini-yz) \quad \text{[Equation 5]}$$

"Vyz" is an external voltage (Hereinafter, referred to as "inter-Y-Z external voltage") applied to the scan electrodes (Y) and the sustain electrodes (Z) during the setup period (SU) and represents voltages of the positive ramp waveforms (PRY1 and PRY2) that are applied to the scan electrodes (Y) in the driving waveforms of FIGS. 14 and 16 and represents 0 voltage that are applied to the sustain electrodes (Z).

Figure 19:
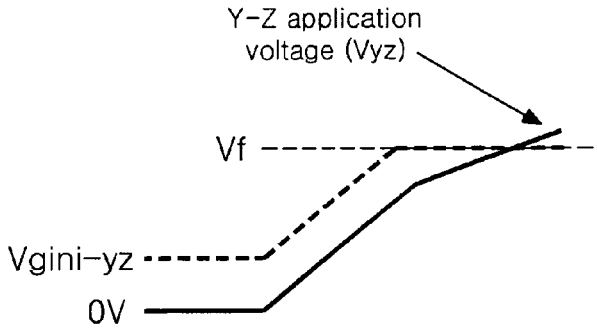
FIG. 19 illustrates variations of an external voltage applied between a scan electrode and sustain electrodes and a gap voltage within a discharge cell in a setup period when a plasma display panel is driven by driving waveforms of FIGS. 14 and 16.

FIG. 19 illustrates variations of the external voltage applied between the scan electrode and the sustain electrodes and the gap voltage within the discharge cell in the setup period when the plasma display panel is driven by the driving waveforms of FIGS. 14 and 16.

As shown in Equation 5 and FIG. 19, when the inter-Y-Z external voltage (Vyz) increases to be more than a difference between the discharge firing voltage (Vf) and the inter-Y-Z initial gap voltage (Vgini−yz) during the setup period (SU), the dark discharge is stably generated within the discharge cells due to a wide driving margin.

In the plasma display apparatus according to the third embodiment of the present invention, an amount of emission generated in the reset period in each subfield is much less than the emission generated in the reset period in the conventional art. This amount of emission is less because the number of emissions generated within the cell during the reset period of each subfield is less and specifically, the number of surface discharges is less than number of surface discharges in the conventional art.

Table 2 is an arrangement of the types of and the number of discharges generated in the pre reset period (PRERP) and the reset period (RP) of the first subfield described in the driving waveform of FIG. 14.

Table 3 is an arrangement of the types of and the number of discharges generated in a reset period (RP) of each of the remaining subfields without the pre reset period (PRERP) described in the driving waveform of FIG. 16.

TABLE 2

| | Operation | | |
|---|---|---|---|
| period | | RP | |
| Cell state | PRERP | SU | SD |
| Opposite discharge (Y-X) | ○ | ○ | ○ |
| Surface discharge (Y-Z or Z-X) | ○ | ○ | X |

TABLE 3

| period | | Operation RP of SFn | |
|---|---|---|---|
| Cell state | | SU | SD |
| On-cell turned on in SFn-1 | Opposite discharge (Y-X) | ○ | X |
| | Surface discharge (Y-Z) | ○ | ○ |
| Off-cell turned off in SFn-1 | Opposite discharge (Y-X) | X | ○ |
| | Surface discharge (Y-Z) | X | X |

As shown in the Table 2, in the driving waveform of the first subfield of FIG. 14, three opposite discharges and two surface discharges in maximum are generated during the pre reset period (PRERP) and the reset period (RP). In subsequent subfields, as shown in the Table 3, during the reset period (RP), one opposite discharge and two surface discharges in maximum are generated, and in an off-cell turning off in the previous subfield, only one opposite discharge is generated. Due to a difference in the number of discharges and the types of discharges, where the plasma display apparatus according to the third embodiment of the present invention is driven by time dividing one frame period into twelve subfields, a black screen decreases in luminance to less than one third. Accordingly, the inventive plasma display apparatus can display the black screen using a darkroom contrast value less than a darkroom contrast value of the conventional art and therefore, can display an image more clearly.

A lower number discharges generated in the reset period (RP) means that the wall charges or the polarities are remain almost unchanged within the discharge cell.

Figure 20:
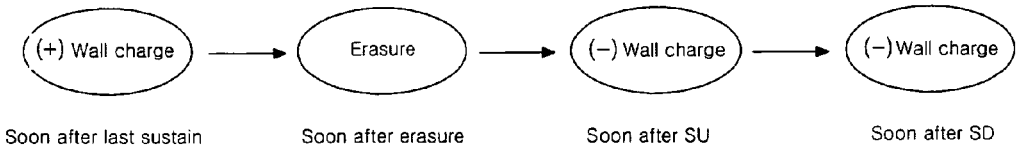
FIG. 20 illustrates a polarity change of a wall charge on a sustain electrode during an erasure period and a reset period by a conventional exemplary driving waveform of FIG. 4.

FIG. 20 illustrates a polarity change of the wall charge on the sustain electrode during the erasure period and the reset period by a conventional exemplary driving waveform of FIG. 4.

Figure 21:
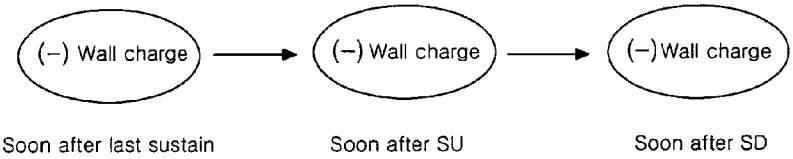
FIG. 21 illustrates a polarity change of a wall charge on a sustain electrode during a reset period by driving waveforms of FIGS. 14 and 16.

FIG. 21 illustrates a polarity change of the wall charge on the sustain electrode during the reset period by the driving waveforms of FIGS. 14 and 16.

In a conventional plasma display apparatus, as shown in FIG. 20, the wall charges on sustain electrodes (Z) are changed in polarity in a sequence of positive polarity, erasure and negative polarity (FIG. 5A), positive polarity (FIG. 5B) and negative polarity (FIG. 5C), from soon after a last sustain discharge of an (n−1)th subfield (SFn−1) to soon after a dark discharge of a setdown period (SD) of an nth subfield (SFn). In comparison, in the inventive plasma display apparatus, as shown in FIG. 21, the wall charges on the sustain electrodes (Z) maintain a negative polarity, from soon after the last sustain discharge of the (n−1)th subfield (SFn−1) to soon after the dark discharge of the setdown period (SD) of the nth subfield (SFn). In other words, in the inventive plasma display apparatus, as shown in FIGS. 15A, 15B, and 15C, in an initialization process, the wall charges on the sustain electrodes (X) constantly maintain a negative polarity while the address period (AP) lapses.

Figure 22:
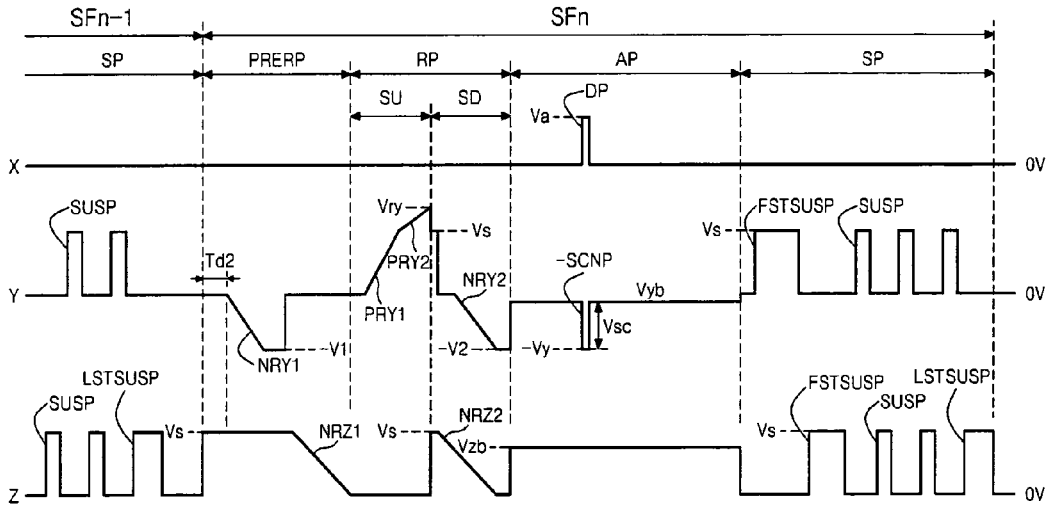
FIG. 22 is a waveform diagram illustrating a driving waveform of a first subfield period in a driving method of a plasma display apparatus according to the fourth embodiment of the present invention.
Figure 23:
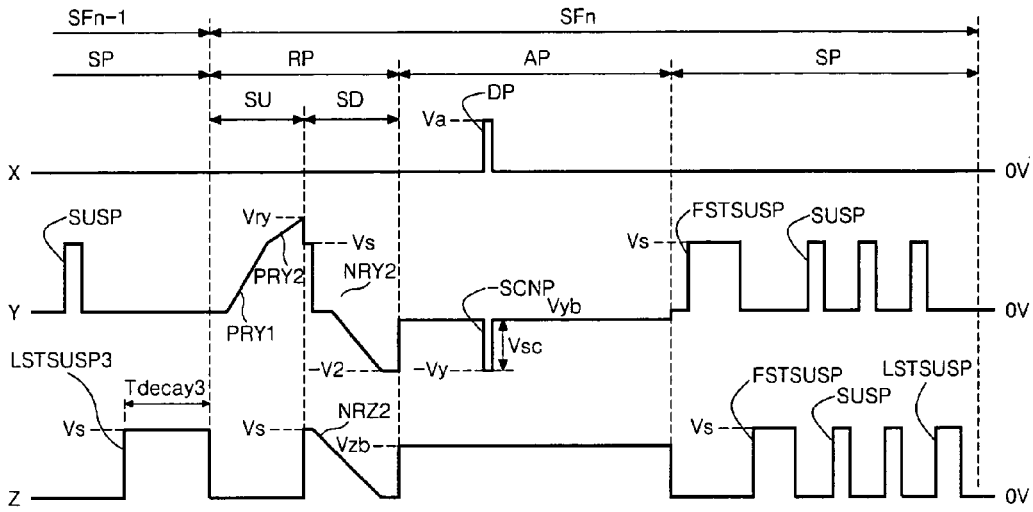
FIG. 23 is a waveform diagram illustrating a driving waveform of remnant subfield periods other than a first subfield period in a driving method of a plasma display apparatus according to the fourth embodiment of the present invention.

FIG. 22 illustrates a driving waveform of a first subfield period in a driving method of a plasma display apparatus according to the fourth embodiment of the present invention. FIG. 23 illustrates driving waveforms during a sustain period (SP) of an (n−1)th subfield (SFn−1) ("n" is a positive integer of more than 2) and an nth subfield (SFn) in the driving method of the plasma display apparatus according to the fourth embodiment of the present invention.

Referring to FIGS. 22 and 23, in the driving method of the plasma display apparatus according to the present invention, a voltage decreasing from 0V or a ground level voltage (GND) is applied to scan electrodes (Y) during a setdown period (SD) of each subfield, thereby making wall charge distributions of all of the discharge cells initialized in the setup period (SU) to be uniform.

A first subfield includes a pre-reset period (PRERP), a reset period (RP), an address period (AP), and a sustain period (SP) as in FIG. 22 and other subfields include a reset period (RP), an address period (AP) and a sustain period (SP) as in FIG. 23.

In the pre-reset period (PRERP) of the first subfield, space charges are changed into wall charges, thereby erasing the space charges and also, to form the wall charge distribution of FIG. 15A within each discharge cell, a positive sustain voltage (Vs) is applied to all sustain electrodes (Z) and then, a first Y negative ramp waveform (NRY1) having a voltage decreasing from 0V or the ground level voltage (GND) to a negative voltage (−VI) is applied to all of the scan electrodes (Y) from a time point that a predetermined time (Td2) lapses.

The last sustain pulse (LSTSUSP3) applied to the sustain electrodes (Z) before the reset period (RP) of the nth subfield other than the first subfield sustains the positive sustain voltage (Vs) during a space charge decay time (Tdecay3) of about 300 μs±50 μs. During the space charge decay time (Tdecay3), the space charges are changed into wall charges and are then erased.

In each subfield (SFn−1, SFn), in the setdown period (SD) of the reset period (RP), a second Y negative ramp waveform (NRY2) is applied to the scan electrodes (Y) and at the same time, a second Z negative ramp waveform (NRZ2) is applied to the sustain electrodes (Z). A voltage of the second Y negative ramp waveform (NRY2) decreases from 0V or the ground level voltage (GND) to a negative voltage (−V2) unlike the aforementioned embodiments. A voltage of the second Z negative ramp waveform (NRZ2) decreases from the positive sustain voltage (Vs) to 0V or the ground level voltage. During the setdown period (SD), the voltages of the scan electrodes (Y) and the sustain electrodes (Z) are decrease concurrently and therefore, the discharge is not generated therebetween whereas a dark discharge is generated between the scan electrodes (Y) and the address electrodes (X). This dark discharge erases excessive wall charges among negative wall charges accumulated on the scan electrodes (Y) and erases excessive wall charges among positive wall charges accumulated on the address electrodes (X). The second Z negative ramp waveform (NRZ2) can also be omitted.

If the voltage of the second Y negative ramp waveform (NRY2) decreases from 0V or the ground level voltage, the setdown period (SD) is less than the setdown period of the aforementioned embodiments. Although, the voltage of the second Y negative ramp waveform (NRY2) decreases from 0V or the ground level voltage, due a little difference between the scan electrodes (Y) and the sustain electrodes (Z), the plasma display apparatus according to the fourth embodiment can effectively suppress the discharge between the scan electrodes (Y) and the sustain electrodes (Z) while stabilizing the initialization. Accordingly, in this embodiment, due to decrease in the setdown period (SD), a driving time will be more secure and an initialization operation of the setdown period (SD) will be more stable.

To reduce the number of space charges generated in the sustain discharge, a rising period and a falling period for each sustain pulse (FIRSTSUSP, SUSP, and LSTSUSP) are lengthened to about 340 ns±20 ns.

Figure 24:
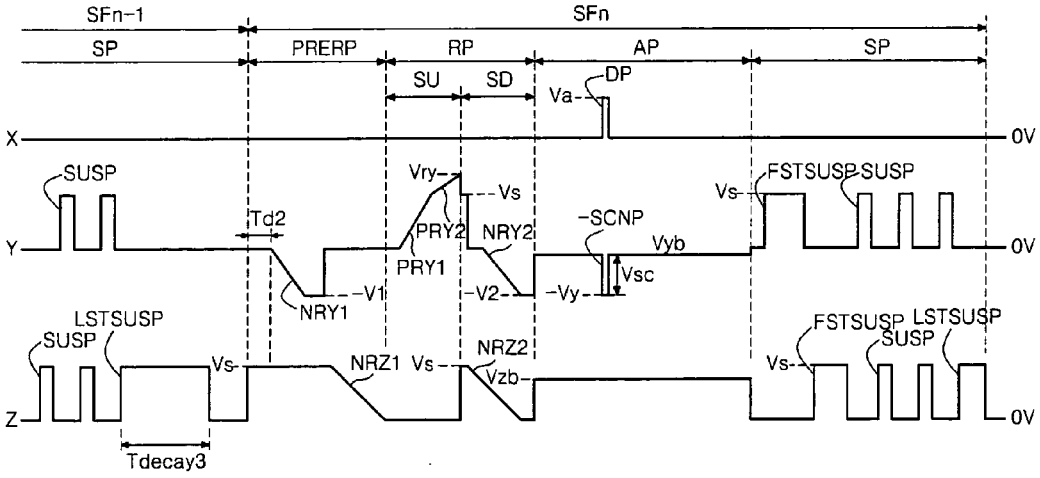
FIG. 24 is a waveform diagram illustrating a driving method of a plasma display apparatus according to the fifth embodiment of the present invention.

FIG. 24 is a waveform diagram of a driving waveform illustrating a driving method of a plasma display apparatus according to the fifth embodiment of the present invention, and illustrates the driving waveform applied in a high temperature environment.

Referring to FIG. 24, in the inventive driving method of the plasma display apparatus, during the late period of the (n−1) th subfield, a last sustain pulse (LSTSUSP) having a positive sustain voltage sustained during a space charge decay time (Tdecay3) of about 300 μs±50 μs is applied to the sustain electrodes (Z) and then, 0V or a ground level voltage (GND) is applied to the sustain electrodes (Z).

In the inventive driving method of the plasma display apparatus, a positive sustain voltage (Vs) is again applied to all of the sustain electrodes and then, a first Y negative ramp waveform (NRY1) with a voltage decreasing from 0V or ground level voltage (GND) to a negative voltage (−VI) is applied to all of the scan electrodes from a time point that a predetermined time (Td2) lapses. Accordingly, where the voltages of the sustain electrodes (Z) are sustained to equal the sustain voltages (Vs), the first Y negative ramp waveform (NRY1) is applied to the scan electrodes (Y). Consequently, in the inventive driving method of the plasma display apparatus, after 0V or the ground level voltage (GND) is applied to the scan electrodes (Y), a first Z negative ramp waveform (NRZ) with a voltage decreasing gradually from the sustain voltage (Vs) to 0V or the ground level voltage (GND) is applied to the sustain electrodes (Z).

To reduce the number of space charges generated in the sustain discharge, a rising period and a falling period for each sustain pulse (FIRSTSUSP, SUSP, and LSTSUSP) are lengthened to about 340 ns±20 ns.

Due to a series of driving waveforms, the space charges generated in the high temperature environment are almost completely erased or changed into the wall charges before the nth subfield (SFn), and each discharge cell is initialized in the wall charge distribution of FIG. 15A.

Figure 25:
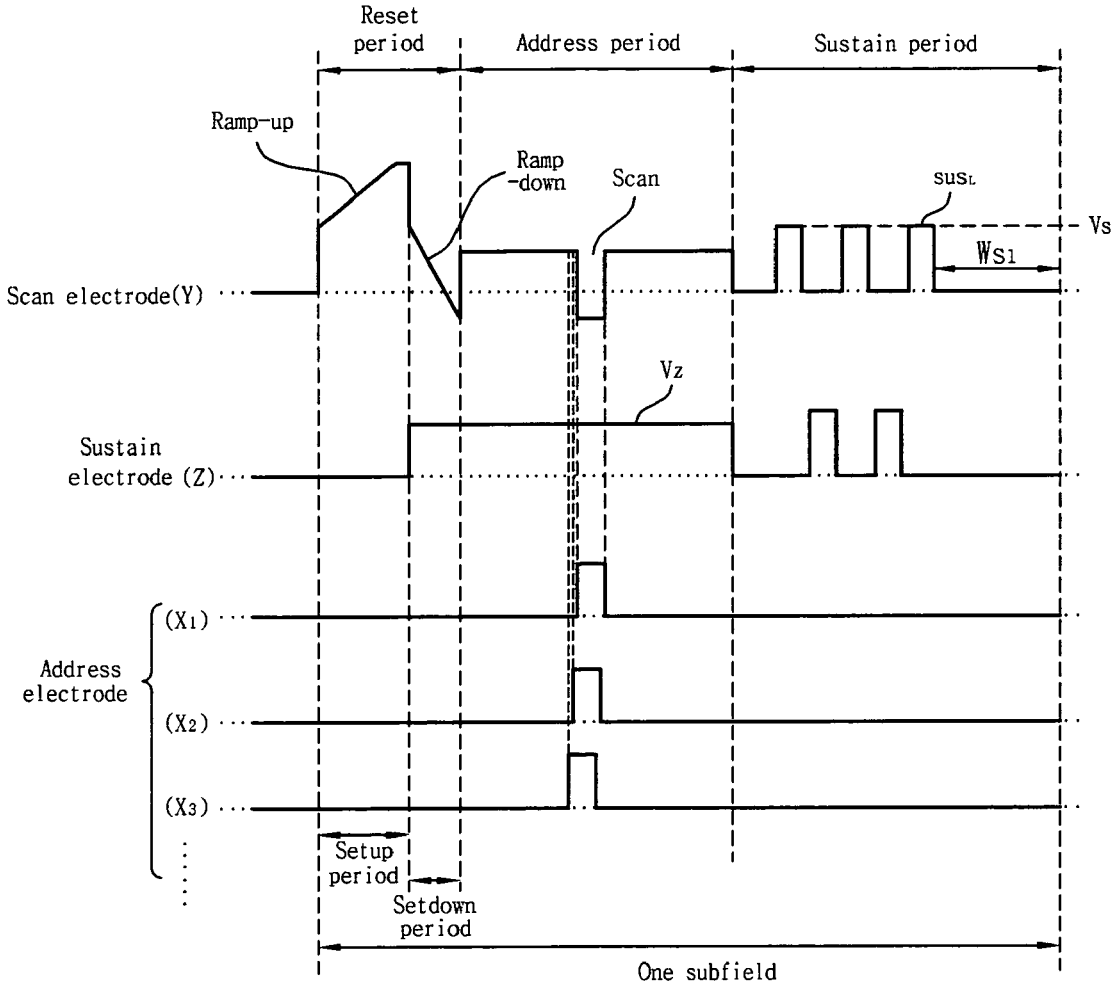
FIG. 25 is a waveform diagram of a driving waveform illustrating a driving method of a plasma display apparatus according to the sixth embodiment of the present invention.

FIG. 25 is a waveform diagram of a driving waveform illustrating a driving method of a plasma display apparatus according to the sixth embodiment of the present invention.

As shown in FIG. 25, in the driving waveform according to the driving method of the plasma display apparatus, in an address period of one subfield, application time points of the data pulses applied to all of the address electrodes (X1 to Xn) are different from the application time points of a scan pulse applied to a scan electrode. The length of a sustain period is controlled to reduce space charges within a discharge cell.

In the controlling of the length of the sustain period, it is desirable to control a period from a time point that a last sustain pulse (SUSL) is applied to a reset period of a next subfield in the sustain period. For example, assuming that a time point that the last sustain pulse (SUSL) is supplied to the scan electrode (Y) or the sustain electrode (Z) in a sustain period of a first subfield is "t0", and the reset period is initiated from a time point "t1" in a second subfield subsequent to the first subfield, the sustain period to be controlled is the period "t0-t1".

The controlling of the length of the sustain period is achieved by controlling the period from the time point that the last sustain pulse is supplied to the reset period of the next subfield in the sustain period. In other words, the period from the time point that the last sustain pulse is supplied to the reset period of the next subfield is controlled, thereby controlling the length of the entire sustain period.

Preferably, in the sustain period, the period from the time point that the supplying of the last sustain pulse (SUSL) ends to the reset period of the next subfield ranges from 100 μs to 1 ms. The termination of the last sustain pulse (SUSL) means that the voltage of the last sustain pulse (SUSL) is less than about 10% of a maximal voltage. In other words, assuming that the maximal voltage of the last sustain pulse (SUSL) is 200V, when the voltage of the last sustain pulse (SUSL) is less than about 20V, it is said that the supplying of the last sustain pulse (SUSL) has terminated.

Preferably, in the sustain period, the period from the time point that the supplying of the last sustain pulse has terminated to the reset period of the next subfield is, as shown in FIG. 25A, a period (W1) for sustaining a ground level voltage (GND) after the last sustain pulse (SUSL) of the sustain pulses applied in the sustain period falls from the sustain voltage (Vs) to the ground level (GND).

As such, the period from the time point where the supplying of the last sustain pulse (SUSL) is terminated to the reset period of the next subfield in the sustain period is controlled to be in a range of 100 μs to 1 ms, thereby reducing the space charges within the discharge cell, which are a main cause of generating the erroneous discharge that results from a temperature of a plasma display panel being at a high temperature, for example, at a temperature of more than 40° C.

If the period from the time point that the supplying of the last sustain pulse (SUSL) has terminated to the reset period of the next subfield is set long enough, a time enough to reduce the space charges is secured after the supplying of the last sustain pulse (SUSL). Accordingly, the space charges within the discharge cell decreased.

As described above, the space charges within the discharge cell are recombined with the wall charges positioned on a predetermined electrode within the number of discharge cell decrease, thereby reducing the number of the wall charges participating in the discharge. As a result, the space charges within the discharge cell are reduced in amount, thereby reducing the high temperature erroneous discharges generated when a temperature around the panel is high.

The reason why the period from the time point that the supplying of the last sustain pulse (SUSL) ends to the reset period of the next subfield is more than 100 μs, that is, the reason why a lower threshold value is set to 100 μs is to ensure a sufficient reduction of the space charges generated in the sustain discharge of the plasma display panel. The reason why the period from the time point that the supplying of the last sustain pulse (SUSL) ends to the reset period of the next subfield is less than 1 ms, that is, the reason why an upper threshold value is set to 1 ms is to secure an operational margin of the sustain period in the sustain driving of the plasma display panel.

In FIG. 25, the length of the sustain period is controlled so that the period from the time point that the supplying of the last sustain pulse (SUSL) ends to the reset period of the next subfield is controlled, but the length of the entire sustain period can be also controlled by controlling the supplying period of the sustain pulse. This will be described with reference to FIG. 26 below.

Figure 26:
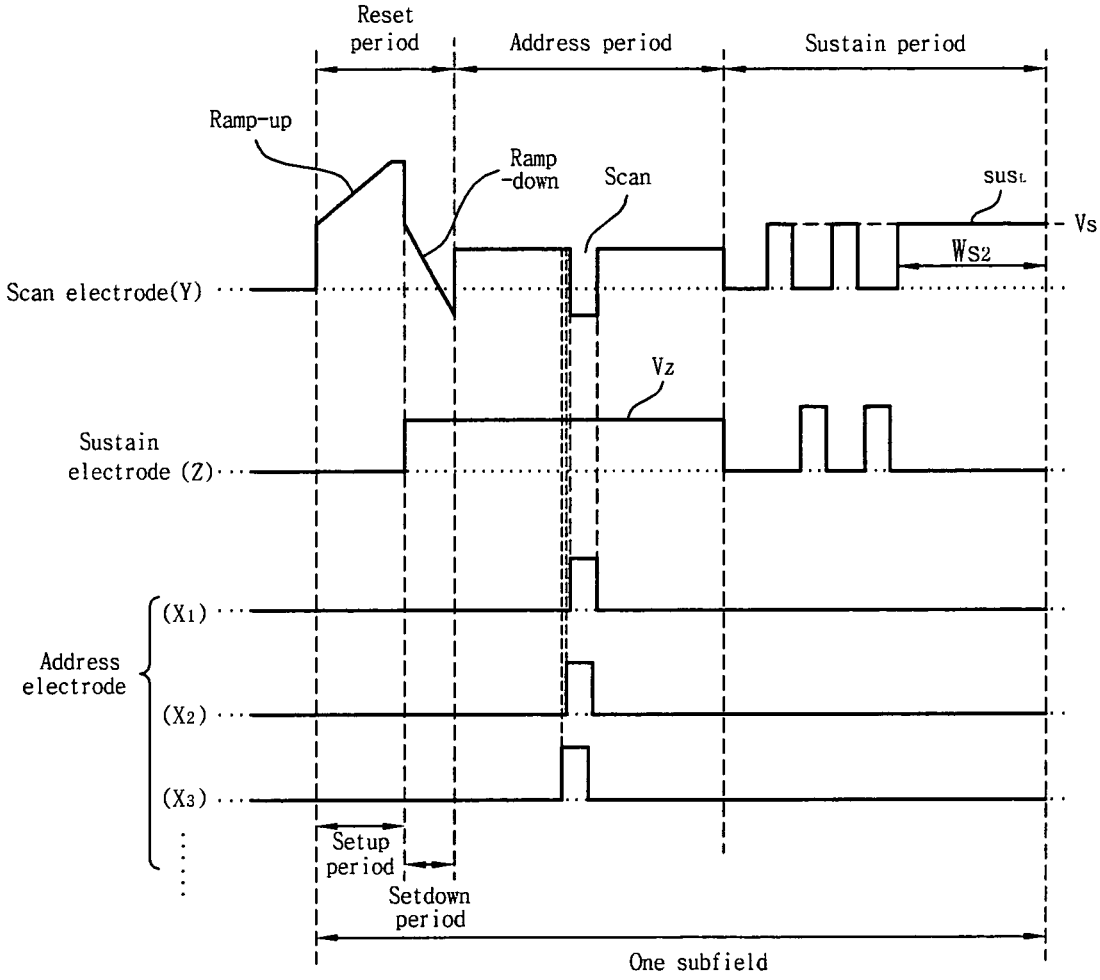
FIG. 26 is a waveform diagram of another driving waveform illustrating a driving method of a plasma display apparatus according to the sixth embodiment of the present invention.

FIG. 26 is a waveform diagram of another driving waveform illustrating a driving method of a plasma display apparatus according to the sixth embodiment of the present invention.

Referring to FIG. 26, a period for supplying a sustain pulse for generating a last sustain discharge, that is, a last sustain pulse in a sustain period is controlled, thereby controlling a length of a whole sustain period, that is, a length of a period from a time point that the last sustain pulse is applied to a reset period of a next subfield in the sustain period.

Preferably, the supplying period of the sustain pulse for generating the last sustain discharge in the sustain period is a period for which the last sustain pulse (SUSL) applied in the sustain period maintains the sustain voltage (Vs), considering that the sustain voltage (Vs) is alternately applied to a scan electrode or a sustain electrode in the sustain period. In the sustain period, the supplying period of the last sustain pulse (SUSL) is preferably controlled to be 1 μs to 1 ms.

The reason why the supplying period of the last sustain pulse (SUSL) for generating the last sustain discharge is set to be more than 1 μs in the sustain period, that is, the reason why a lower threshold value is set to 1 μs, is to generate a sustain discharge of a desired magnitude in the sustain discharge of the plasma display panel. The reason why the supplying period of the last sustain pulse (SUSL) for generating the last sustain discharge is set to be less than 1 ms in the sustain period, that is, a reason why an upper threshold value is set to 1 ms is to sufficiently reduce the space charges generated in the sustain discharge and concurrently, secure an operational margin of the sustain period in sustain driving of a plasma display apparatus.

In the present invention, the subfield for controlling the length of the sustain period can be arbitrarily selected within one frame. For example, in the driving waveform according to the inventive driving method of the plasma display apparatus, it is desirable that, considering that an image is expressed by a combination of a plurality of subfields where a predetermined voltage is applied to the address electrode, the scan electrode, and the sustain electrode in the reset period, the address period, and the sustain period, when the subfield where the length of the sustain period is controlled is selected, all of the subfields of one frame are selected to more effectively prevent a high temperature erroneous discharge. That is, in the sustain period of all of the subfields of one frame, the sustain period is controlled.

A circumstance where the application time points of a scan pulse applied to the scan electrode (Y) and a data pulse applied to the address electrode (X) are different in the address period will be described below.

A method for making the application time point of the scan pulse applied to the scan electrode (Y) to be different from the application time point of the data pulse applied to the address electrodes (X1 to Xn) in the address period can be variously changed. There is a method of applying the data pulse at a time point different from the application time point where the scan pulse is applied to each of the address electrodes (X1 to Xn). This method will be described with reference to FIGS. 27A to 27E below.

FIGS. 27A to 27E illustrate an example of applying the data pulse to each of the address electrodes (X1 to Xn) at an application time point different from an application time point of the scan pulse in the driving waveform based on the driving method of the plasma display apparatus according to the present invention.

Figure 27A:
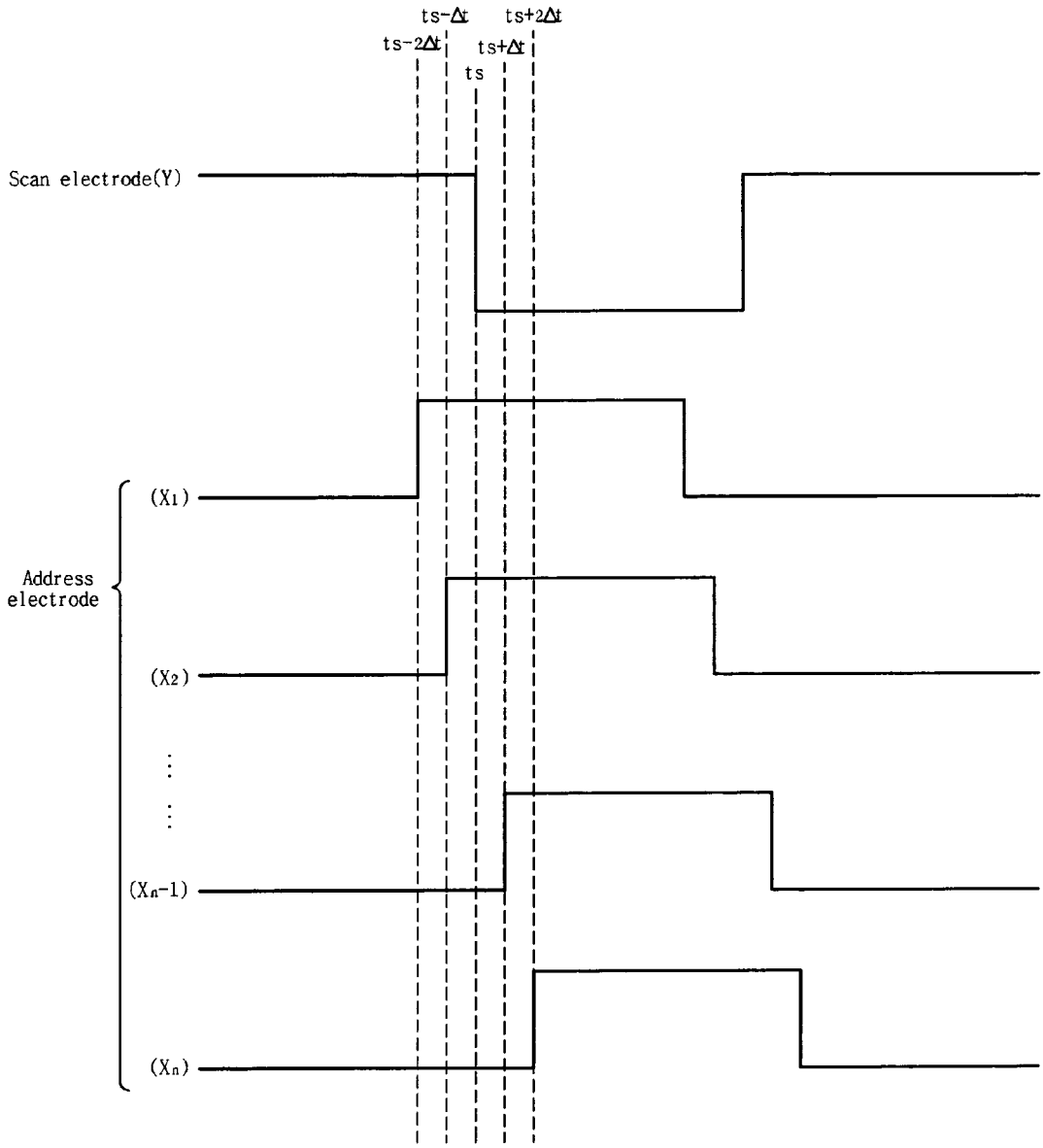
FIGS. 27A to 27E illustrate an example of applying a data pulse to each of the address electrodes (X1 to Xn) at an application time point different from an application time point of a scan pulse in a driving waveform based on a driving method of a plasma display apparatus according to the present invention.

Referring to FIGS. 27A to 27E, in the method for setting the application time points of the scan pulse and the data pulse to be different in the driving waveform of the present invention, in the address period of one subfield, the application time points of the data pulses applied to the address electrodes (X1 to Xn) are different from the application time point of the scan pulse applied to the scan electrode (Y), respectively. For example, as shown in FIG. 27A, in the driving waveform according to the driving method of the present invention, assuming that the application time point of the scan pulse applied to the scan electrode (Y) is "ts", the data pulse is applied to the address electrode (X1) at a time point earlier by 2Δt than a time point at which the scan pulse is applied to the scan electrode (Y), that is, at a time point "ts−2Δt" adaptively to an arrangement sequence of the address electrodes (X1 to Xn). The data pulse is applied to the address electrode (X2) at a time point earlier by Δt than a time point at which the scan pulse is applied to the scan electrode (Y), at a time point "ts−Δt". By this method, the data pulse is applied to the electrode (Xn−1) at a time point "ts−Δt", and the data pulse is applied to the electrode (Xn) at a time point "ts−2Δt". In other words, as shown in FIG. 27A, the data pulse is applied to the address electrodes (X1 to Xn) before or after the application time point of the scan pulse applied to the scan electrode (Y). Unlike FIG. 27A, the application time point of the data pulse applied to the address electrodes (X1 to Xn) is set to be different from the application time point of the scan pulse applied to the scan electrode (Y) so that the application time point of the data pulse applied to at least one address electrode (X1 to Xn) can also be set to be later than the application time point of the scan pulse. This driving waveform will be described with reference to FIG. 27B.

Figure 27B:
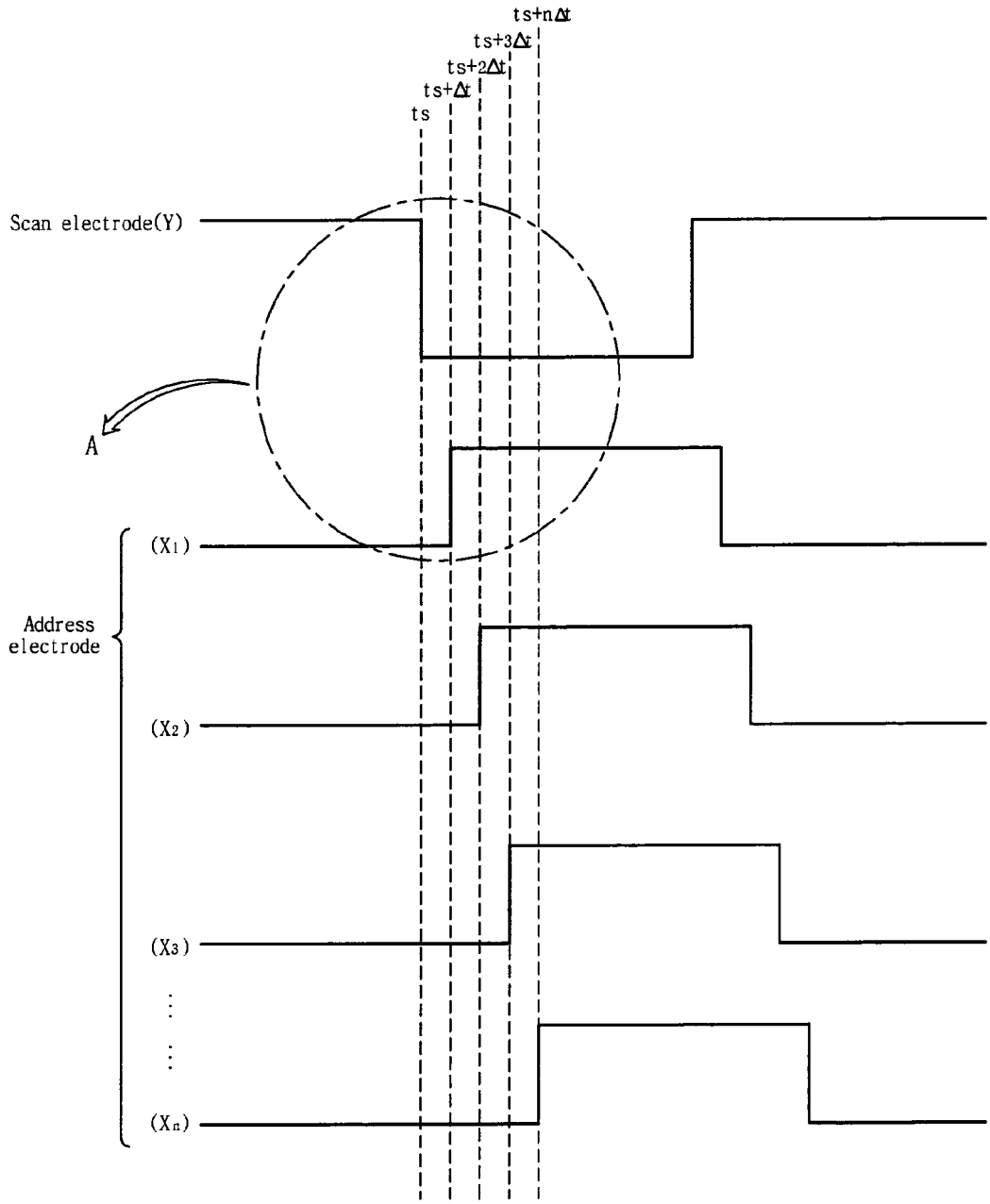
Figure 27C:
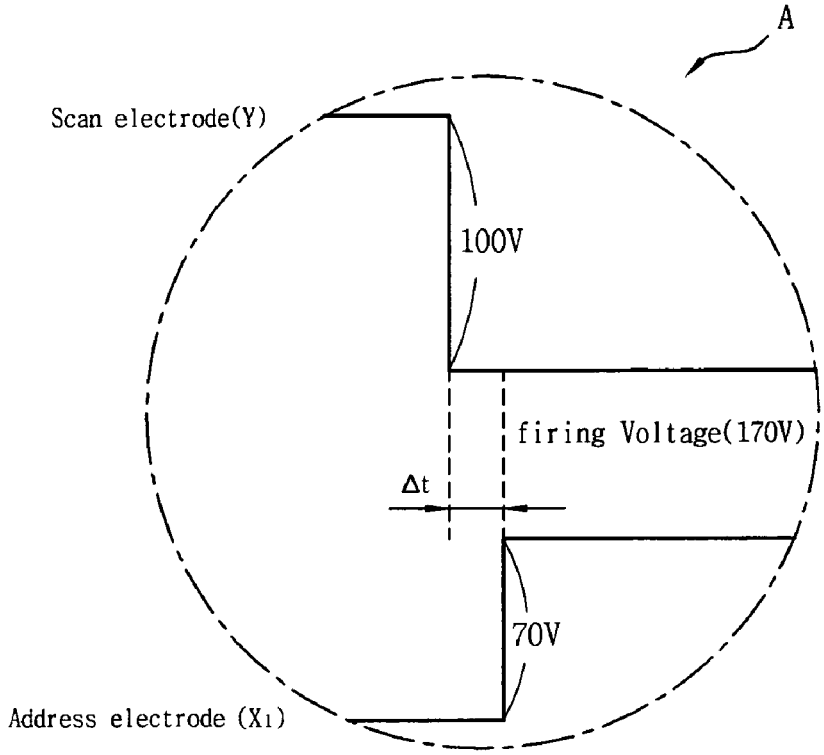

Referring to FIG. 27B, unlike FIG. 27A, in the driving waveform of the present invention, the application time point of the data pulse applied to the address electrodes (X1 to Xn) is different from the application time point of the scan pulse applied to the scan electrode (Y) and the application time points of all of the data pulses are later than the application time point of the scan pulse described above. In FIG. 27B, the application time points of all of the data pulses are later than the application time point of the scan pulse, but only the application time point of one data pulse can be set to be later than the application time point of the scan pulse, and the number of the data pulses applied later than the application time point of the scan pulse can be changed. For example, as shown in FIG. 27B, in the driving waveform according to the driving method of the present invention, assuming that the application time point of the scan pulse applied to the scan electrode (Y) is "ts", the data pulse is applied to the address electrode (X1) at a time point later by Δt than a time point that the scan pulse is applied to the scan electrode (Y), that is, at a time point "ts+Δt" adaptively to an arrangement sequence of the address electrodes (X1 to Xn). The data pulse is applied to the address electrode (X2) at a time point later by 2Δt than a time point at which the scan pulse is applied to the scan electrode (Y), that is, at a time point "ts+2Δt". In this method, the data pulse is applied to the electrode (X3) at a time point "ts+3Δt", and the data pulse is applied to the electrode (Xn) at a time point "ts+nΔt". In other words, as shown in FIG. 27B, the data pulse is applied to the address electrodes (X1 to Xn) after the application time point of the scan pulse applied to the scan electrode (Y). In a description of a region "A" where the discharge is generated in the driving waveform of FIG. 27B with reference to FIG. 27C, for example, assuming that an address discharge firing voltage is 170V, the scan pulse has a voltage of 100V, and the data pulse has a voltage of 70V, in the region "A", first, a voltage difference between the scan electrode (Y) and the address electrode (X1) becomes 100V by the scan pulse applied to the scan electrode (Y), and after a time "Δt" lapses after the applying of the scan pulse, a voltage difference between the scan electrode (Y) and the address electrode (X1) rises to 170V by the data pulse applied to the address electrode (X1). Accordingly, the voltage difference between the scan electrode (Y) and the address electrode (X1) becomes an address discharge firing voltage, thereby generating the address discharge between the scan electrode (Y) and the address electrodes (X1 to Xn). Unlike FIG. 27B, the application time point of the data pulse applied to the address electrodes (X1 to Xn) is set to be different from the application time point of the scan pulse applied to the scan electrode (Y) so that the application time point of the data pulse can be set to be earlier than the application time point of the scan pulse. This driving waveform will be described with reference to FIG. 27D.

Figure 27D:
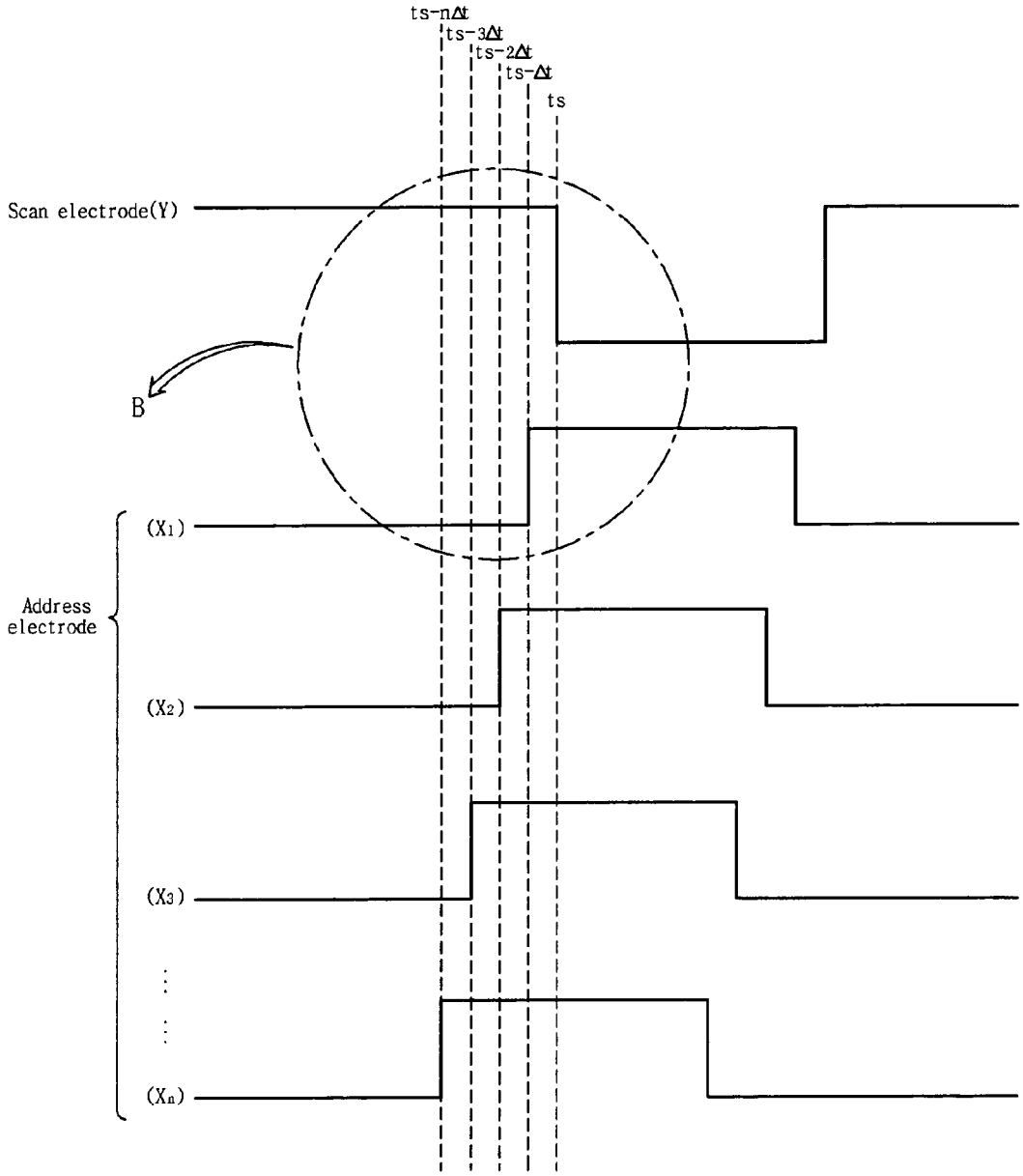
Figure 27E:
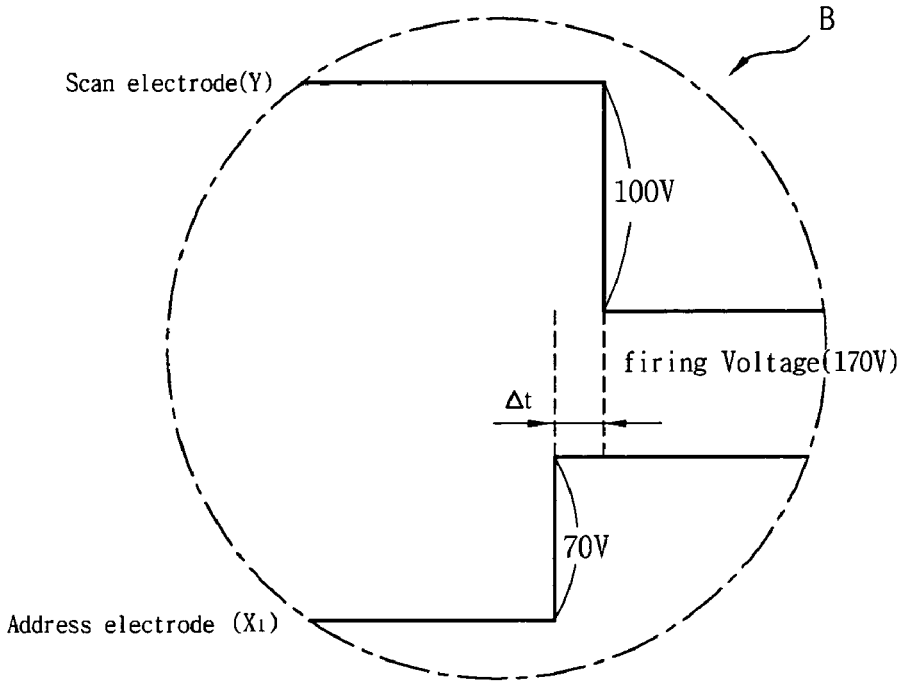

Referring to FIG. 27D, unlike FIG. 27A or FIG. 27B, in the driving waveform of the present invention, the application time point of the data pulse applied to the address electrodes (X1 to Xn) is different from the application time point of the scan pulse applied to the scan electrode (Y) and the application time points of the data pulses are earlier than the application time point of the scan pulse described above. In FIG. 27D, the application time points of all of the data pulses are earlier than the application time point of the scan pulse, but only the application time point of one data pulse can be set to be earlier than the application time point of the scan pulse described above, and the number of the data pulses applied earlier than the application time point of the scan pulse can be changed. For example, as shown in FIG. 27D, in the driving waveform according to the driving method of the present invention, assuming that the application time point of the scan pulse applied to the scan electrode (Y) is "ts", the data pulse is applied to the address electrode (X1) at a time point earlier by Δt than a time point at which the scan pulse is applied to the scan electrode (Y), that is, at a time point "ts−Δt" adaptively to an arrangement sequence of the address electrodes (X1 to Xn). The data pulse is applied to the address electrode (X2) at a time point earlier by 2Δt than a time point at which the scan pulse is applied to the scan electrode (Y), that is, at a time point "ts−2Δt". In this method, the data pulse is applied to the electrode (X3) at a time point "ts−3Δt", and the data pulse is applied to the electrode (Xn) at a time point "ts−nΔt". In other words, as shown in FIG. 27D, the data pulse is applied to the address electrodes (X1 to Xn) before the application time point of the scan pulse applied to the scan electrode (Y). In a description of a region "B" where the discharge is generated in the driving waveform of FIG. 27D with reference to FIG. 27E, for example, assuming that an address discharge firing voltage is 170V as in FIG. 27C, the scan pulse has the voltage of 100V, and the data pulse voltage is 70V, in the region "B", first, a voltage difference between the scan electrode (Y) and the address electrode (X1) is 70V due to the data pulse applied to the address electrode (X1), and after a time "Δt" lapses after the applying of the data pulse, the voltage differences between the scan electrode (Y) and the address electrodes (X1 to Xn) rise to 170V due to the scan pulse applied to the scan electrode (Y). Accordingly, the voltage difference between the scan electrode (Y) and the address electrode (X1) becomes the address discharge firing voltage, thereby generating the address discharge between the scan electrode (Y) and the address electrode (X1).

In FIGS. 27A to 27E, a difference between the application time point of the scan pulse applied to the scan electrode (Y) and the application time points of the data pulses applied to the address electrodes (X1 to Xn) or a difference between the application time points of the data pulses applied to the address electrodes (X1 to Xn) are described with reference to Δt. In describing Δt, for example, the application time point of the scan pulse applied to the scan electrode (Y) is "ts", a difference between the application time point (ts) of the scan pulse and the application time point of the data pulse being most proximate with the application time point (ts) is "Δt" and a difference between the application time point (ts) of the scan pulse and the application time point of the data pulse being subsequently proximate with the application time point (ts) is twice Δt, that is, 2Δt. Δt is constant. In other words, the application time point of the scan pulse applied to the scan electrode (Y) is different from the application time points of the data pulses applied to the address electrodes (X1 to Xn), respectively, while the differences between the application time points of the data pulses applied to the address electrodes (X1 to Xn) are the same as one another, respectively. Within one subfield, the differences between the application time points of the data pulses applied to the address electrodes (X1 to Xn) are the same as one another, respectively while the difference between the application time point of the scan pulse and the application time point of the data pulse being the most proximate with the application time point of the scan pulse can also be made to be the same as or different from one another. For example, if in one subfield, the differences between the application time points of the data pulses applied to the address electrodes (X1 to Xn) are made to be the same as one another, respectively while, in any one address period, the difference between the application time point (ts) of the scan pulse and the application time point of the data pulse being most proximate with the application time point (ts) is "Δt", in other address periods of the same subfield, the difference between the application time point (ts) of the scan pulse and the application time point of the data pulse being most proximate with the application time point (ts) is "2Δt". The difference between the application time point (ts) of the scan pulse and the application time point of the data pulse being most proximate with the application time point (ts) is more than 10 ns in consideration of a time of the limited address period, and is preferably set to less than 1000 ns. Considering any one scan pulsewidth depending on the driving of the plasma display panel, the "Δt" is preferably set to have a range of one-hundredth to one predetermined scan pulsewidth. For example, assuming that a width of one scan pulse is 1 μs, a difference between the application time points has a range of one-hundredth time of 1 μs (that is, 10 ns) to one 1 μs (that is, 1000 ns).

The application time point of the scan pulse and the application time point of the data pulse are different from each other while the difference between the application time points of the data pulses can be also different from one another, respectively. In other words, the application time points of the data pulses applied to the address electrodes (X1 to Xn) are different from the application time point of the scan pulse applied to the scan electrode (Y) while the application time points of the data pulses applied to the address electrodes (X1 to Xn) are different from one another, respectively. For example, assuming that the application time point of the scan pulse applied to the scan electrode (Y) is "ts", and the difference between the application time point (ts) of the scan pulse and the application time point of the data pulse being most proximate with the application time point (ts) is "Δt", the difference between the application time point (ts) of the scan pulse and the application time point of the data pulse being subsequently proximate with the application time point (ts) can also be "3Δt". For example, if the application time point that the scan pulse is applied to the scan electrode (Y) is 0 ns, the data pulse is applied to the address electrode (X1) at a time point of 10 ns. Accordingly, the difference between the application time point of the scan pulse applied to the scan electrode (Y) and the application time point of the data pulse applied to the address electrode (X1) is 10 ns. The data pulse is applied to a next address electrode (X2) at a time point of 20 ns so that the difference between the application time point of the scan pulse applied to the scan electrode (Y) and the application time point of the data pulse applied to the address electrode (X2) is 20 ns and accordingly, the difference between the application time point of the data pulse applied to the address electrode (X1) and the application time point of the data pulse applied to the address electrode (X2) is 10 ns. The data pulse is applied to a next address electrode (X3) at a time point of 40 ns so that the difference between the application time point of the scan pulse applied to the scan electrode (Y) and the application time point of the data pulse applied to the address electrode (X3) is 40 ns and accordingly, the difference between the application time point of the data pulse applied to the address electrode (X2) and the application time point of the data pulse applied to the address electrode (X3) is 20 ns. In other words, the application time point of the scan pulse applied to the scan electrode (Y) and the application time point of the data pulse applied to the address electrode (X1 to Xn) are different from one another while the difference between the application time points of the data pulses applied to the address electrodes (X1 to Xn) can also be different from one another, respectively.

The difference (Δt) between the application time point of the scan pulse applied to the scan electrode (Y) and the application time points of the data pulses applied to the address electrodes (X1 to Xn) is more than 10 ns, and is preferably set to be less than 1000 ns. Considering the scan pulsewidth according to the driving of the plasma display panel, the "Δt" is preferably set to have a range of one-hundredth to one predetermined scan pulsewidth.

In the address period, the application time point of the scan pulse applied to the scan electrode (Y) is different from the application time points of the data pulses applied to the address electrodes (X1 to Xn), thereby reducing coupling through a capacitance of the panel at each application time point of the data pulse applied to the address electrodes (X1 to Xn) and reducing noise of the waveform applied to the scan electrode and the sustain electrode. This noise reduction will be described with reference to FIGS. 28A and 28B below.

Figure 28A:
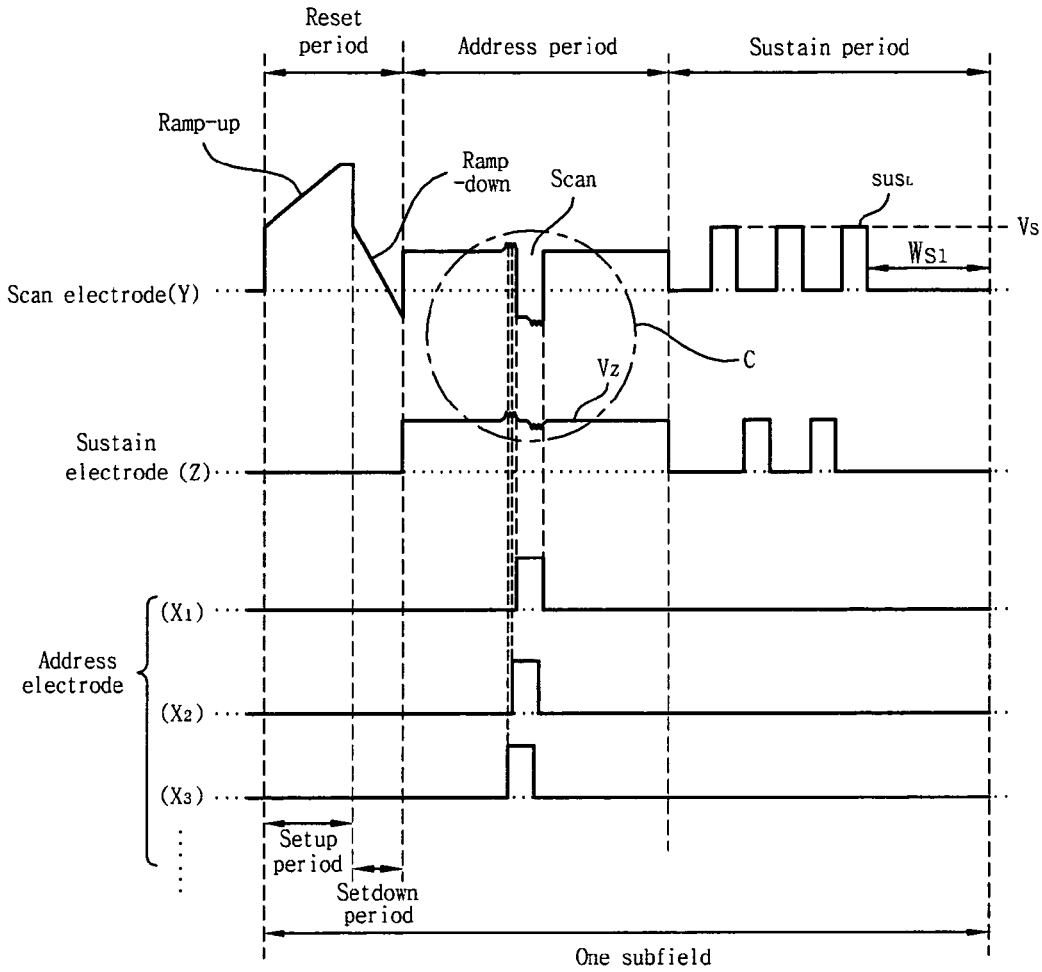
FIGS. 28A and 28B illustrate a reduction of noise by a driving waveform according to the present invention.
Figure 28B:
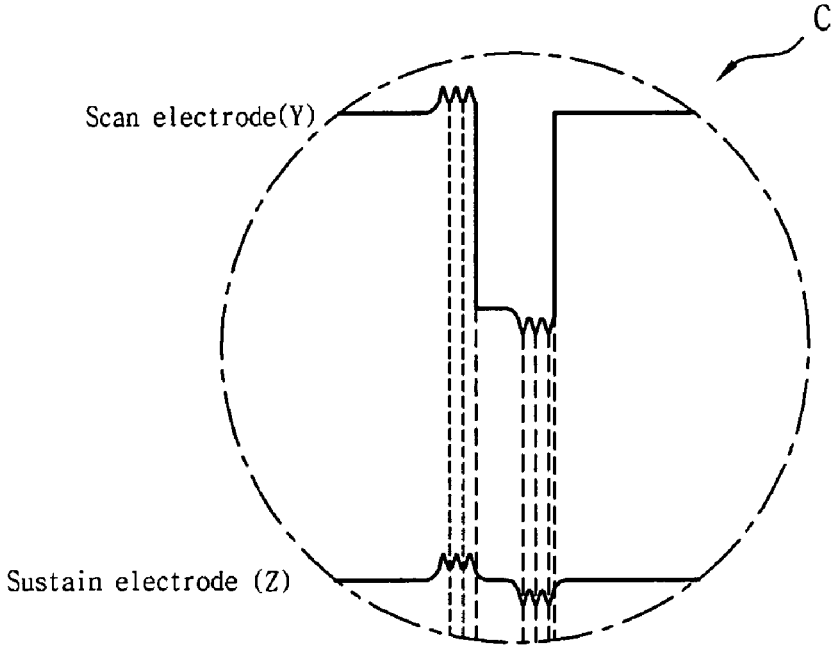

FIGS. 28A and 28B illustrate the noise reduced by the driving waveform according to the present invention.

Figure 10:
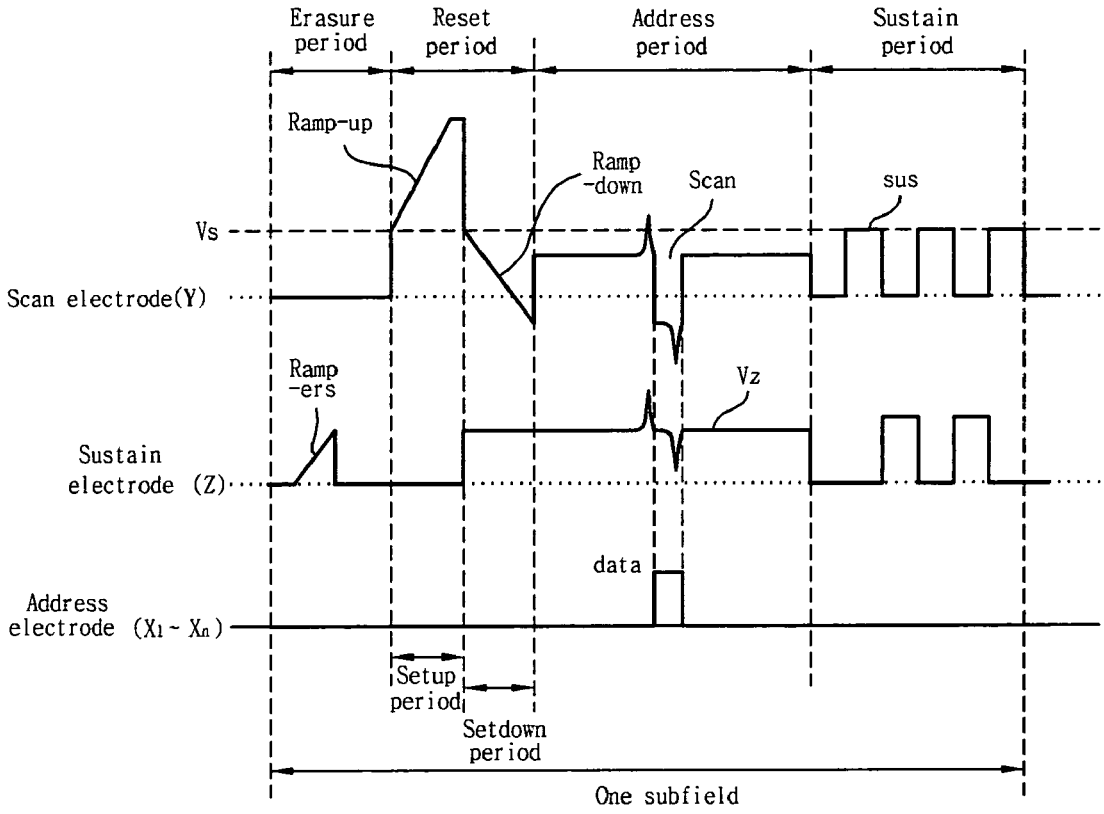
FIG. 10 illustrates noise resulting from a pulse applied in an address period in a conventional driving method of a plasma display apparatus.
Figure 11:
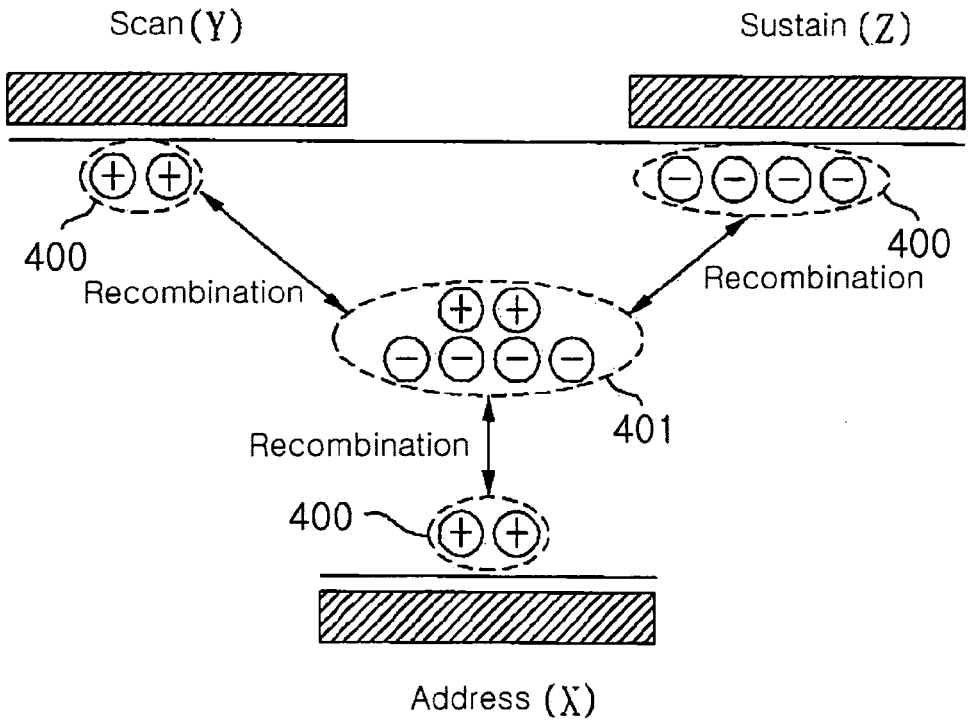
FIG. 11 illustrates an erroneous discharge resulting from temperature in a plasma display apparatus operating by a driving waveform based on a conventional driving method.

Referring to FIG. 28A, the noise of the waveforms applied to the scan electrode and the sustain electrode is significantly reduced in comparison to FIG. 10. This noise is shown in FIG. 28B in more detail. A reason for the reduction in noise is that, without applying the data pulse to all of the address electrodes (X1 to Xn) at the same time point as the application time point of the scan pulse applied to the scan electrode (Y), the data pulse is applied to each of the address electrodes (X1 to Xn) at a time point different from the application time point of the scan pulse so that the coupling through the capacitance of the panel is reduced at each time point, thereby reducing the rising noise generated from the waveform applied to the scan electrode and the sustain electrode at a time point at which the data pulse rises abruptly, and reducing a falling noise generated from the waveform applied to the scan electrode and the sustain electrode at a time point at which the data pulse falls abruptly. Accordingly, the address discharge generated in the address period is stabilized, thereby preventing the reduction of driving stabilization of the plasma display panel.

As a result, the address discharge of the plasma display panel is stabilized, thereby making it possible to employ a single scan method where a whole panel is scanned with one driver.

Where the pre-reset period is included between the sustain period and the reset period, the data pulses are applied to all of the address electrodes (X1 to Xn) at time points different from the application time point of the scan pulse applied to the scan electrode. However, it is possible that at least any one of the data pulses applied to the address electrodes (X1 to Xn) can be applied at the same time point as those of at least two to (n−1) ones of the address electrodes (X1 to Xn). This method is the same as that of the driving method of the plasma display apparatus according to the second embodiment of the present invention.

Figure 29:
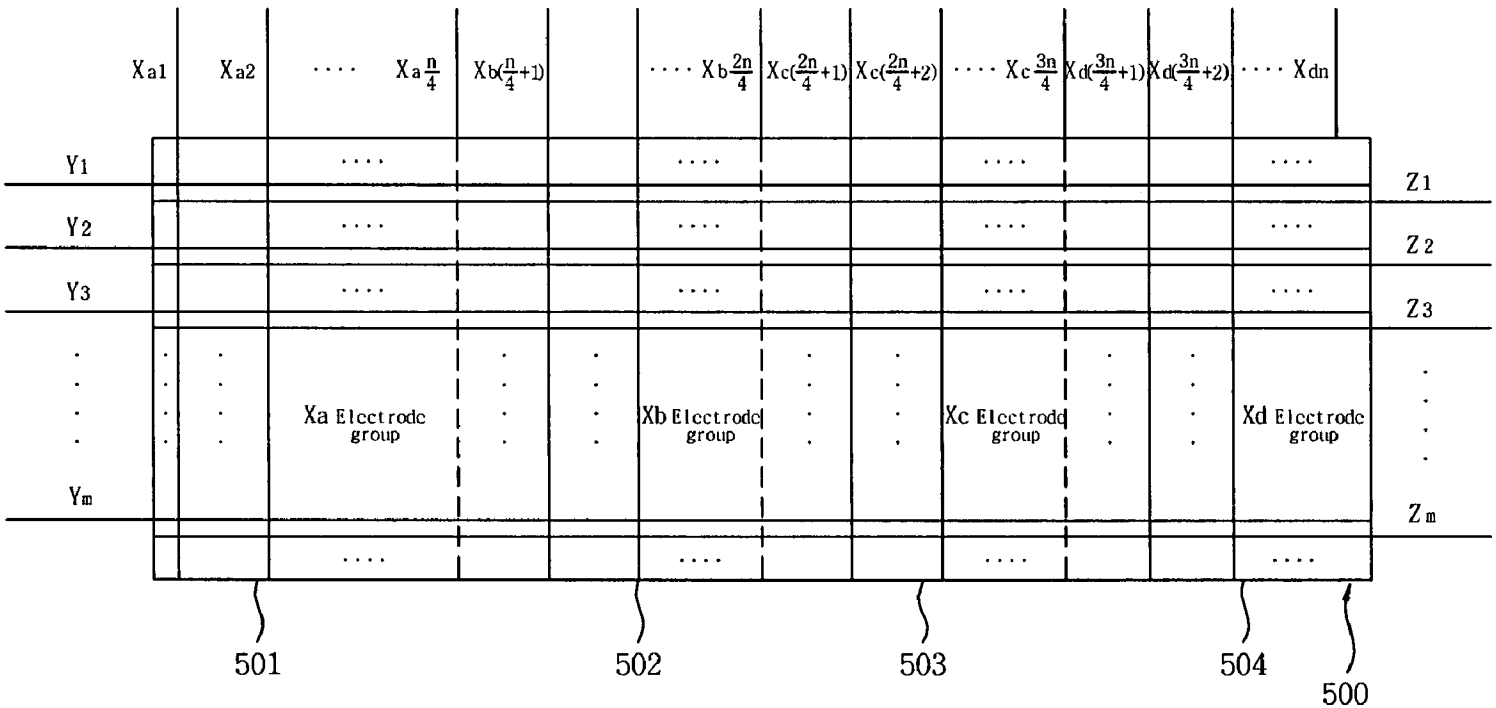
FIG. 29 illustrates address electrodes (X1 to Xn) grouped as four address electrode groups to describe another driving waveform in a driving method of a plasma display apparatus according to the seventh embodiment of the present invention.

FIG. 29 illustrates address electrodes (X1 to Xn) grouped as four address electrode groups to describe another driving waveform in a driving method of a plasma display apparatus according to the seventh embodiment of the present invention.

Figure 7A:
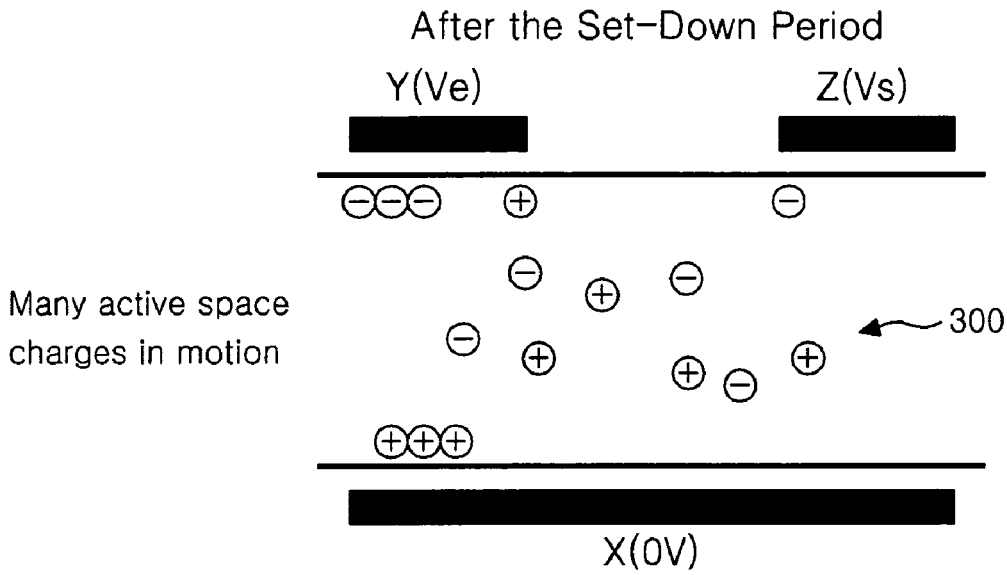
FIGS. 7A to 7C illustrate space charges and the motion of the space charges when a plasma display panel is driven in a high temperature environment by a driving waveform of FIG. 4.
Figure 7B:
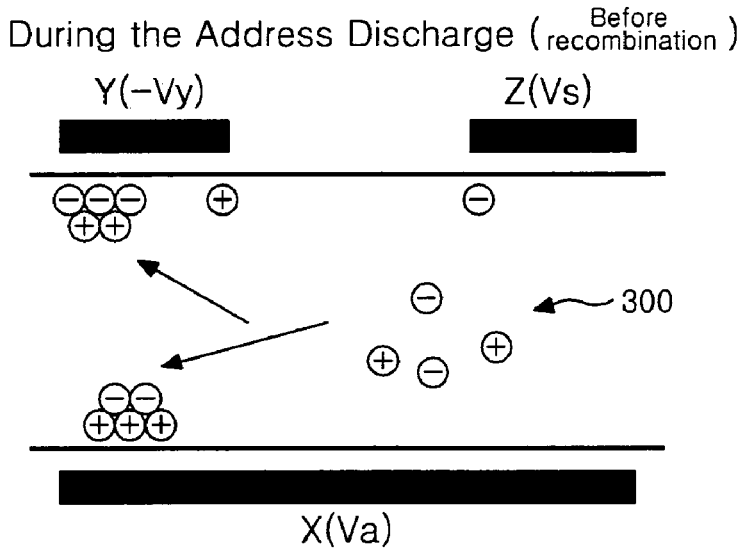
Figure 7C:
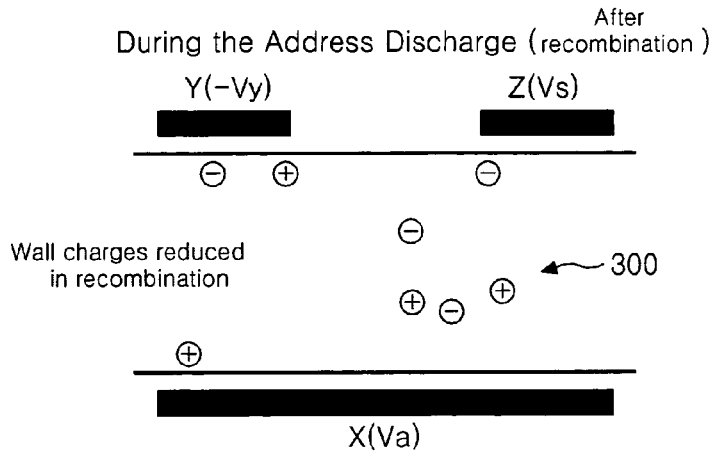

In the driving method of the plasma display apparatus according to the seventh embodiment of the present invention, only a case where application time points of a scan pulse applied to a scan electrode (Y) and a data pulse applied to the address electrode (X) are different from one another in an address period will be illustrated and described. However, the driving method according to the seventh embodiment of the present invention is basically the same as the driving method according to the sixth embodiment of the present invention and like the sixth embodiment, even in the seventh embodiment, a length of a sustain period is controlled to reduce space charges within a discharge cell in the sustain period. The controlling of the sustain period according to the seventh embodiment is substantially the same as in the sixth embodiment and therefore, its duplicate description will be omitted. Also, illustrations in FIG. 7 will be omitted.

In the driving method of the plasma display apparatus according to the seventh embodiment of the present invention, as shown in FIG. 29, the address electrodes (X1 to Xn) of a plasma display panel 500 are grouped as, for example, an Xa electrode group (Xa1 to Xa(n)/4) 501, an Xb electrode group (Xb{(n/4)+1} to Xb(2n)/4) 502, an Xc electrode group (Xc{(2n/4)+1} to Xc(3n)/4) 503, and an Xd electrode group (Xd{3n/4}+1) to Xd(n)) 504, and a data pulse is applied to any one of the grouped address electrode groups at a time point different from an application time point of a scan pulse applied to a scan electrode (Y). In other words, the data pulse is applied to all of the electrodes (Xa1 to Xa(n)/4) belonging to the Xa electrode group 501 at a time point different from the application time point of the scan pulse applied to the scan electrode (Y) and the application time points of the data pulses applied to the electrodes (Xa1 to Xa(n)/4) belonging to the Xa electrode group 501 are all the same. The data pulses are applied to the electrodes belonging to remaining other electrode groups 502, 503 and 504 at application time points different from the application time points of the data pulses applied to the electrodes (Xa1 to Xa(n)/4) belonging to the Xa electrode group 501 and the application time points of the data pulses applied to the electrodes belonging to other address electrode groups 502, 503 and 504 can be the same as or different from the application time point of the scan pulse applied to the scan electrode (Y).

In FIG. 29, the number of the address electrodes included in each of the address electrodes 501, 502, 503 and 504 is the same, but the number of the address electrodes included in each of the address electrode groups 501, 502, 503 and 504 can be set to be different from each other. Further, the number of the address electrode groups is controllable. The number of the address electrode groups can be set to have a range of at least two to a total maximum number of address electrodes, that is, $2 \leqq N \leqq (n-1)$.

In FIG. 25, in association with address electrode groups as shown FIG. 29, the address electrodes (X1 to Xn) of the plasma display panel are grouped as a plurality of address electrode groups, and the address electrode groups includes the address electrodes one by one, respectively.

The application time point of the data pulse applied to the plasma display panel where the address electrodes are grouped as four address electrode groups will be described with reference to FIGS. 30A to 30C below.

Figure 30A:
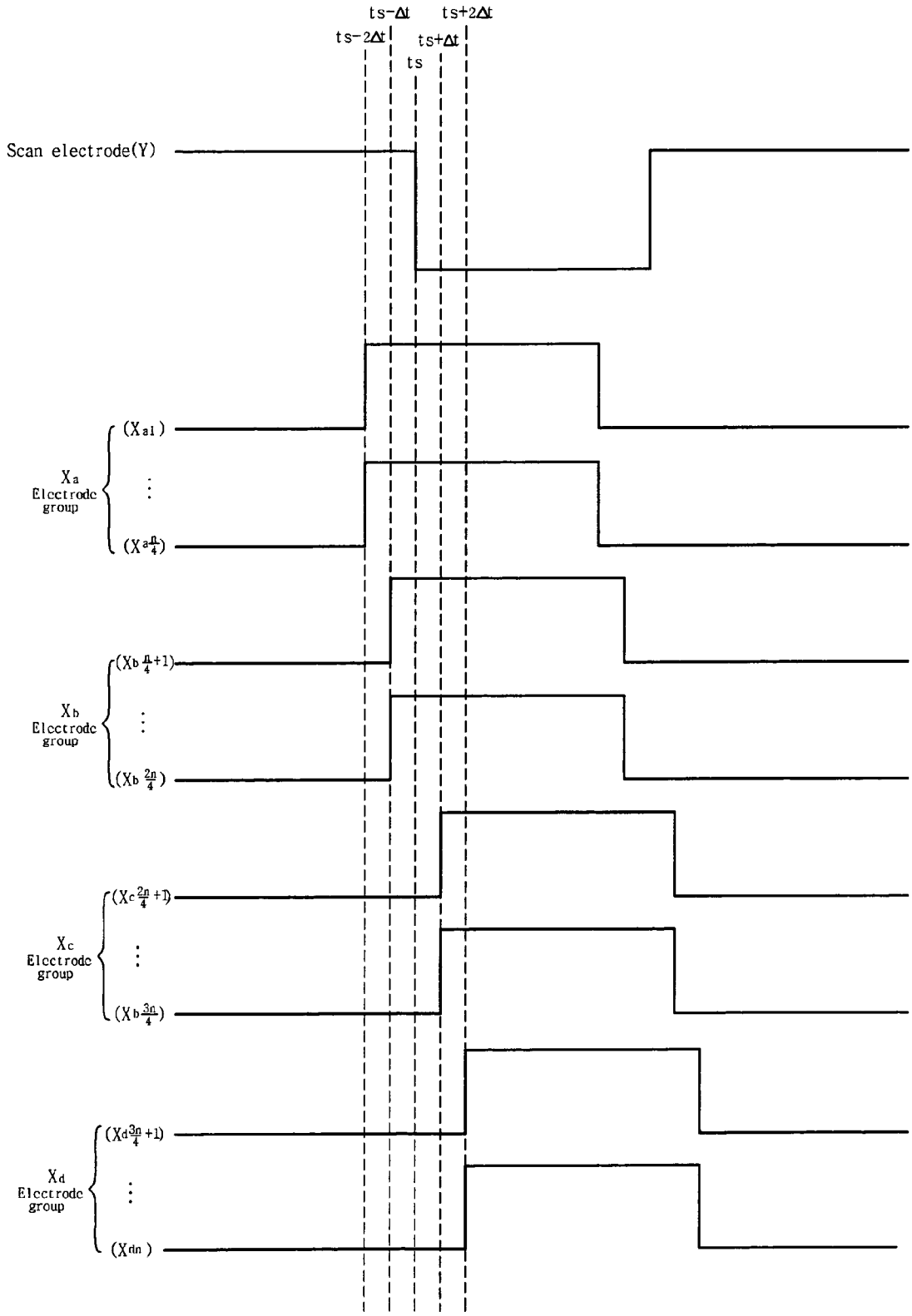
FIGS. 30A to 30C illustrate an example of grouping address electrodes (X1 to Xn) as a plurality of electrode groups and applying a data pulse to each electrode group at an application time point different from an application time point of a scan pulse in a driving waveform of a driving method of a plasma display apparatus according to the seventh embodiment of the present invention.
Figure 30B:
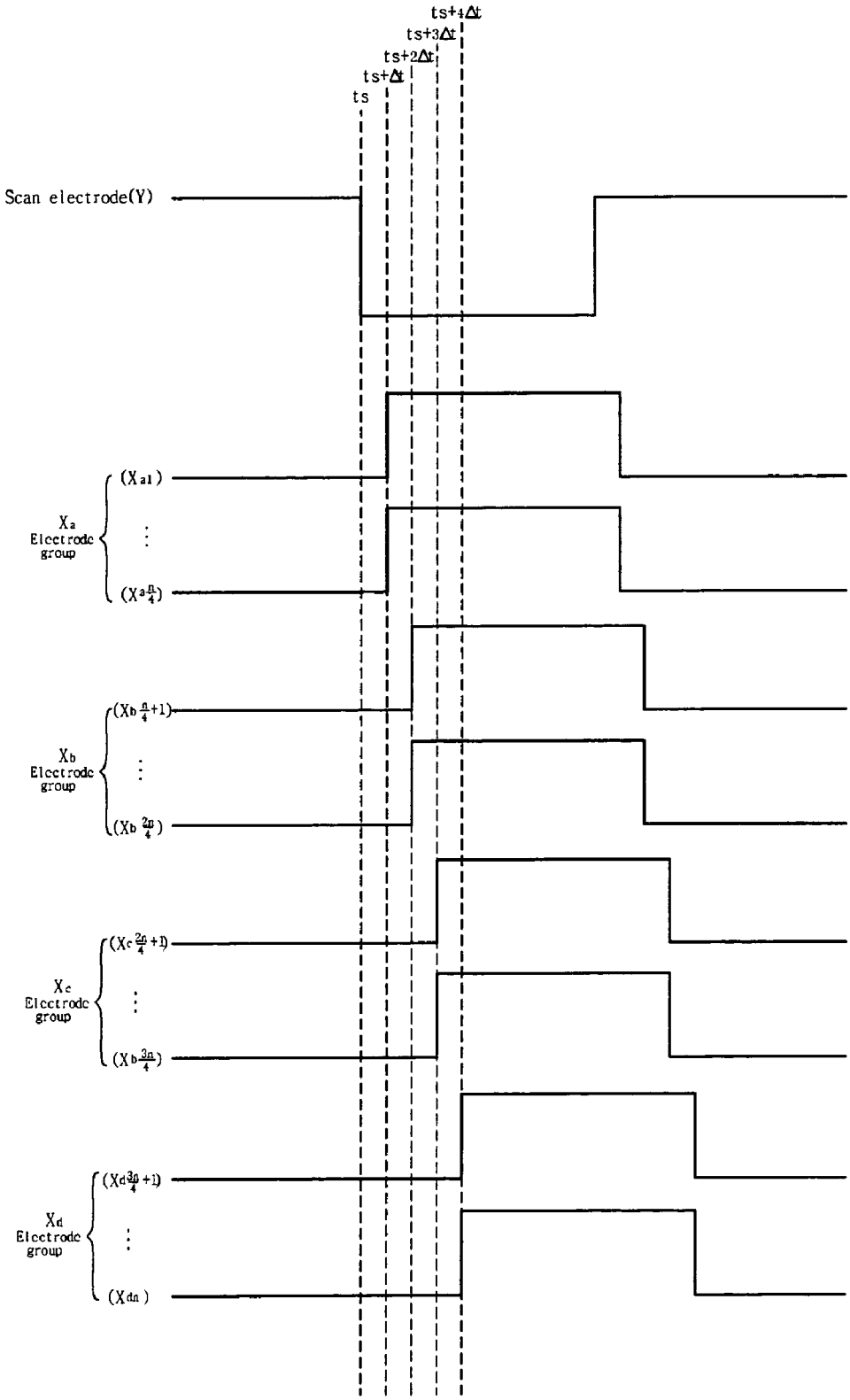
Figure 30C:
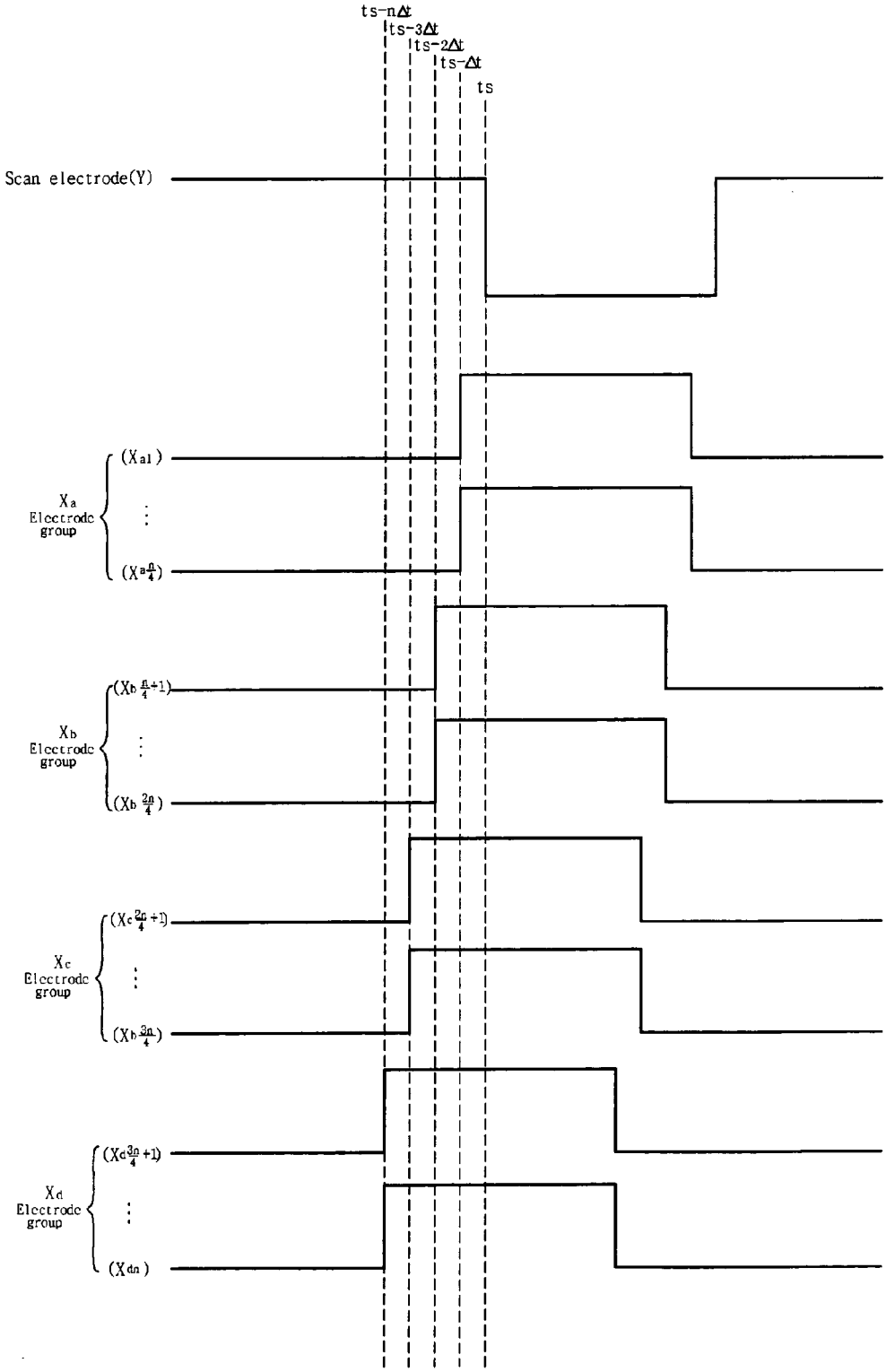

FIGS. 30A to 30C illustrate an example of grouping the address electrodes (X1 to Xn) as the plurality of electrode groups and applying the data pulse to each electrode group at the application time point different from the application time point of the scan pulse in the driving waveform of the driving method of the plasma display apparatus according to the seventh embodiment of the present invention.

As shown in FIGS. 30A to 30C, in the driving waveform according to the present invention, the plurality of address electrodes (X1 to Xn) are grouped as the plurality of address electrode groups (Xa, Xb, Xc, and Xd) as in FIG. 29, and in the address period of the subfield, the application time points of the data pulses applied to the address electrodes (X1 to Xn) of at least one of the plurality address electrode groups are different from the application time point of the scan pulse applied to the scan electrode (Y). Though not illustrated in the drawings, but as in the driving method of the plasma display apparatus of the present invention, the length of the sustain period is controlled to reduce the number of space charges within the discharge cell.

The length of the sustain period is controlled, thereby preventing the generation of above high temperature erroneous discharges as mentioned above.

The application time point of the scan pulse applied to the scan electrode (Y) and the application time points of the data pulses applied to the address electrodes (X1 to Xn) are different from one another, thereby preventing destabilization of the address discharge and preventing a reduction of the driving stability. Accordingly, driving efficiency is enhanced. For example, as shown in FIG. 30A, assuming that the application time point of the scan pulse applied to the scan electrode (Y) is "ts", the data pulses are applied to the address electrodes (Xa1 to Xa(n)/4) at a time point earlier by 2Δt than a time point at which the scan pulse is applied to the scan electrode (Y), that is, at a time point "ts−2Δt" adaptively to an arrangement sequence of the address electrode groups including the address electrodes (X1 to Xn). The data pulses are applied to the address electrode (Xb{(n/4)+1} to Xb(2n)/4) included in the electrode group (Xb) at a time point earlier by Δt than a time point at which the scan pulse is applied to the scan electrode (Y), at a time point "ts−Δt". In this method, the data pulses are applied to the address electrodes (Xc{(2n/4)+1} to Xc(3n)/4) included in the electrode group (Xc) at a time point "ts+Δt", and the data pulses are applied to the address electrodes (Xd{(3n/4)+1} to Xd(n)) included in the electrode group (Xd) at a time point "ts+2Δt". In other words, as shown in FIG. 30A, the data pulses are applied to the electrode groups (Xa, Xb, Xc, and Xd) including the address electrodes (X1 to Xn) before or after the application time point of the scan pulse applied to the scan electrode (Y). Unlike FIG. 30A, the application time point of the data pulse applied to the address electrode of at least any one of the plurality of address electrode groups can also be set to be later than the application time point of the scan pulse. This driving waveform will be described with reference to FIG. 30B.

Referring to FIG. 30B, unlike FIG. 30A, in the driving waveform of the present invention, the application time point of the data pulses applied to the plurality of address electrode groups (Xa, Xb, Xc, and Xd) including the address electrodes (X1 to Xn) is different from the application time point of the scan pulse applied to the scan electrode (Y) and the application time points of all of the data pulses are later than the application time point of the scan pulse described above. In FIG. 30B, the application time points of all data pulses applied to the address electrodes included in each of the address electrode groups are later than the application time point of the scan pulse, but only the application time points of the data pulses applied to the address electrodes of just one of the plurality of address electrode groups can also be later than the application time point of the scan pulse described above, and the number of the data pulses applied later than the application time point of the scan pulse can be changed. For example, as shown in FIG. 30B, in the driving waveform according to the driving method of the present invention, assuming that the application time point of the scan pulse applied to the scan electrode (Y) is "ts", the data pulses are applied to the address electrodes included in the electrode group (Xa) at a time point later by Δt than a time point at which the scan pulse is applied to the scan electrode (Y), that is, at a time point "ts+Δt" adaptively to an arrangement sequence of the address electrode group including the address electrodes (X1 to Xn). The data pulses are applied to the address electrodes included in the electrode group (Xb) at a time point later by 2Δt than a time point at which the scan pulse is applied to the scan electrode (Y), that is, at a time point "ts+2Δt". In this method, the data pulse is applied to the address electrodes included in the electrode group (Xc) at a time point "ts+3Δt" and the data pulse is applied to the electrode group (Xd) at a time point "ts+4Δt". In other words, as shown in FIG. 30B, the data pulses are applied to the address electrode groups including the address electrodes (X1 to Xn) after the application time point of the scan pulse applied to the scan electrode (Y). Unlike FIG. 30B, the application time points of the data pulses applied to the address electrode groups including the address electrodes (X1 to Xn) are different from the application time point of the scan pulse applied to the scan electrode (Y) so that the application time point of the data pulse can be earlier than the application time point of the scan pulse. This driving waveform will be described with reference to FIG. 30C.

Referring to FIG. 30C, unlike FIG. 30A or FIG. 30B, in the driving waveform of the present invention, the application time points of the data pulses applied to the address electrode groups including the address electrodes (X1 to Xn) are different from the application time point of the scan pulse applied to the scan electrode (Y) and the application time points of all of the data pulses are earlier than the application time point of the scan pulse described above. In FIG. 30C, the application time points of all of the data pulses are earlier than the application time point of the scan pulse, but only the application time point of one data pulse can be earlier than the application time point of the scan pulse described above, and the number of the address electrode groups to which the data pulses are applied earlier than the application time point of the scan pulse can be changed. For example, as shown in FIG. 30C, in the driving waveform according to the driving method of the present invention, assuming that the application time point of the scan pulse applied to the scan electrode (Y) is "ts", the data pulses are applied to the address electrode included in the electrode group (Xa) at a time point earlier by Δt than a time point at which the scan pulse is applied to the scan electrode (Y), that is, at a time point "ts−Δt" adaptively to an arrangement sequence of the address electrode groups including the address electrodes (X1 to Xn). The data pulses are applied to the address electrode included in the electrode group (Xb) at a time point earlier by 2Δt than a time point at which the scan pulse is applied to the scan electrode (Y), that is, at a time point "ts−2Δt". In this method, the data pulse is applied to the address electrode included in the electrode group (Xc) at a time point "ts−3Δt", and the data pulse is applied to the address electrode included in the electrode group (Xd) at a time point "ts−(n−1)Δt". In other words, as shown in FIG. 30C, the data pulse is applied to the electrode groups including the address electrodes (X1 to Xn) before the application time point of the scan pulse applied to the scan electrode (Y).

In FIGS. 30A to 30C, for example, the application time point of the scan pulse applied to the scan electrode (Y) is "ts", and a difference between the application time point (ts) of the scan pulse and the application time point of the data pulse being most proximate with the application time point (ts) is "Δt", and a difference between the application time point (ts) of the scan pulse and the application time point of the data pulse being subsequently proximate with the application time point (ts) is "2Δt". "Δt" is constant. In other words, in at least any one of the plurality of address electrode groups, the application time point of the data pulse applied to the address electrode is different from the application time point of the scan pulse applied to the scan electrode (Y) while the differences between the application time points of the data pulses applied to the address electrodes (X1 to Xn) included in the plurality of address electrode groups are the same as one another, respectively. Unlike this, the application time point of the data pulse applied to the address electrode of at least any one of the plurality of address electrode groups is different from the application time point of the scan pulse applied to the scan electrode (Y) while the application time points of the data pulses applied to each address electrode group of the plurality of address electrode groups can be set to be different from one another, respectively. In other words, assuming that the difference between the application time point (ts) of the scan pulse and the application time point of the data pulse being most proximate with the application time point (ts) is "Δt", the difference between the application time point (ts) of the scan pulse and the application time point of the data pulse being subsequently proximate with the application time point (ts) can also be "3Δt". For example, if the application time point at which the scan pulse is applied to the scan electrode (Y) is 0 ns, the data pulses are applied to the address electrodes included in the electrode group (Xa) at a time point of 10 ns. Accordingly, the difference between the application time point of the scan pulse applied to the scan electrode (Y) and the application time point of the data pulse applied to the electrode group (Xa) is 10 ns. The data pulse is applied to the electrode group (Xb) being a next address electrode group at a time point of 20 ns so that the difference between the application time point of the scan pulse applied to the scan electrode (Y) and the application time point of the data pulse applied to the electrode group (Xb) is 20 ns and accordingly, the difference between the application time point of the data pulse applied to the electrode group (Xa) and the application time point of the data pulse applied to the electrode group (Xb) is 10 ns. The data pulses are applied to the address electrodes included in the electrode group (Xc) being a next address electrode group at a time point of 40 ns so that the difference between the application time point of the scan pulse applied to the scan electrode (Y) and the application time point of the data pulse applied to the electrode group (Xc) is 40 ns and accordingly, the difference between the application time point of the data pulse applied to the electrode group (Xb) and the application time point of the data pulse applied to the electrode group (Xc) is 20 ns. In other words, the application time point of the scan pulse applied to the scan electrode (Y) and the application time point of the data pulse applied to each address electrode group are different from one another while the difference between the application time points of the data pulses applied to each address electrode group can also be different from one another, respectively.

The difference between the application time points of the data pulses depending on the address electrode group is more than 10 ns considering a limited time of the address period, and is preferably set to be less than 1000 ns. Considering the scan pulsewidth according to the driving of the plasma display panel, the "Δt" is preferably set to have a range of one-hundredth to one predetermined scan pulsewidth.

Assuming that the application time point of the scan pulse applied to the scan electrode (Y) is "ts", irrespective of a relationship of the application time points of the data pulses applied to the plurality of address electrode groups, the differences between the application time points (ts) of the scan pulses and the application time points of the data pulses being most proximate with the application time points (ts) can be the same or different from one another within one subfield, respectively. As mentioned above, the difference between the application time point of the scan pulse and the application time point of the data pulse being most proximate with the application time point of the scan pulse is preferably set to have a range of 10 ns to 1000 ns in consideration of the limited time of the address period. Considering a predetermined scan pulsewidth according to the driving of the plasma display panel, the "Δt" is preferably set to have a range of one-hundredth to one total address period.

If the application time point of the scan pulse applied to the scan electrode (Y) and the application time point of the data pulse applied to each address electrode group are different in the address period as described above, as shown in FIGS. 28A to 28B, coupling through a capacitance of the panel is reduced at each application time point of the data pulse applied to each address electrode group including the address electrodes (X1 to Xn), thereby reducing the noise of the waveforms applied to the scan electrode and the sustain electrode. Accordingly, the address discharge generated in the address period is stabilized, thereby preventing the reduction of the driving stability of the plasma display panel.

As a result, the address discharge of the plasma display panel is stabilized, thereby making it possible to employ a single scan method where a whole panel is scanned with one driver.

In addition, the length of the sustain period is controlled, thereby preventing high temperature erroneous discharges.

Where the application time points of the scan pulse and the data pulse are different from one another, only the difference between the application time point of the scan pulse applied to the scan electrode (Y) and the application time point of the data pulse within one subfield has been illustrated and described. However, on a one frame basis, the application time point of the scan pulse applied to the scan electrode (Y) and the application time points of the data pulses applied to the address electrodes (X1 to Xn) or the address electrode groups (Xa, Xb, Xc, and Xd) are different from one another while, int each subfield, the difference between the application time points of the data pulses applied to the address electrodes can be different from one another. This driving waveform will be described in a driving method of a plasma display apparatus according to the eighth embodiment of the present invention below.

Figure 31:
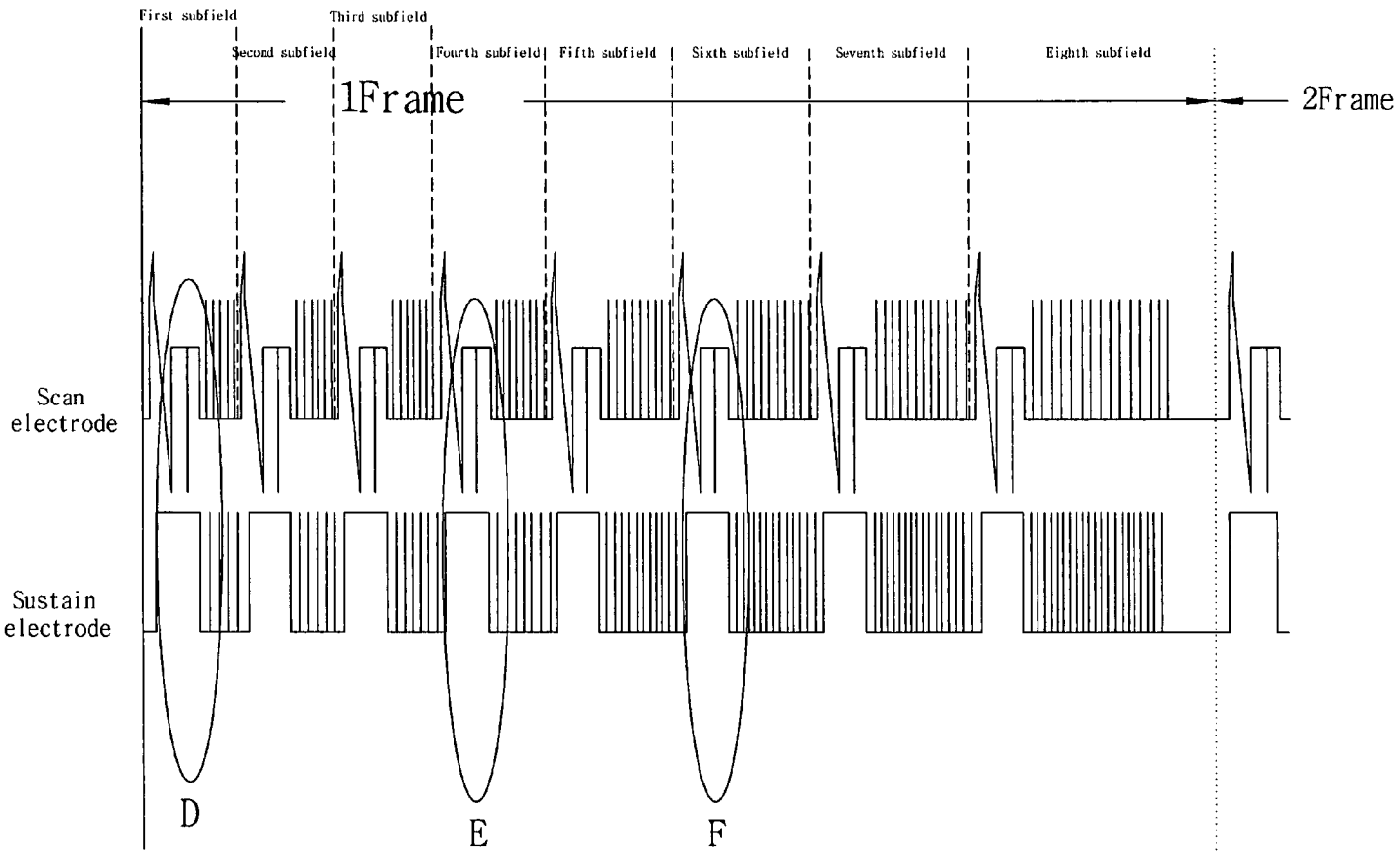
FIG. 31 illustrates an example of setting an application time point of a scan pulse to be different from an application time point of a data pulse depending on each subfield within a frame in a driving waveform of a driving method of a plasma display apparatus according to the eighth embodiment of the present invention.

FIG. 31 illustrates an example of setting an application time point of a scan pulse to be different from an application time point of a data pulse depending on each subfield within a frame in the driving waveform of the driving method of the plasma display apparatus according to the eighth embodiment of the present invention.

Like the seventh embodiment, in the driving method according to the eighth embodiment of the present invention, only a case where application time points of the scan pulse applied to a scan electrode and the data pulse applied to an address electrode are different from one another in an address period is illustrated and described. However, the eighth embodiment of the present invention is the same as the sixth or second embodiment and accordingly, even in the eighth embodiment of the present invention, a length of a sustain period is controlled to reduce the number of space charges within a discharge cell as in the sixth or second embodiment. The controlling of the length of the sustain period of the eighth embodiment of the present invention is substantially the same as that of the sixth or seventh embodiment and therefore, its duplicate description will be omitted. Further, illustrations in the drawings will be also omitted.

As shown in FIG. 29, in the driving waveform according to the driving method of the plasma display apparatus according to the present invention, the differences between the application time points of the data pulses applied to the address electrodes (X) are the same in the same subfield, and the application time point of the scan pulse applied to the scan electrode (Y) and the application time point of the data pulse applied to the address electrode (X) are different from each other, and in at least any one of the subfields within one frame, the difference between the application time points of the data pulses applied to the address electrodes (X) in the address period is different from the difference between the application time points of the data pulses applied to the address electrodes in the address period of another subfield.

The length of the sustain period is controlled, thereby preventing high temperature erroneous discharges as described above.

The application time point of the scan pulse applied to the scan electrode (Y) and the application time point of the data pulse applied to the address electrodes (X1 to Xn), thereby preventing destabilization of the address discharge and preventing a reduction of driving stability. Accordingly, the driving efficiency is enhanced.

In an exemplary method where the application time points of the data pulse and the scan pulse are different from each other, in a first subfield of one frame, the application time point of the data pulse applied to the address electrodes (X1 to Xn) is different from the application time point of the scan pulse applied to the scan electrode (Y) while the difference between the application time point of the data pulses applied to the address electrode is set to "Δt". Further, like the first subfield, in a second subfield, the application time point of the data pulse applied to the address electrodes (X1 to Xn) is different from the application time point of the scan pulse applied to the scan electrode (Y) while the difference between the application time points of the data pulses applied to the address electrodes is set to "2Δt". In the above method, the differences between the application time points of the data pulses applied to the address electrodes can be different from one another in each subfield included in one frame such as "3Δt" and "4Δt".

In the driving waveform of the present invention, in at least one subfield, the application time point of the data pulse and the application time point of the scan pulse are different from each other while, at each subfield, the application time point of the data pulse can also be set, differently from one another, to be earlier and later than application time point of the scan pulse. For example, in the first subfield, the application time point of the data pulse is set to be earlier and later than the application time point of the scan pulse, and in the second subfield, the application time points of the data pulses are all set to be earlier than the application time point of the scan pulse, and in the third subfield, all of the application time points of the data pulses can also be set to be later than the application time point of the scan pulse.

Such a driving waveform will be in more detail described with reference to FIGS. 32A to 32C below, using regions D, E and F of FIG. 31.

Figure 32A:
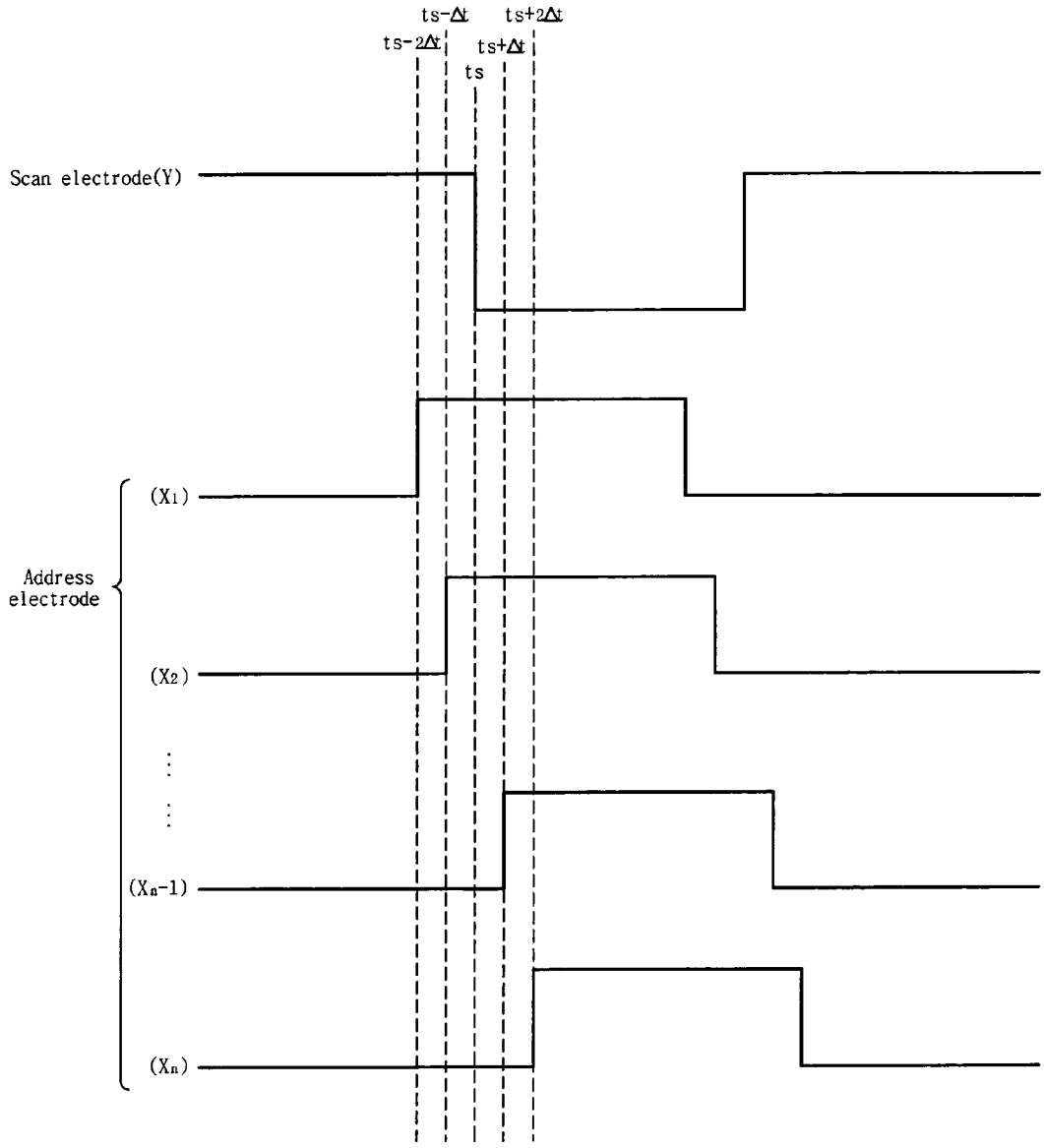
FIGS. 32A to 32C illustrate a more detailed description of the driving waveform of FIG. 31.
Figure 32B:
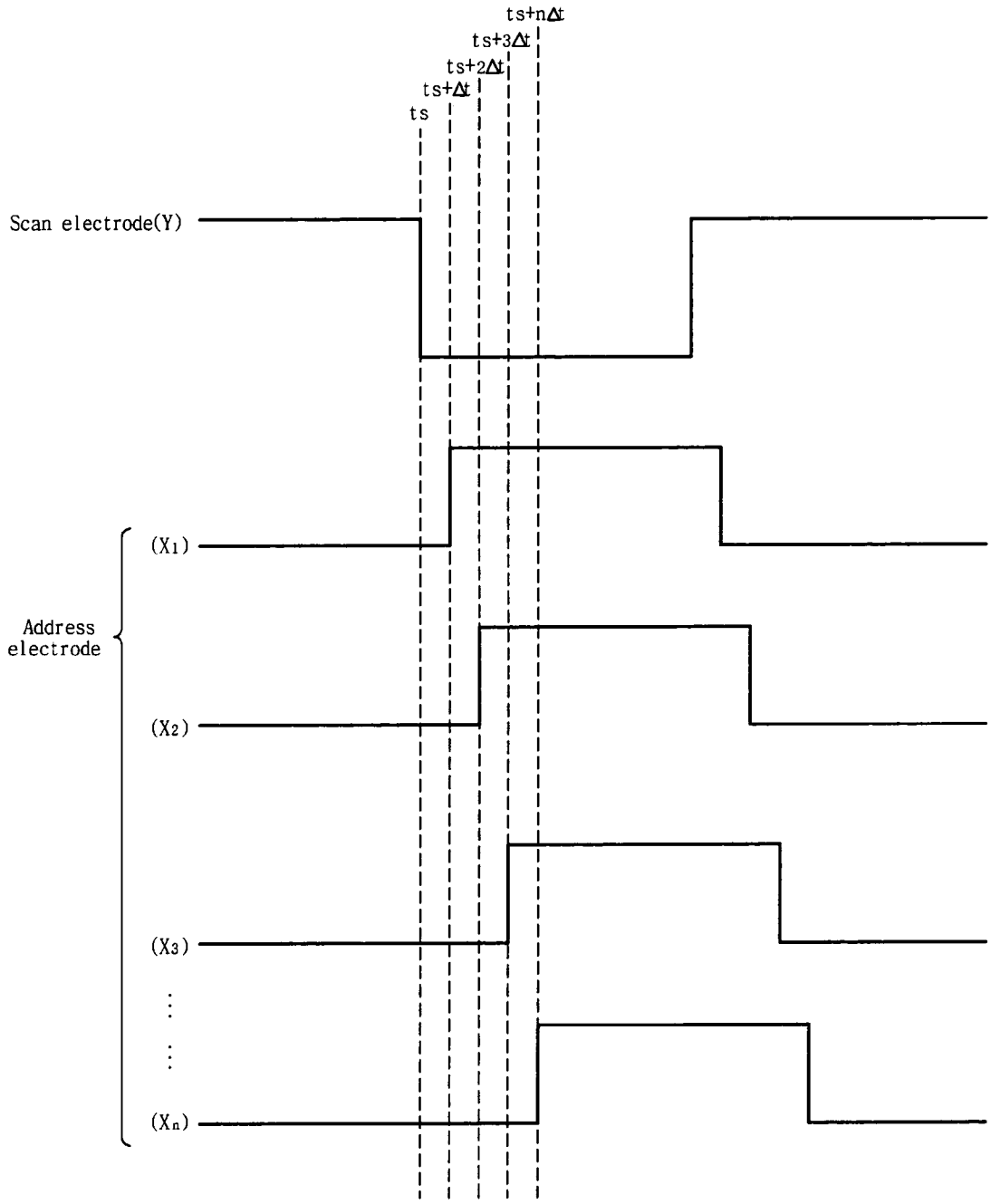
Figure 32C:
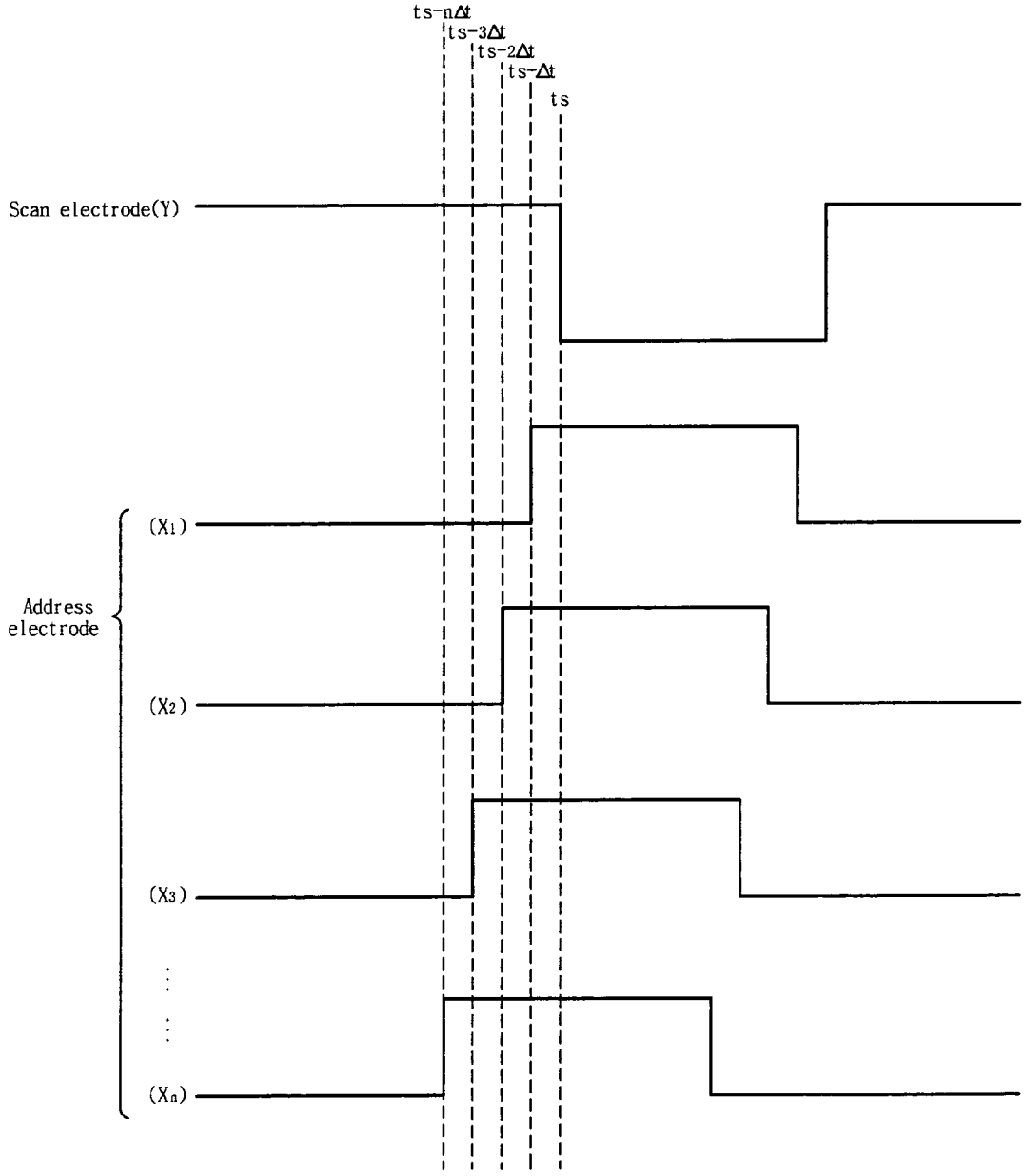

FIGS. 32A to 32C illustrate in more detail the driving waveform of FIG. 31.

Figure 8:
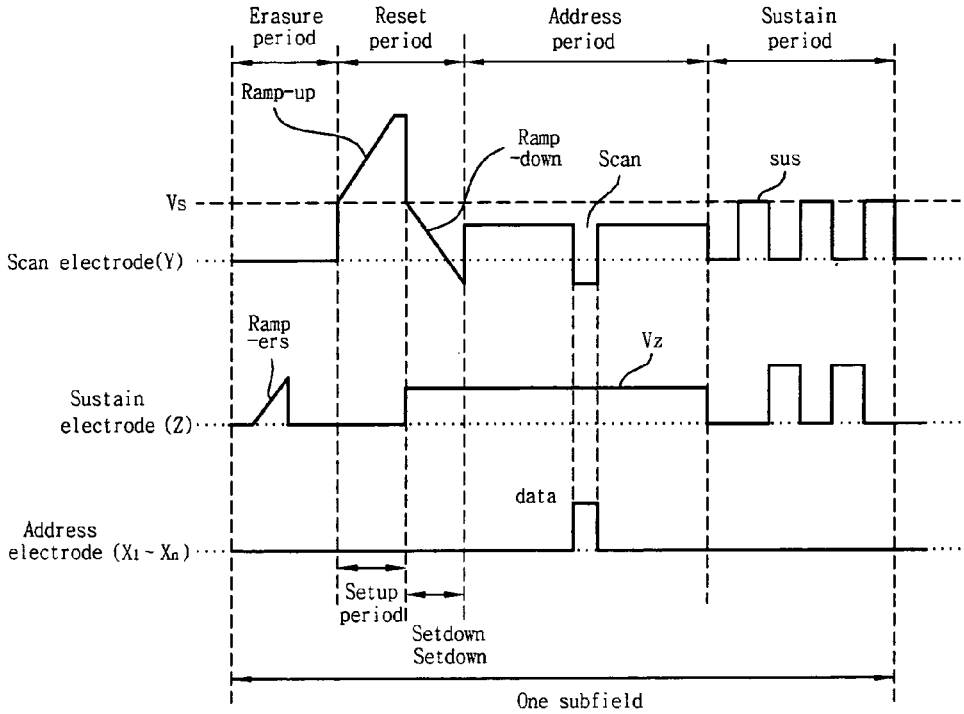
FIG. 8 illustrates another example of a driving waveform according to a conventional driving method of a plasma display apparatus.
Figure 9:
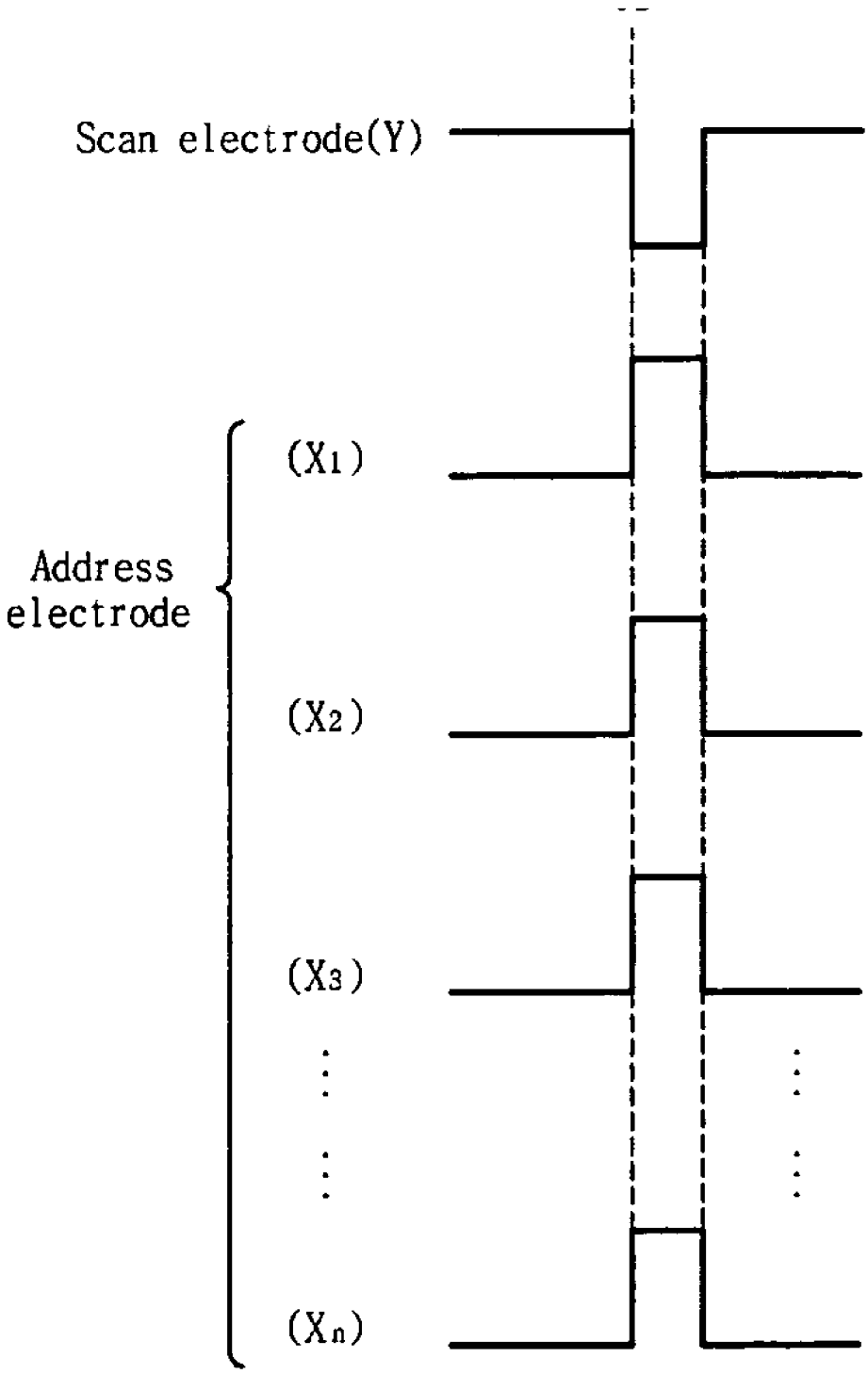
FIG. 9 illustrates an application time point of a pulse applied in an address period in a conventional driving method of a plasma display apparatus.

Referring first to FIG. 32A, in the driving waveform according to the driving method of the present invention, for example, in the first subfield, assuming that the application time point of the scan pulse applied to the scan electrode (Y), in the D region of FIG. 31, the data pulse is applied to the address electrode (X1) at a time point earlier by 2Δt than a time point at which the scan pulse is applied to the scan electrode (Y), that is, at a time point "ts−2Δt" adaptively to an arrangement sequence of the address electrodes (X1 to Xn). The data pulse is applied to the address electrode (X2) at a time point earlier by At than a time point at which the scan pulse is applied to the scan electrode (Y), at a time point "ts−Δt". In this method, the data pulse is applied to the electrode (Xn−1) at a time point "ts−Δt", and the data pulse is applied to the electrode (Xn) at a time point "ts−2Δt". In other words, as shown in FIG. 8A, the data pulse is applied to the address electrodes (X1 to Xn) before or after the application time point of the scan pulse applied to the scan electrode (Y).

Referring to FIG. 32B, unlike FIG. 32A, in the driving waveform of the present invention, in the E region of FIG. 31, the application time point of the data pulse applied to the address electrodes (X1 to Xn) is different from the application time point of the scan pulse applied to the scan electrode (Y), and the application time points of all data pulses are later than the application time point of the scan pulse described above. In FIG. 32B, the application time points of all data pulses are later than the application time point of the scan pulse, but only the application time point of one data pulse can be set to be later than the application time point of the scan pulse described above, and the number of the data pulses applied later than the application time point of the scan pulse can be changed. For example, as shown in FIG. 32B, in the driving waveform according to the driving method of the present invention, assuming that the application time point of the scan pulse applied to the scan electrode (Y) is "ts", the data pulse is applied to the address electrode (X1) at a time point later by Δt than a time point at which the scan pulse is applied to the scan electrode (Y), that is, at a time point "ts+Δt" adaptively to the arrangement sequence of the address electrodes (X1 to Xn). The data pulse is applied to the address electrode (X2) at a time point later by 2Δt than a time point at which the scan pulse is applied to the scan electrode (Y), that is, at a time point "ts+2Δt". In this method, the data pulse is applied to the electrode (X3) at a time point "ts+3Δt", and the data pulse is applied to the electrode (Xn) at a time point "ts+nΔt".

Referring to FIG. 32C, unlike FIG. 32A or FIG. 32B, in the driving waveform of the present invention, in the F region of FIG. 31, the application time point of the data pulse applied to the address electrodes (X1 to Xn) is different from the application time point of the scan pulse applied to the scan electrode (Y) and the application time points of all of the data pulses are earlier than the application time point of the scan pulse described above. In FIG. 32C, the application time points of all of the data pulses are earlier than the application time point of the scan pulse, but only the application time point of one data pulse can be set to be earlier than the application time point of the scan pulse described above, and the number of the data pulses applied earlier than the application time point of the scan pulse can be changed. For example, as shown in FIG. 32C, in the driving waveform according to the driving method of the present invention, assuming that the application time point of the scan pulse applied to the scan electrode (Y) is "ts", the data pulse is applied to the address electrode (X1) at a time point earlier by Δt than a time point at which the scan pulse is applied to the scan electrode (Y), that is, at a time point "ts−Δt" adaptively to the arrangement sequence of the address electrodes (X1 to Xn). The data pulse is applied to the address electrode (X2) at a time point earlier by 2Δt than a time point at which the scan pulse is applied to the scan electrode (Y), that is, at a time point "ts−2Δt". By this method, the data pulse is applied to the electrode (X3) at a time point "ts−3Δt", and the data pulse is applied to the electrode (Xn) at a time point "ts−nΔt". In other words, as shown in FIG. 32C, the data pulse is applied to the address electrodes (X1 to Xn) before the application time point of the scan pulse applied to the scan electrode (Y).

The driving waveforms of FIGS. 32A, 32B and 32C are the same as the driving waveforms of FIGS. 27A, 27B and 27D. Accordingly, a more duplicate description will be omitted.

If the application time point of the scan pulse applied to the scan electrode (Y) and the application time point of the data pulse applied to the address electrodes (X1 to Xn) are different in the address period in each subfield as described above, coupling through a capacitance of the panel decreases at each application time point of the data pulse applied to the address electrodes (X1 to Xn), thereby reducing the noise of the waveforms applied to the scan electrode and the sustain electrode. Accordingly, the address discharge generated in the address period is stabilized, thereby preventing a reduction of the driving stability of the plasma display panel.

As a result, the address discharge of the plasma display panel is stabilized, thereby making it possible to employ a single scan method where a whole panel is scanned with one driver.

In addition, the length of the sustain period is controlled thereby preventing high temperature erroneous discharges.

As described above, it will understood by those skilled in the art of the present invention that the present invention can be embodied in other concrete forms. For example, the above illustrates and describes only a method where the data pulse is applied to all address electrodes (X1 to Xn) at the time point different from the time point at which the scan pulse is applied to all the address electrodes (X1 to Xn) or all the address electrodes are grouped as four electrode groups having the same number of the address electrodes according to the arrangement sequence, and the data pulse is applied at each electrode group at the time point different from the time point at which the scan pulse is applied. However, there can be also provided a method where among all of the address electrodes (X1 to Xn), the odd numbered address electrodes are set as one electrode group, and the even numbered address electrodes are set as another electrode group, and the data pulse is applied at the same time point to all the address electrodes within the same electrode group, and the application time point of the data pulse of each electrode group is set to be different from the application time point at which the scan pulse is applied.

There can be provided a method where the address electrodes (X1 to Xn) are grouped as a plurality of electrode groups having the number of the address electrodes having at least one different address electrode, and the data pulse is applied at each electrode group at the time point different from the application time point of the scan pulse. For example, the driving method of the plasma display panel of the present invention can be variously modified so that, assuming that the application time point of the scan pulse applied to the scan electrode (Y) is "ts", the data pulse is applied to the address electrode (X1) at the time point "ts+Δt", and the data pulses are applied to the address electrodes (X2 to X10) at the time point "ts+3Δt", and the data pulses are applied to the address electrodes (X11 to Xn) at the time point "ts+4Δt".

Figure 33:
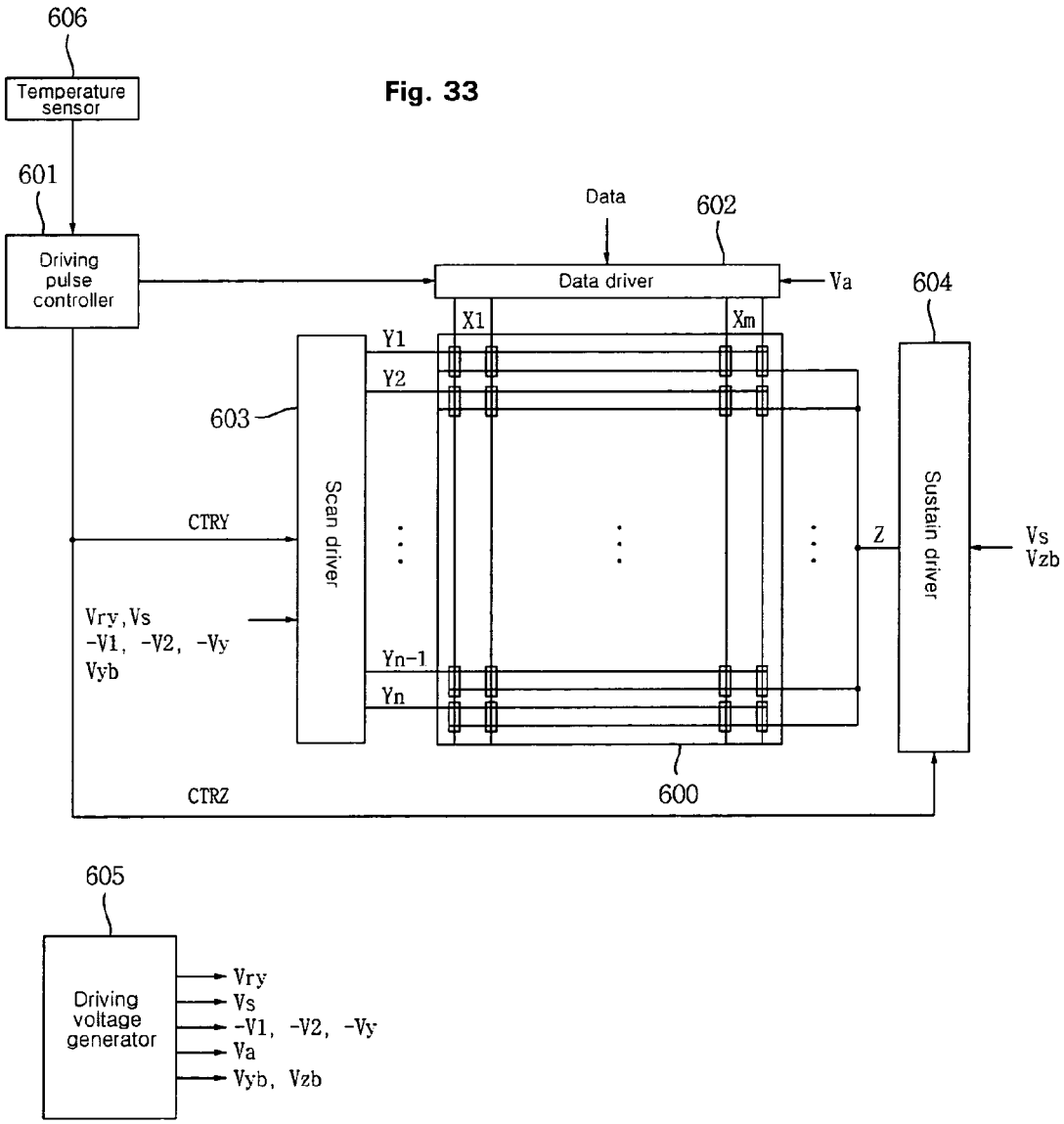
FIG. 33 is a block diagram illustrating a plasma display apparatus according to an embodiment of the present invention.

FIG. 33 is a block diagram illustrating the plasma display apparatus according to an embodiment of the present invention.

Referring to FIG. 33, the inventive plasma display apparatus includes a plasma display panel (PDP) 600; a temperature sensor 606 for sensing a temperature of the PDP 600; a data driver 602 for supplying data to the address electrodes (X1 to Xm) of the PDP 600; a scan driver 603 for driving the scan electrodes (Y1 to Yn) of the PDP 600; a sustain driver 604 for driving the sustain electrodes (Z) of the PDP 600; a driving pulse controller 601 for controlling each of the drivers 602, 603 and 604 depending on the temperature of the PDP 600; and a driving voltage generator 605 for generating driving voltages necessary for the drivers 602, 603 and 604.

The temperature sensor 606 senses the temperature of the PDP, generates a sense voltage, converts the sense voltage into a digital signal and supplies the converted digital signal to the driving pulse controller 601.

The data driver 602 receives data that is inverse-gamma corrected and error-diffused by an inverse gamma correction circuit and an error diffusion circuit and is mapped to a preset subfield pattern by a subfield mapping circuit. The data driver 602 applies 0V or the ground level voltage to the address electrodes (X1 to Xm) in the pre reset period (PRERP), the reset period (RP), and the sustain period (SP). The data driver 602 samples and latches data during the address period (AP) of each subfield under the control of the controller 601 and then supplies a data voltage (Va) to the address electrodes (X1 to Xm).

The scan driver 603 supplies a ramp-up waveform (ramp-up) and a ramp-down waveform (ramp-down) to the scan electrode (Y) during the reset period. Further, the scan driver 603 sequentially supplies the scan pulse (Sp) of the negative scan voltage (−Vy) to the scan electrode (Y) during the address period, and supplies the sustain pulse (SUS) to the scan electrode (Y) during the sustain period.

As shown in FIGS. 12, 13, 14, 16, 22, 23 and 24, under the control of the driving pulse controller 601, the scan driver 603 supplies the ramp waveforms (NRY1, PRY1, PRY2, and NRY2) to initialize the all of the discharge cells in the pre reset period (PRERP) and the reset period (RP) and then sequentially supplies the scan pulse (SCNP) to the scan electrodes (Y1 to Yn) to select the scan line to which the data is supplied during the address period (AP). The scan driver 603 supplies the sustain pulses (FSTSUSP and SUSP) having the rising period and the falling period of about 340 ns±60 ns to the scan electrodes (Y1 to Yn) to generate the sustain discharge within the on-cells selected in the sustain period when the PDP is at the high temperature.

The sustain driver 604 supplies the positive sustain bias voltage (Vzb) to the sustain electrode (Z) during the period for generating the ramp-down waveform, the address period, and the address period, and is operated alternately with the scan driver 603 and supplies the sustain pulse (SUS) to the sustain electrode (Z).

As shown in FIGS. 14, 16 and 22 to 24, under the control of the driving pulse controller 601, the sustain driver 604 supplies the ramp waveforms (NRZ1, and NRZ2) to the sustain electrodes (Z) to initialize all of the discharge cells in the pre reset period (PRERP) and the reset period (RP), and supplies the Z bias voltage (Vzb) to the sustain electrodes (Z) in the address period (AP). Further, the sustain driver 604 is operated alternately with the scan driver 603 in the sustain period (SP), and supplies the sustain pulses (FSTSUSP, SUSP, and LSTSUSP) to the sustain electrodes (Z). When the PDP is at the high temperature, the pulsewidth of the last sustain pulse (LSTSUSP) generated in the sustain driver 604 is lengthened to 1 μs to 1 ms, and each of the sustain pulses (FSTSUSP, SUSP, and LSTSUSP) has the rising period and the falling period of about 340 ns±60 ns.

The driving pulse controller 601 generates a timing control signal for controlling synchronization with an operation timing of the data driver 602, the scan driver 603, or the sustain driver 604 in the address period, and the sustain period, and supplies the generated timing control signal to the data driver 602, the scan driver 603, or the sustain driver 604, thereby controlling the data driver 602, the scan driver 603, or the sustain driver 604. In particular, the driving pulse controller 601 controls the data driver 602, the scan driver 603, or the sustain driver 604 so that, in the address period of at least any one of the subfields of the frame, the application time point of the data pulse applied to at least one of the plurality of address electrode groups including at least one address electrode (X) is different from the application time point of the scan pulse applied to the scan electrode (Y), and the length of the sustain period for which the sustain pulse is applied to the scan electrode (Y) or the sustain electrode (Z) is controlled to reduce the space charges within the discharge cell.

The driving pulse controller 601 receives a vertical/horizontal synchronization signal and a clock signal, generates timing control signals (CTRX, CTRY, and CTRZ) necessary for each driver 602, 603 and 604, and supplies the timing control signals (CTRX, CTRY and CTRZ) to the corresponding drivers 602, 603 and 604, thereby controlling each of the drivers 602, 603 and 604. The timing control signal (CTRX) supplied to the data driver 602 includes a sampling clock for sampling data, a latch control signal and a switch control signal for controlling on/off times of an energy recovery circuit and a driving switching element. The timing control signal (CTRY) applied to the scan driver 603 includes a switch control signal for controlling the on/off times of the energy recovery circuit and the driving switching element of the scan driver 603. The timing control signal (CTRZ) applied to the sustain driver 604 includes a switch control signal for controlling the on/off times of an energy recovery circuit and a driving switching element of the sustain driver 604.

The driving pulse controller 601 receives an output voltage of the temperature sensor 606, and controls the scan driver 604 and the sustain driver 604 so that, when the PDP 600 is at the high temperature, the pulsewidth of the last sustain pulse (LSTSUSP) is lengthened to have a range of 1 μs to 1 ms, and controls the scan driver 603 and the sustain driver 604 so that each of the sustain pulses (FSTSUSP, SUSP, and LSTSUSP) has the rising period and the falling period of 340 ns±60 ns. Further, the driving pulse controller 601 controls the scan driver 603 and the sustain driver 604 to supply the positive sustain voltage (Vs) to the sustain electrodes (Z) prior to the first Y negative ramp waveform (NRY1).

The driving voltage generator 605 generates the driving voltages (Vry, Vs, −V1, −V2, −Vy, Va, Vyb and Vzb) supplied to the PDP 600. These driving voltages can be varied depending on a discharge characteristic or a composition of the discharge gas varied according to a resolution and a model of the PDP 600.

The invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising a scan electrode, a sustain electrode and an address electrode;

a first controller for controlling an application time point of the data pulse for the address electrode during address period to be different from an application time point of a scan pulse for the scan electrode; and a second controller for controlling a last sustain pulse applied to at least one of the scan electrode and the sustain electrode, wherein the second controller controls, when the temperature in the plasma display panel or the temperature around the plasma display panel is substantially higher than room temperature, an interval between the application time point of the last sustain pulse and an initialization signal of a next subfield to be longer than the interval for a PDP in room temperature.

2. The plasma display apparatus of claim 1, wherein the first controller controls the application time point of the data pulse to be applied prior to the application time point of the scan pulse.

3. The plasma display apparatus of claim 1, wherein the first controller controls the application time point of the data pulse to be later than the application time point of the scan pulse.

4. The plasma display apparatus of claim 1, wherein a rising time or falling time of the sustain pulse ranges from 320 ns to 360 ns when the temperature of the plasma display panel or of the proximate area of the panel is substantially higher than room temperature.

5. The plasma display apparatus of claim 1, wherein a difference between the application time point of the data pulse and the application time point of the scan pulse ranges from 10 ns to 1 μs.

6. The plasma display apparatus of claim 5, wherein, following the last sustain pulse, a ramp-down waveform having a gradually decreasing voltage is applied to the scan electrode.

7. The plasma display apparatus of claim 6, wherein a substantial sustain voltage is applied to the sustain electrode when the ramp-down waveform is applied to the scan electrode.

8. The plasma display apparatus of claim 7, wherein the sustain voltage is applied after a predetermined time is elapsed when the last sustain pulse is applied to the scan electrode.

9. A plasma display apparatus comprising:

a plasma display panel comprising a scan electrode, a sustain electrode and an address electrode;

a first controller for controlling the application time point of a data pulse for the address electrode during address period to be different from another; and a second controller for controlling a last sustain pulse applied to at least one of the scan electrode and the sustain electrode, wherein the second controller controls the width of the last sustain pulse to be different from the width of other sustain pulse in at least one of the subfields of a frame during sustain period.

10. The plasma display apparatus of claim 9, wherein, when the temperature in the plasma display panel or the temperature around the plasma display panel is substantially higher than room temperature, the first controller applies a prereset pulse having a negative polarity ramp waveform prior to the reset pulse application to the scan electrode in at least one of the subfields of the frame.

11. The plasma display apparatus of claim 9, wherein the interval between the end time point of the last sustain pulse application and an initialization signal of a next subfield ranges from 100 μs to 1 ms when the temperature in the plasma display panel or the temperature around the plasma display panel are substantially a high temperature.

12. The plasma display apparatus of claim 9, wherein the width of the last sustain pulse ranges from 1 μs to 1 ms when the temperature in the plasma display panel or the temperature around the plasma display panel are substantially a high temperature.

13. The plasma display apparatus of claim 10, wherein the width of the first pulses applied to the scan electrode and the sustain electrode respectively during the sustain period and the width of the last sustain pulse applied to the sustain electrode are set to be wider than the other sustain pulses, after the prereset pulse is applied to the scan electrode.

14. The plasma display apparatus of claim 10, wherein the prereset pulse is a ramp-down waveform.

15. The plasma display apparatus of claim 14, wherein a ramp-down waveform having a negative polarity is applied to the scan electrode during setdown period of a reset period, after the ramp-down waveform having the negative polarity is applied to the scan electrode during the prereset period.

16. The plasma display apparatus of claim 15, a ramp-down waveform is applied to the sustain electrode during setdown period of the reset period.

17. The plasma display apparatus of claim 11, wherein, when the temperature in the plasma display panel or the temperature around the plasma display panel is substantially a high temperature, the width of the last sustain pulse is wider than that of other sustain pulse in the previous subfield of a subfield where the prereset pulse is applied.

18. A driving method of a plasma display apparatus comprising a scan electrode, a sustain electrode and an address electrode, the method comprising:

applying a data pulse applied to the address electrode and a scan pulse applied to the scan electrode during an address period, wherein the application time point of the data pulse is different from the application time point of the scan pulse, controlling, when the temperature in the plasma display panel or the temperature around the plasma display panel is substantially a high temperature, an interval between the end time point of a last sustain pulse applied to at least one of the scan electrode and the sustain electrode and an initialization signal of the next subfield to be longer than that of room temperature.

19. The method of claim 18, wherein the application time point of the data pulse is prior to the application time point of the scan pulse.

20. The method of claim 18, wherein the application time point of the data pulse is set to be later than the application time point of the scan pulse.

21. The method of claim 18, wherein the rising time or falling time of the sustain pulse ranges from 320 ns to 360 ns when the temperature of the plasma display panel or of the proximate area of the panel is substantially higher than room temperature.

22. The method of claim 18, wherein a difference between the application time point of the data pulse and the application time point of the scan pulse ranges from 10 ns to 1 μs.

23. The method of claim 18, wherein, following the last sustain pulse, a ramp-down waveform having a gradually decreasing voltage is applied to the scan electrode.

24. The method of claim 23, wherein a substantial sustain voltage is applied to the sustain electrode when the ramp-down waveform is applied to the scan electrode.

25. The method of claim 24, wherein the sustain voltage is applied after a predetermined time is elapsed when the last sustain pulse is applied to the scan electrode.

26. A driving method of a plasma display apparatus including a scan electrode, a sustain electrode and an address electrode, the method comprising:

applying a data pulse applied to the address electrode and a scan pulse applied to the scan electrode during an address period, wherein the application time point of the data pulse is different from the application time point of the scan pulse, controlling the width of the last sustain pulse applied to at least one of the scan electrode and the sustain electrode to be different from the width of other sustain pulse in at least one of the subfields of a frame during sustain period.

27. The method of claim 26, wherein, when the temperature in the plasma display panel or the temperature around the plasma display panel is substantially a high temperature, a prereset pulse having a negative polarity ramp waveform is applied to the scan electrode prior to the reset pulse application in at least one of the subfields of the frame.

28. The method of claim 26, wherein the interval between the end time point of the last sustain pulse application and an initialization signal of a next subfield ranges from 100 μs to 1 ms when the temperature in the plasma display panel or the temperature around the plasma display panel is substantially a high temperature.

29. The method of claim 26, wherein the width of the last sustain pulse ranges from 1 μs to 1 ms when the temperature in the plasma display panel or the temperature around the plasma display panel is substantially a high temperature.

30. The method of claim 26, wherein the width of the first pulses applied to the scan electrode and the sustain electrode respectively during the sustain period and the width of the last sustain pulse applied to the sustain electrode are set to be wider than the width of the other sustain pulses, after the prereset pulse is applied to the scan electrode.

31. The method of claim 27, wherein the prereset pulse is a ramp-down waveform.

32. The method of claim 31, wherein a ramp-down waveform having a negative polarity is applied to the scan electrode during setdown period of a reset period, after the ramp-down waveform having the negative polarity is applied to the scan electrode during the prereset period.

33. The method of claim 32, a ramp-down waveform is applied to the sustain electrode during setdown period of the reset period.

34. The method of claim 27, wherein, when the temperature in the plasma display panel or the temperature around the plasma display panel is substantially a high temperature, the width of the last sustain pulse is wider than the width of other sustain pulse in the previous subfield of a subfield where the prereset pulse is applied.

* * * * *